US009815586B2

(12) United States Patent
Graham et al.

(10) Patent No.: US 9,815,586 B2
(45) Date of Patent: Nov. 14, 2017

(54) MACHINE AND METHOD FOR FORMING REINFORCED POLYGONAL CONTAINERS FROM BLANKS

(75) Inventors: Thomas D. Graham, Winter Garden, FL (US); Ricki D. Anderson, Westerville, OH (US); Guillermo Rojas, Miami, FL (US); Kenneth C. Smith, Hiram, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 1292 days.

(21) Appl. No.: 13/339,009

(22) Filed: Dec. 28, 2011

(65) Prior Publication Data

US 2012/0100977 A1 Apr. 26, 2012

Related U.S. Application Data

(60) Division of application No. 12/436,712, filed on May 6, 2009, now Pat. No. 8,105,223, which is a (Continued)

(51) Int. Cl.
*B65D 5/468* (2006.01)
*B65D 5/00* (2006.01)
(Continued)

(52) U.S. Cl.
CPC ..... *B65D 5/4608* (2013.01); *B65D 5/003* (2013.01); *B65D 5/28* (2013.01); *B65D 5/443* (2013.01);
(Continued)

(58) Field of Classification Search
CPC .... B31B 1/48; B31B 1/36; B31B 1/44; B31B 1/46; B31B 1/54; B31B 3/00;
(Continued)

(56) References Cited

U.S. PATENT DOCUMENTS 2,522,597 A 9/1950 Blandford
2,832,270 A 4/1958 Pierce, Jr. et al.
(Continued)

FOREIGN PATENT DOCUMENTS

WO 9714552 A1 4/1997
WO WO9714552 4/1997

OTHER PUBLICATIONS

A second Office Action from the Mexican Institute of Industrial Property (IMPI), dated Jun. 10, 2015, for co-pending Mexican patent application No. MX/a/2011/011983 (9 pgs.).
(Continued)

*Primary Examiner* — Sameh Tawfik
(74) *Attorney, Agent, or Firm* — WestRock IP Legal

(57) ABSTRACT

A method of forming a container from a blank of sheet material using a machine is provided. The blank includes a bottom panel, two side panels, two end panels, and a reinforcing panel assembly extending from a first side panel. The machine includes a hopper station, a corner post forming station, and a plunger station. The method includes rotating the reinforcing panel assembly upwardly toward the first side panel as the blank is transported from the hopper station to the corner post forming station, forming a corner wall and a reinforcing end tab by folding reinforcing panels about fold lines as the blank is transported through the corner post forming station, rotating the side panels and the end panels to be substantially perpendicular to the bottom panel by directing the blank through the plunger station, and coupling the reinforcing end tab to an end panel to form the container.

16 Claims, 44 Drawing Sheets

Related U.S. Application Data continuation-in-part of application No. 12/256,051, filed on Oct. 22, 2008, now Pat. No. 8,820,618.

(60) Provisional application No. 61/107,614, filed on Oct. 22, 2008, provisional application No. 61/051,302, filed on May 7, 2008.

(51) Int. Cl.
*B65D 5/28* (2006.01)
*B65D 5/44* (2006.01)
*B65D 5/66* (2006.01)

(52) U.S. Cl.
CPC .... *B65D 5/6629* (2013.01); *B31B 2201/2637* (2013.01); *B31B 2201/2654* (2013.01); *B31B 2201/2666* (2013.01); *B31B 2201/2675* (2013.01); *B31B 2201/2691* (2013.01); *B31B 2201/27* (2013.01); *B31B 2201/6091* (2013.01)

(58) Field of Classification Search
CPC .... B31B 2201/2637; B31B 2201/2666; B31B 2201/2675; B31B 2201/2691; B31B 2201/27; B65D 5/003; B65D 5/28; B65D 5/443; B65D 5/4608; B65D 5/6629
USPC ..... 493/127, 143, 125, 167
See application file for complete search history.

(56) References Cited

U.S. PATENT DOCUMENTS 3,034,698 A 5/1962 Forrer
3,883,067 A 5/1975 McGlynn et al.
3,940,053 A 2/1976 Putman et al.
3,952,634 A 4/1976 Rollins et al.
3,978,774 A 9/1976 Royal
4,052,932 A * 10/1977 Huiskes ..... B31B 1/54 493/13
4,056,223 A 11/1977 Williams
4,139,146 A 2/1979 Bamburg et al.
4,211,153 A 7/1980 Walters et al.
4,215,525 A 8/1980 Nigrelli
4,235,364 A 11/1980 Baker
4,261,254 A 4/1981 Nowacki
4,308,023 A 12/1981 Bidegain
4,345,905 A 8/1982 Moen
4,464,155 A * 8/1984 Collura ..... B31B 1/44 493/137
4,516,210 A 5/1985 Dahlke
4,581,005 A 4/1986 Moen
4,621,766 A 11/1986 McClure
4,624,653 A 11/1986 McBride et al.
4,636,187 A 1/1987 Oakley
4,674,998 A * 6/1987 Benedicenti ..... B31B 1/44 493/124
4,676,428 A 6/1987 McClure
4,676,429 A * 6/1987 Crowe ..... B65D 5/2033 229/109
4,792,084 A * 12/1988 Dreeszen ..... B65D 5/2033 229/109
4,843,798 A 7/1989 Focke et al.
4,919,326 A 4/1990 Deiger
4,988,331 A 1/1991 Boisseau
5,000,377 A 3/1991 McClure
5,002,224 A 3/1991 Muise
5,028,000 A * 7/1991 Chabot ..... B65D 5/0045 229/143
5,125,567 A 6/1992 McClure
5,131,208 A 7/1992 Paul et al.
5,139,195 A 8/1992 McClure
5,147,271 A 9/1992 Bacques et al.
5,184,998 A 2/1993 Volk et al.
5,207,375 A 5/1993 McClure
5,261,594 A 11/1993 Brown et al.
5,285,956 A 2/1994 Piepho
5,289,970 A 3/1994 McClure
5,289,971 A 3/1994 McClure
5,295,623 A * 3/1994 Bacques ..... B65D 71/36 229/109
5,295,631 A 3/1994 McClure
5,372,569 A 12/1994 Ballos, III
5,400,955 A 3/1995 Coalier et al.
5,487,504 A 1/1996 Baird
5,489,061 A * 2/1996 Fogle ..... B65D 5/323 229/109
5,535,941 A * 7/1996 Garza ..... B65D 5/6644 229/191
5,588,585 A * 12/1996 McClure ..... B65D 5/6632 229/149
5,624,031 A 4/1997 Fowler et al.
5,673,848 A 10/1997 Garza
5,687,902 A 11/1997 Tusing et al.
5,752,648 A 5/1998 Quaintance
5,782,732 A 7/1998 Herrin
5,807,223 A 9/1998 Holton
5,807,225 A 9/1998 Nowacki et al.
5,876,319 A 3/1999 Holton
5,950,911 A 9/1999 Naughton et al.
5,971,906 A * 10/1999 Tharpe, Jr. ..... B31B 1/36 493/124
5,996,885 A 12/1999 Chu
6,015,084 A 1/2000 Mathieu et al.
6,131,805 A 10/2000 Gasior
6,223,978 B1 5/2001 Drager
6,319,183 B1 11/2001 Ballos, III
6,367,690 B1 4/2002 McClure
6,402,020 B1 6/2002 McClure
6,508,395 B2 * 1/2003 McLeod ..... B65D 5/0025 229/168
6,575,356 B2 6/2003 McClure
6,595,411 B2 7/2003 McClure
6,651,875 B2 11/2003 Chu
7,152,777 B2 12/2006 McClure
7,207,473 B2 4/2007 Fry
7,290,696 B2 11/2007 McClure
7,458,503 B2 12/2008 Fry
7,470,225 B2 * 12/2008 Herrin ..... B31B 1/00 493/126
7,470,226 B1 * 12/2008 Herrin ..... B65D 5/0045 493/125
7,559,884 B2 7/2009 Kisch
7,628,313 B2 12/2009 Fry
7,677,434 B2 3/2010 Fry
7,857,743 B2 12/2010 Barner
7,922,069 B2 4/2011 Gardner
7,935,041 B2 5/2011 Graham et al.
8,087,569 B2 1/2012 Ledvina
8,105,223 B2 1/2012 Graham et al.
8,128,547 B2 3/2012 Graham et al.
8,408,452 B2 * 4/2013 Churvis ..... B65D 5/28 229/108
2005/0067478 A1 3/2005 McClure
2005/0137072 A1 6/2005 Jackson
2007/0000985 A1 1/2007 McClure
2007/0000986 A1 * 1/2007 McClure ..... B65D 5/443 229/143
2007/0228119 A1 10/2007 Barner
2008/0000784 A1 1/2008 McClure
2009/0266873 A1 10/2009 Ledvina
2009/0277952 A1 11/2009 Smith
2009/0280973 A1 11/2009 Graham et al.
2011/0281705 A1 11/2011 Aganovic et al.
2012/0100977 A1 4/2012 Graham et al.

OTHER PUBLICATIONS

International Search Report and Written Opinion, dated Nov. 13, 2014, for International application No. PCT/US14/37546 (16 pgs).
International Search Report and Written Opinion, dated Nov. 13, 2014, for International application No. PCT/US14/37542 (19 pgs).

(56) References Cited

OTHER PUBLICATIONS

International Search Report and Written Opinion for PCT/US14/37542.
International Search Report and Written Opinion for PCT/US14/37546.

* cited by examiner

MACHINE AND METHOD FOR FORMING REINFORCED POLYGONAL CONTAINERS FROM BLANKS

CROSS REFERENCE TO RELATED APPLICATIONS

This is a Divisional application of U.S. patent application Ser. No. 12/436,712, filed May 6, 2009, now issued as U.S. Pat. No. 8,105,223, which is a continuation-in-part of U.S. patent application Ser. No. 12/256,051, filed May 7, 2008, now issued as U.S. Pat. No. 8,820,618, and which claims the priority of U.S. Provisional Patent Application Ser. No. 61/107,614, filed Oct. 22, 2008, and U.S. Provisional Patent Application Ser. No. 61/051,302 filed May 7, 2008, all of which are hereby incorporated by reference in their entirety.

BACKGROUND OF THE INVENTION

The field of the invention relates generally to a blank and a reinforced polygonal container formed from the blank and more particularly, to a machine for forming the reinforced polygonal container from the blank.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, it is difficult to form a container from a single sheet of material that includes multiple reinforcing panels along the corner and side walls. Accordingly, a need exists for a multi-sided reinforced container, also known as a mitered tray and/or a Meta Tray 8™ (Meta Tray 8 is a trademark of Smurfit-Stone Container Corporation located in Chicago, Ill.), formed from a single blank that can be easily formed at high-speeds. Further, a need exists for a machine that can form a reinforced polygonal container from a blank of sheet material at a high-speed.

BRIEF DESCRIPTION OF THE INVENTION

In one aspect, a method of forming a polygonal container from a blank of sheet material using a machine is provided. The blank includes a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines. The reinforcing panel assembly extends from a first side edge of a first side panel of the two side panels. The machine includes a hopper station, a corner post forming station, and a plunger station. The method includes rotating the reinforcing panel assembly upwardly about a first fold line of the plurality of fold lines toward the first side panel as the blank is transported from the hopper station to the corner post forming station, wherein an exterior surface of the blank faces downward within the hopper station, forming a corner wall and a reinforcing end tab by folding the plurality of reinforcing panels about the plurality of fold lines as the blank is transported through the corner post forming station to the plunger station, rotating the side panels and the end panels to be substantially perpendicular to the bottom panel by directing the blank through the plunger station, and coupling the reinforcing end tab to one of the end panels to form the container.

In another aspect, a machine for forming a polygonal container from a blank of sheet material is provided. The blank includes a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines. The reinforcing panel assembly extends from a first side edge of a first side panel of the two side panels. The machine includes a hopper station configured to rotate the reinforcing panel assembly upwardly about a first fold line of the plurality of fold lines toward the first side panel. An exterior surface of the blank is facing downward within the hopper station. The machine further includes a corner post forming station configured to form a partially formed container from the blank by folding the plurality of reinforcing panels about the plurality of fold lines. The partially formed container includes a corner wall and a reinforcing end tab formed from the reinforcing panel assembly. The machine includes a plunger station configured to rotate the side panels and the end panels to be substantially perpendicular to the bottom panel and to couple the reinforcing end tab to one of the end panels to transform the partially formed container into the container.

In yet another aspect, a machine for forming a polygonal container from a blank of sheet material is provided. The blank includes a bottom panel having opposing side edges and opposing end edges, two opposing side panels each extending from one of the side edges of the bottom panel, two opposing end panels each extending from one of the end edges of the bottom panel, and a reinforcing panel assembly extending from a first side edge of a first side panel of the two side panels. The reinforcing panel assembly includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel. The machine includes a hopper configured to support the blank substantially horizontally with an exterior surface of the blank facing downward, a feed mechanism configured to pull the blank downward from the hopper to remove the blank from the hopper, at least one hopper plow configured to fold the reinforcing panel assembly with respect to the first side panel, and a transport system configured to transport the blank from the feed mechanism through a corner post forming station to a plunger. The corner post forming station includes a first upper rail, a first lower rail, a second lower rail, a stop plate, a second upper rail, and a third lower rail. The first upper rail is configured to rotate an interior surface of the inner reinforcing panel into face-to-face contact with an interior surface of the outer reinforcing panel by contacting an exterior surface of at least one of the inner reinforcing panel and the inner side panel. The first lower rail is configured to maintain a position of the outer reinforcing panel with respect to the first side panel by contacting an interior surface of the outer reinforcing panel while the blank is transported through the corner post forming station. The second lower rail is configured to maintain the position of the outer reinforcing panel with respect to the first side panel by contacting an exterior surface of the outer reinforcing panel while the blank is transported through the corner post forming station. The stop plate is positioned adjacent to the first upper rail. The upper rail is configured to rotate the inner side panel toward the stop plate, and the stop plate configured to apply a force to an interior surface of the inner side panel to rotate the inner side panel toward the exterior surface of the inner reinforcing panel. The second upper rail is configured to rotate the first reinforcing end panel and the second reinforcing end panel toward an exterior surface of the reinforcing corner panel by contacting an exterior surface of the first reinforcing end panel, wherein the first reinforcing end panel and the second reinforcing end panel are in face-to-face contact. The third lower rail is configured to maintain a position of the corner panel and the reinforcing corner panel with respect the first side panel by contacting an exterior surface of the corner panel while the blank is transported through the corner post forming station, wherein the corner panel and the reinforcing corner panel in face-to-face contact. A partially formed container is formed by the first and second upper rails and the first, second, and third lower rails, and the partially formed container includes a corner wall and a reinforcing end tab. The machine further includes a plurality of plunger plows configured to rotate the side panels and the end panels toward an interior surface of the bottom panel to form side walls and end walls of the container and to secure the reinforcing end tab to one of the end panels. The plurality of plows at least partially defines a plunger opening. The machine includes a plunger having a cross-sectional shape corresponding to a cross-sectional shape of the container and being vertically movable through the plunger opening. The plunger is configured to contact an interior surface of the bottom panel and to push the partially formed container downward through the plunger opening and past the plurality of plunger plows to transform the partially formed container into the container.

DETAILED DESCRIPTION OF THE INVENTION

Figure 1:
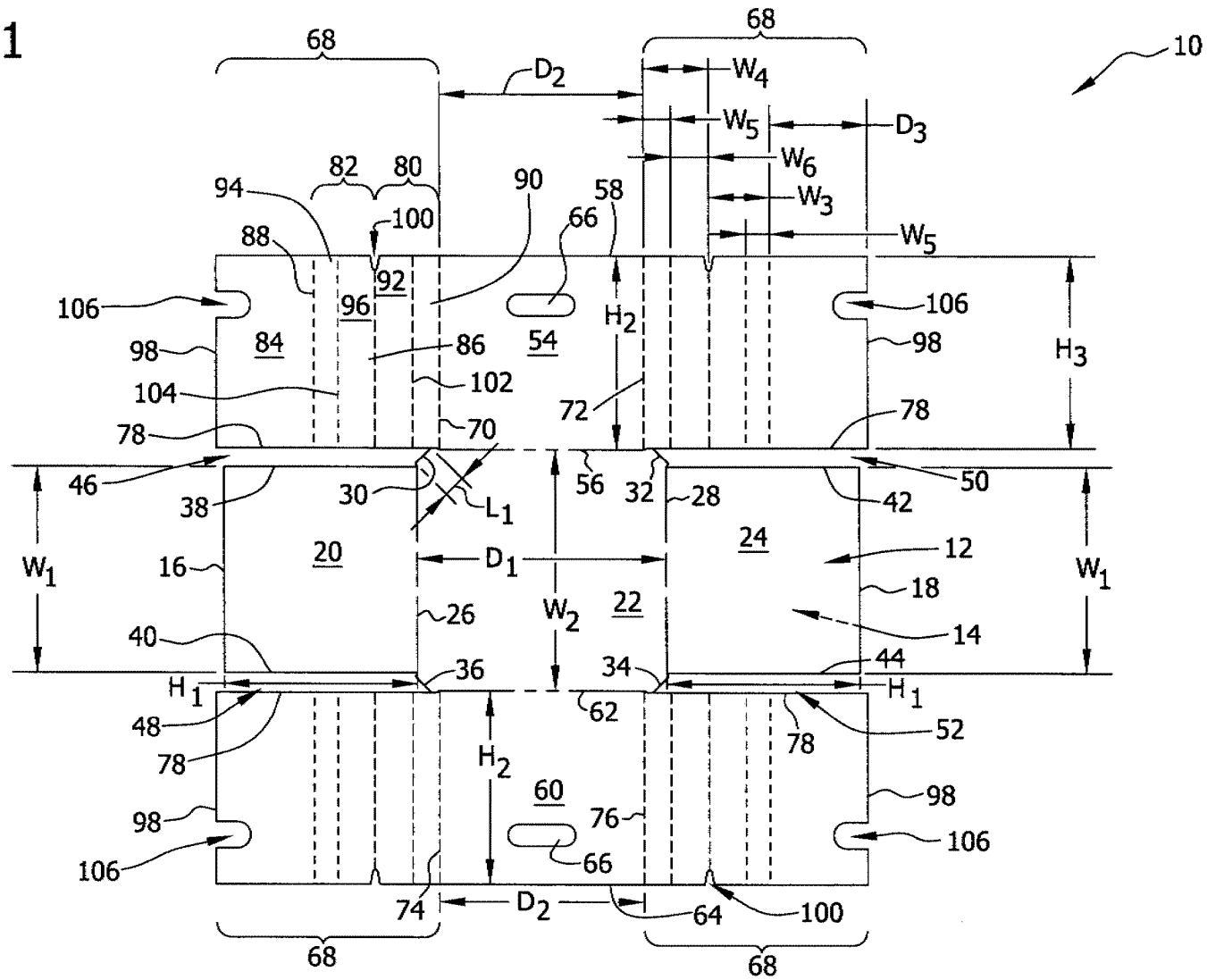
FIG. 1 is a top plan view of a blank of sheet material for constructing a container according to a first embodiment of the present invention.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, reinforced container formed from a single sheet of material, and a method and machine for constructing the container. The container is sometimes referred to as a reinforced mitered tray or a reinforced eight-sided tray. The container may be constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

In one aspect, a machine for forming a polygonal container from a blank of sheet material is provided. The blank includes a bottom panel, two opposing side panels each extending from a side edge of the bottom panel, two opposing end panels each extending from an end edge of the bottom panel, and a reinforcing panel assembly extending from a first side edge of a first side panel of the two side panels. The machine includes a hopper station, a forming station, an ejection station, and a transport system through the hopper station, the forming station, and the ejection station. The forming station includes a corner post forming station and a plunger station for forming the blank into the container.

In another aspect, the reinforcing panel assembly of the blank includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel. The corner post forming station of the machine includes a plurality of rails configured to fold the corner panel, the first reinforcing end panel, the second reinforcing end panel, the inner reinforcing corner panel, and the inner side panel into overlying relationships to form a partially formed container.

In still another aspect, the plunger station of the machine includes a plunger and a plurality of plows configured to form side walls and end walls of the container by using the plunger to push a partially formed container through the plurality of plows to form the container.

Referring now to the drawings, and more specifically to FIG. 1, which is a top plan view of an example embodiment of a blank 10 of sheet material. A container 150 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a front panel 20, a bottom panel 22, and a rear panel 24, coupled together along preformed, generally parallel, fold lines 26 and 28, respectively. Front panel 20 and rear panel 24 are also considered to be end panels. The container formed from blank 10 may be referred to as an open-top reinforced mitered tray.

More specifically, front panel 20 extends from leading edge 16 to fold line 26, bottom panel 22 extends from front panel 20 along fold line 26, rear panel 24 extends from bottom panel 22 along fold line 28 to trailing edge 18. Fold lines 26 and/or 28, as well as other fold lines and/or hinge lines described herein, may include any suitable line of weakening and/or line of separation known to those skilled in the art and guided by the teachings herein provided. Front and rear panels 20 and 24 may be considered to be end panels. When container 150 is formed from blank 10, fold line 26 defines a bottom edge of front panel 20 and a front edge, or first end edge, of bottom panel 22, and fold line 28 defines a rear edge, or second end edge, of bottom panel 22 and a bottom edge of rear panel 24. As used through this description, front edges and rear edges are also considered to be end edges.

Front panel 20 and rear panel 24 are substantially congruent and have a rectangular shape. Bottom panel 22 has an octagonal shape. More specifically, front panel 20 and rear panel 24 have a width $W_1$. Bottom panel 22 has a width $W_2$, which is longer that width $W_1$. Alternatively, width $W_1$ is substantially equal to or longer than width $W_2$. Further, in the exemplary embodiment, front and rear panels 20 and 24 have a first height $H_1$, and bottom panel 22 has a first depth $D_1$ that is larger than first height $H_1$. In an alternative embodiment, height $H_1$ is substantially equal to or larger than depth $D_1$. In the exemplary embodiment, front panel 20, rear panel 24, and/or bottom panel 22 are equally dimensioned, however, front panel 20, rear panel 24, and/or bottom panel 22 may be other than equally dimensioned.

In the exemplary embodiment, bottom panel 22 may be considered to be substantially rectangular in shape with four cut-off corners or angled edges 30, 32, 34, and 36 formed by cut lines. As such, the cut-off corner edges of otherwise rectangular bottom panel 22 define an octagonal shape of bottom panel 22. Moreover, each angled corner edge 30, 32, 34, and 36 has a length $L_1$, and angled edges 30 and 34 and angled edges 32 and 36 are substantially parallel. Alternatively, bottom panel 22 has any suitable shape that enables container 150 to function as described herein. For example, bottom panel 22 may be in the shape of a rectangle having corners that are truncated by a segmented edge such that bottom panel 22 has more than eight sides. In another example, bottom panel 22 may be in the shape of a rectangle having corners that are truncated by an arcuate edge such that bottom panel 22 has four substantially straight sides and four arcuate sides.

In the exemplary embodiment, front panel 20 includes two free side edges 38 and 40, and rear panel 24 includes two free side edges 42 and 44. Side edges 38, 40, 42, and 44 are substantially parallel to each other. Alternatively, side edges 38, 40, 42, and/or 44 are other than substantially parallel. In the exemplary embodiment, each side edge 38, 40, 42, and 44 is connected to a respective angled edge 30, 32, 34, or 36. Each side edge 38, 40, 42, and 44 may be directly connected to a respective angled edge 30, 32, 34, or 36 or, as shown in FIG. 1, may be slightly offset from a respective angled edge 30, 32, 34, or 36 to facilitate forming container 150 from blank 10 by allowing clearance for a thickness of a panel that is directly or indirectly attached to front panel 20 or rear panel 24. Side edges 38, 40, 42, and 44 and angled edges 30, 32, 34, and 36 partially define a respective cutout 46, 48, 50, or 52. More specifically, side edge 38 and angled edge 30 partially define cutout 46, side edge 42 and angled edge 32 partially define cutout 50, side edge 44 and angled edge 34 partially define cutout 52, and side edge 40 and angled edge 36 partially define cutout 48.

A first side panel 54 extends from bottom panel 22 along a fold line 56 to a free edge 58, and a second side panel 60 extends from bottom panel 22 along a fold line 62 to a free edge 64. Fold line 56 defines a bottom edge of first side panel 54 and a side edge of bottom panel 22, and fold line 62 defines a bottom edge of second side panel 60 and a side edge of bottom panel 22. First and second side panels 54 and 60 are each generally rectangularly shaped. Side panels 54 and 60 each have a depth $D_2$ that is shorter than depth $D_1$ such that side panels 54 and 60 are narrower than bottom panel 22. In the exemplary embodiment, side panels 54 and 60 each have a height $H_2$ such that height $H_2$ is substantially equal to height $H_1$. Alternatively, height $H_2$ is other than equal to height $H_1$. In the exemplary embodiment, fold line 56 extends between ends of angled corner edges 30 and 32, and fold line 62 extends between ends of angled corner edges 34 and 36. Further, in the exemplary embodiment, an oval shaped cutout 66 is defined within first and second side panels 54 and 60. In an alternative embodiment, cutout 66 may be of any shape and/or defined within any suitable panel, such as front panel 20 and/or rear panel 24. Alternatively, blank 10 does not include cutout 66.

In the exemplary embodiment, a reinforcing panel 68 extends from side edges of each side panel 54 and 60. Reinforcing panel 68 is also referred to herein as a reinforcing panel assembly that includes a plurality of panels as described in more detail herein. Each side edge is defined by a respective fold line 70, 72, 74, or 76. Fold lines 70, 72, 74, and 76 are substantially parallel to each other. Alternatively, fold lines 70, 72, 74, and/or 76 are other than substantially parallel. In the exemplary embodiment, each reinforcing panel 68 includes a free bottom edge 78. Each free bottom edge 78 at least partially defines cutouts 46, 48, 50, and 52. As such, one side edge 38, 40, 42, or 44, a respective angled edge 30, 36, 32, or 34, and a bottom edge 78 of an adjacent reinforcing panel 68 defines cutouts 46, 48, 50, and 52. Further, each reinforcing panel 68 is substantially similar and includes an outer reinforcing panel 80, an inner reinforcing panel 82, and an inner side panel 84 connected along substantially parallel fold lines 86 and 88. Fold line 86 defines a side edge of outer reinforcing panel 80 and a side edge of inner reinforcing panel 82, and fold line 88 defines a side edge of inner reinforcing panel 82 and a side edge of inner side panel 84. Moreover, outer reinforcing panel 80 includes a corner panel 90 and a first reinforcing end panel 92, and inner reinforcing panel 82 includes an inner reinforcing corner panel 94 and a second reinforcing end panel 96.

More specifically, outer reinforcing panel 80 extends along each of fold lines 70, 72, 74, and 76. Further, inner reinforcing panel 82 extends from each outer reinforcing panel 80 along fold line 86, and inner side panel 84 extends from each inner reinforcing panel 82 along fold line 88 to a free edge 98. A notch 100 is formed along fold line 86 between inner reinforcing walls 82 and outer reinforcing walls 80. Inner reinforcing walls 82 and outer reinforcing walls 80 are substantially rectangular in shape. More specifically, inner reinforcing walls 82 have a width $W_3$, and outer reinforcing walls 80 have a width $W_4$, which is substantially equal to width $W_3$. Further, in the exemplary embodiment, inner and outer reinforcing walls have a height $H_3$ that is substantially similar to height $H_1$ of front panel 20 and rear panel 24. In an alternative embodiment, height $H_2$ is other than equal to height $H_3$.

Each outer reinforcing panel 80 includes a fold line 102 that bisects each outer reinforcing panel 80 into corner panel 90 and first reinforcing end panel 92. Fold line 102 defines an edge of corner panel 90 and a side edge of first reinforcing end panel 92, and fold line 86 defines a side edge of first reinforcing end panel 92. In the exemplary embodiment, corner panel 90 and first reinforcing end panel 92 are substantially rectangular. Further, in the exemplary embodiment, each inner reinforcing panel 82 includes a fold line 104 that bisects each inner reinforcing panel 82 into inner reinforcing corner panel 94 and second reinforcing end panel 96. Fold line 104 defines an edge of inner reinforcing corner panel 94 and a side edge of second reinforcing end panel 96, fold line 88 defines a side edge of inner reinforcing corner panel 94, and fold line 86 defines a side edge of second reinforcing end panel 96.

In the exemplary embodiment, inner reinforcing corner panel 94 and second reinforcing end panel 96 are substantially rectangular. Further, corner panel 90 and inner reinforcing corner panel 94 are substantially congruent, and first and second reinforcing end panels 92 and 96 are substantially congruent.

Each corner panel 90 and each inner reinforcing corner panel 94 have a width $W_5$ that is substantially equal to length $L_1$. In addition, each first reinforcing end panel 92 and second reinforcing end panel 96 have a width $W_6$ that is approximately equal to width $W_5$. In an alternative embodiment, width $W_6$ is other than equal to width $W_5$. Further, in the exemplary embodiment, each inner side panel 84 has a depth $D_3$ that is equal to approximately half of the depth $D_2$ of first and second top panels 302 and 304, such that a cutout 106 extending inward from free edge 98 is substantially aligned with at least a portion of cutout 66. In an alternative embodiment, depth $D_3$ is other than equal to approximately half the depth $D_2$. Alternatively, blank 10 does not include cutout 106.

Figure 2:
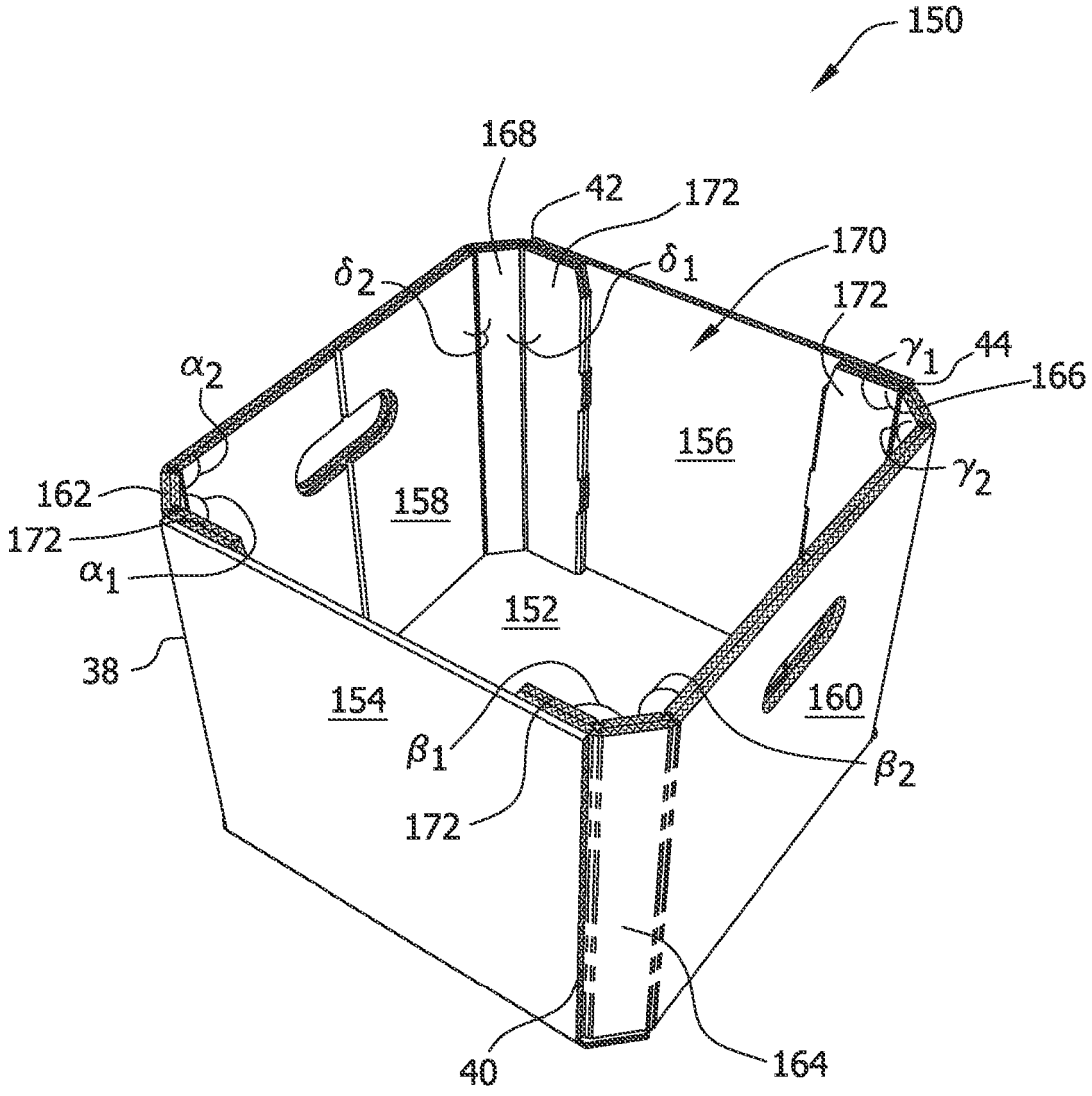
FIG. 2 is a perspective view of a container formed from the blank shown in FIG. 1.

FIG. 2 is a perspective view of container 150 that is formed from blank 10 (shown in FIG. 1). Although container 150 is shown as being formed without a product to be contained therein, container 150 may also be formed having a product therein. Further, container 150 may include any suitable number of products of any suitable shape.

To construct container 150 from blank 10, at least one product is positioned on interior surface 12 of bottom panel 22. In the exemplary embodiment, bottom panel 22 is sized to correspond to product(s) contained within container 150. Each inner side panel 84 and respective inner reinforcing panel 82 are folded about fold line 86 such that inner reinforcing panel 82 and outer reinforcing panel 80 are in an at least partially overlying relationship, and such that inner side panel 84 is in an at least partially overlying relationship with at least a portion of first or second side panel 54 or 60. More specifically, blank 10 is folded along fold line 86 such that corner panel 90 and inner reinforcing corner panel 94 are substantially aligned in an at least partially overlying relationship, first and second reinforcing end panels 92 and 96 are substantially aligned in an at least partially overlying relationship, and inner side panel 84 and at least a portion of first or second side panel 54 or 60 are substantially aligned in an at least partially overlying relationship. In the exemplary embodiment, inner side panel 84, a respective side panel 54 or 60, reinforcing end panels 92 and 96, and/or corner panel 90 and inner reinforcing corner panel 94 are secured in the above-described relationships. For example, inner side panel 84, a respective side panel 54 or 60, reinforcing end panels 92 and 96, and/or corner panel 90 and inner reinforcing corner panel 94 are held against the product to be contained by a force on exterior surface 14 as container 150 continues to be erected. In another example, inner side panel 84 may be adhered to a respective side panel 54 or 60, reinforcing end panels 92 and 96 may be adhered together, and/or corner panels 90 and 94 may be adhered together.

Reinforcing walls 80 and 82 are rotated about fold lines 70, 72, 74, and 76 and fold lines 88. Further, reinforcing end panels 92 and 96 are rotated about fold lines 102 and 104 toward corner panels 90 and 94 before or after reinforcing walls 80 and 82 are rotated about fold lines 70, 72, 74, and 76 and fold lines 88. In the exemplary embodiment, reinforcing walls 80 and 82 and reinforcing end panels 92 and 96 are rotated such that reinforcing end panels 92 and 96 are substantially perpendicular to side panels 54 and 60. First and second side panels 54 and 60 are then rotated about fold lines 56 and 62, respectively, toward interior surface 12.

Front panel 20 is rotated about fold line 26 toward interior surface 12, and rear panel 24 is rotated about fold line 28 toward interior surface 12. More specifically, front panel 20 and rear panel 24 are rotated to be substantially perpendicular to bottom panel 22, as shown in FIG. 2. Interior surface 12 of front panel 20 is secured to exterior surface 14 of two adjacent first reinforcing end panels 92, and interior surface 12 of rear panel 24 is secured to exterior surface 14 of two adjacent first reinforcing end panels 92. In the exemplary embodiment, front panel 20 and rear panel 24 are adhered to respective first reinforcing end panels 92. Alternatively, front panel 20 and rear panel 24 are otherwise attached to respective first reinforcing end panels 92 using, for example, fasteners, a bonding material, and/or any suitable method for attached the panels.

When container 150 is formed, interior surface 12 of front and rear panels 20 and 24 is adjacent the side walls of the product. Further, height $H_1$ of front and rear panels 20 and 24 is sized to correspond to a height of the products within container 150 such that height $H_1$ is substantially equal to or greater than the height of the products. Bottom panel 22 forms a bottom wall 152 of container 150, front panel 20 and a pair of reinforcing end panels 92 and 96 forms a front wall 154 of container 150, and rear panel 24 and a pair of reinforcing end panels 92 and 96 forms a rear wall 156 of container 150. Front wall 154 and rear wall 156 are also referred to as end walls of container 150. Side panel 54 and two inner side panels 84 form a first side wall 158, and side panel 60 and two inner side panels 84 form a second side wall 160. Each pair of corner panels 90 and 94 forms first corner wall 162, second corner wall 164, third corner wall 166, and fourth corner wall 168. Bottom wall 152, front wall 154, rear wall 156, first side wall 158, second side wall 160, and corner walls 162, 164, 166, and 168 define a cavity 170 of container 150.

In the exemplary embodiment, first corner wall 162 is oriented at an oblique $\alpha 1$ to front wall 154 and an oblique angle $\alpha 2$ to side wall 158. Similarly, second corner wall 164 is oriented at an oblique angle $\beta 1$ to front wall 154 and an oblique angle $\beta 2$ to side wall 160. Similarly, third corner wall 166 is oriented at an oblique angle $\gamma 1$ to rear wall 156 and an oblique angle $\gamma 2$ to side wall 160, and fourth corner wall 168 is oriented at an oblique angle $\delta 1$ to rear wall 156 and an oblique angle $\delta 2$ to side wall 158. In the exemplary embodiment, angles $\alpha 1$, $\alpha 2$, $\beta 1$, $\beta 2$, $\gamma 1$, $\gamma 2$, $\delta 1$, and $\delta 2$ are substantially equal, however, angles $\alpha 1$, $\alpha 2$, $\beta 1$, $\beta 2$, $\gamma 1$, $\gamma 2$, $\delta 1$, and/or $\delta 2$ can be other than equal depending of the products positioned within container 150. In one embodiment, angles $\alpha 1$, $\alpha 2$, $\beta 1$, $\beta 2$, $\gamma 1$, $\gamma 2$, $\delta 1$, and $\delta 2$ are between about 120° and about 150°. In the exemplary embodiment, angles $\alpha 1$, $\alpha 2$, $\beta 1$, $\beta 2$, $\gamma 1$, $\gamma 2$, $\delta 1$, and $\delta 2$ are equal to about 135°. Further, in the exemplary embodiment, bottom edges 78 of reinforcing panels 68 are substantially aligned with fold lines 26, 28, 56, and 62 and angled edges 30, 32, 34, and 36. Container 150 has a configuration referred to herein as an "open configuration."

The above-described method to construct container 150 from blank 10 may be performed using a machine, as described in more detail below. The machine performs the above-described method to continuously form container 150 from blank 10 as blank 10 is moved though the machine. In one embodiment, the machine includes at least one plow or finger to at least partially rotate at least one of panels 84, 94, 54, 60, 20, and 24 and/or further form container 150 using a mandrel to complete rotating these panels.

Figure 3:
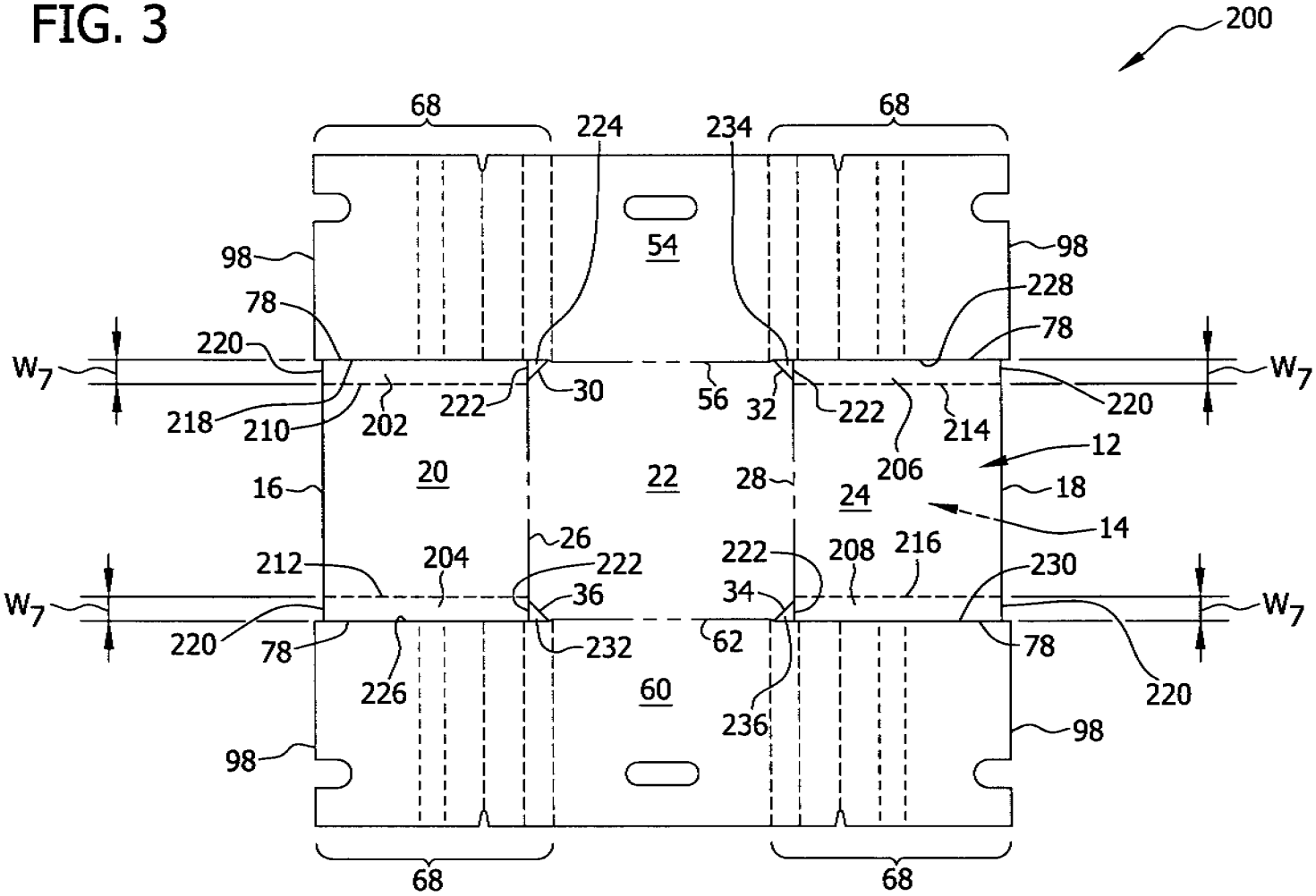
FIG. 3 is a top plan view of a blank of sheet material for constructing a container according to a first alternative embodiment of the present invention.

FIG. 3 is a top plan view of an example embodiment of a blank 200 of sheet material. Blank 200 is essentially similar to blank 10 (shown in FIG. 1) and, as such, similar components are labeled with similar references. More specifically, blank 200 includes outer reinforcing corner panels 202, 204, 206, and 208. Further, blank 200 includes fold lines 210, 212, 214, and 216 rather than free side edges 38, 40, 42, and 44.

In the exemplary embodiment, first outer reinforcing corner panel 202 extends from front panel 20 along fold line 210 to a free edge 218. Fold line 210 and free edge 218 define side edges of first outer reinforcing corner panel 202, and fold line 210 defines a side edge of front panel 20. First outer reinforcing corner panel 202 is substantially rectangular shaped having a top edge 220 and a bottom edge 222. Bottom edge 222, angled edge 30, and bottom edge 78 define a removable cutout 224. Further, first outer reinforcing corner panel 202 has substantially height $H_1$ such that front panel 20 and first outer reinforcing corner panel 202 have a substantially equal height. As such, top edge 220 is substantially collinear with leading edge 16, which defines a top edge of front panel 20, and bottom edge 222 is substantially collinear with fold line 26. Further, first outer reinforcing corner panel 202 has a width $W_7$. Width $W_7$ is substantially equal to length $L_1$. Alternatively, width $W_7$ is less than length $L_1$. In the exemplary embodiment, first outer reinforcing corner panel 202 has substantially constant width $W_7$ from top edge 220 to bottom edge 222 such that first outer reinforcing corner panel 202 does not include cutoff corners and/or tapered top and/or bottom edges.

Similarly, second outer reinforcing corner panel 204 extends from front panel 20 along fold line 212 to a free edge 226, third outer reinforcing corner panel 206 extends from rear panel 24 along fold line 214 to a free edge 228, and fourth outer reinforcing corner panel 208 extends from rear panel 24 along fold line 216 to a free edge 230. In the exemplary embodiment, second outer reinforcing corner panel 204, third outer reinforcing corner panel 206, and fourth outer reinforcing corner panel 208 are each substantially rectangular and have substantially height $H_1$ extending between respective top edges 220 and bottom edges 222 such that front panel 20, rear panel 24, and outer reinforcing corner panels 204, 206, and 208 have an equal height. As such, top edge 220 of second outer reinforcing corner panel 204 is substantially collinear with leading edge 16, bottom edge 222 of second outer reinforcing corner panel 204 is substantially collinear with fold line 26, top edge 220 of third outer reinforcing corner panel 206 is substantially collinear with trailing edge 18, bottom edge 222 of third outer reinforcing corner panel 206 is substantially collinear with fold line 28, top edge 220 of fourth outer reinforcing corner panel 208 is substantially collinear with trailing edge 18, and bottom edge 222 of fourth outer reinforcing corner panel 208 is substantially collinear with fold line 28. Further, bottom edge 222 of second outer reinforcing corner panel 204, angled edge 36, and bottom edge 78 define a removable cutout 232, bottom edge 222 of third outer reinforcing corner panel 206, angled edge 32, and bottom edge 78 define a removable cutout 234, and bottom edge 222 of fourth outer reinforcing corner panel 208, angled edge 34, and bottom edge 78 define a removable cutout 236.

Further, second outer reinforcing corner panel 204, third outer reinforcing corner panel 206, and fourth outer reinforcing corner panel 208 have width $W_7$. Alternatively, outer reinforcing corner panels 202, 204, 206, and/or 208 may have any suitable dimensions that enable blank 10 to function as described herein. In the exemplary embodiment, outer reinforcing corner panels 204, 206, and 208 have substantially constant width $W_7$ from top edges 220 to bottom edges 222 such that corner panels 204, 206, and 208 do not include cutoff corners and/or tapered top and/or bottom edges. Further, second, third, and fourth outer reinforcing corner panels 204, 206, and 208 are substantially congruent to first corner panel 202. Alternatively, corner panels 202, 204, 206, and/or 208 are other than congruent to each other.

In the exemplary embodiment, fold line 210 is generally aligned with an intersection of angled corner edge 30 of bottom panel 22 and fold line 26, fold line 212 is substantially aligned with an intersection of angled corner edge 36 of bottom panel 22 and fold line 26, fold line 214 is substantially aligned with an intersection of angled corner edge 32 of bottom panel 22 and fold line 28, and fold line 216 is substantially aligned with an intersection of angled corner edge 34 of bottom panel 22 and fold line 28. Further, fold lines 210, 212, 214, and 216 are substantially parallel. Moreover, free edges 218, 226, 228, and 230 are substantially parallel with fold lines 210, 212, 214, and 216. Alternatively, free edges 218, 226, 228, and/or 230 and/or fold lines 210, 212, 214, and/or 216 are other than parallel. In the exemplary embodiment, each free edge 218, 226, 228, and 230 is adjacent to and substantially parallel with a bottom edge 78.

Figure 4:
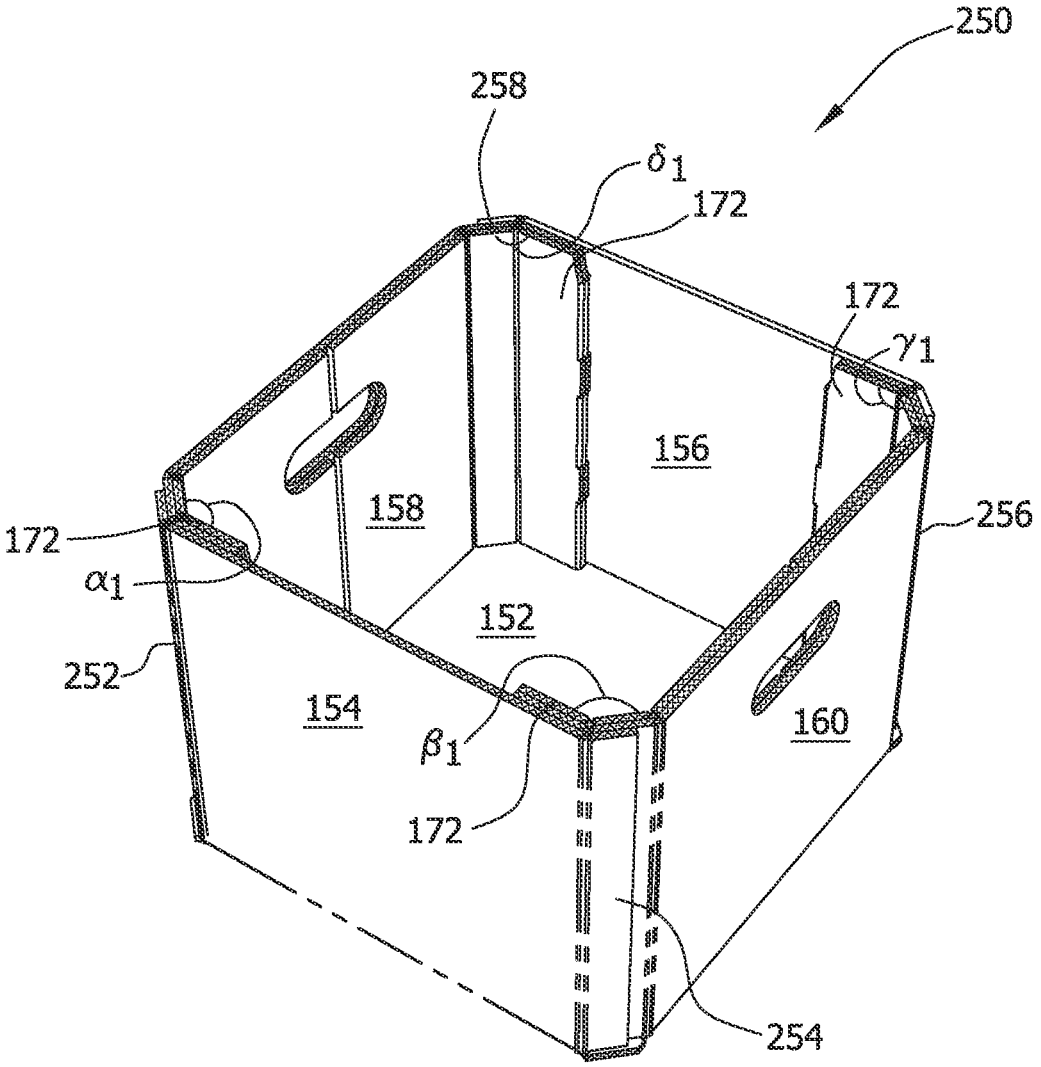
FIG. 4 is a perspective view of a container formed from the blank shown in FIG. 3.

FIG. 4 is a perspective view of container 250 that is formed from blank 200 (shown in FIG. 3). Container 250 is essentially similar to container 150 (shown in FIG. 2) and, as such, similar components are labeled with similar references. Although container 250 is shown as being formed without a product to be contained therein, container 250 may also be formed having a product therein. Further, container 250 may include any suitable number of products of any suitable shape.

To construct container 250 from blank 200 a method that is substantially similar to the method for forming container 150 from blank 10 is used. However, to construct container 250, first outer reinforcing corner panel 202 is rotated about fold line 210 toward interior surface 12 and secured to exterior surface 14 of corner panel 90 extending from fold line 70 of first side panel 54. More specifically, first outer reinforcing corner panel 202 is rotated such that first outer reinforcing corner panel 202 is oriented at oblique angle $\alpha 1$ to front wall 154. Similarly, second outer reinforcing corner panel 204 is rotated about fold line 212 toward interior surface 12 and secured to exterior surface 14 of corner panel 90 extending from fold line 74 of second side panel 60. More specifically, second outer reinforcing corner panel 204 is rotated such that second outer reinforcing corner panel 204 is oriented at oblique $\beta 01$ to front wall 154.

In the exemplary embodiment, free edge 218 of first outer reinforcing corner panel 202 is substantially aligned with fold line 70, and free edge 226 of second outer reinforcing corner panel 204 is substantially aligned with fold line 74. Alternatively, first outer reinforcing corner panel 202 and/or second outer reinforcing corner panel 204 only partially overlap corner panels 90 such that free edges 218 and/or 226 are offset from fold lines 70 and/or 74, respectively. Further, in the exemplary embodiment, bottom edge 222 of first outer reinforcing corner panel 202 is substantially aligned with angled edge 30 of bottom panel 22, and bottom edge 222 of second outer reinforcing corner panel 204 is substantially aligned with angled edge 36 of bottom panel 22. First outer reinforcing corner panel 202 forms a first corner wall 252 with a pair of corner panels 90 and 94, and second outer reinforcing corner panel 204 forms a second corner wall 254 with a pair of corner panels 90 and 94.

Third outer reinforcing corner panel 206 is rotated about fold line 214 toward interior surface 12 and secured to exterior surface 14 of corner panel 90 extending from fold line 72 of first side panel 54. More specifically, third outer reinforcing corner panel 206 is rotated such that third outer reinforcing corner panel 206 is oriented at oblique angle $\gamma 1$ to rear wall 156. Similarly, fourth outer reinforcing corner panel 208 is rotated about fold line 216 toward interior surface 12 and secured to exterior surface 14 of first reinforcing panel 90 extending from fold line 76 of second side panel 60. More specifically, fourth outer reinforcing corner panel 208 is rotated such that fourth outer reinforcing corner panel 208 is oriented at oblique angle $\delta 1$ to rear wall 156. In the exemplary embodiment, free edge 228 of third outer reinforcing corner panel 206 is substantially aligned with fold line 72 of first side panel 54, and free edge 230 of fourth outer reinforcing corner panel 208 is substantially aligned with fold line 76 of second side panel 60. Alternatively, third outer reinforcing corner panel 206 and/or fourth outer reinforcing corner panel 208 only partially overlap corner panels 90 such that free edges 228 and/or 230 are offset from fold lines 72 and/or 76, respectively. Further, in the exemplary embodiment, bottom edge 222 of third outer reinforcing corner panel 206 is substantially aligned with angled edge 32 of bottom panel 22, and bottom edge 222 of fourth outer reinforcing corner panel 208 is substantially aligned with angled edge 34 of bottom panel 22. Third outer reinforcing corner panel 206 forms a third corner wall 256 with a pair of corner panels 90 and 94, and fourth outer reinforcing corner panel 208 forms a fourth corner wall 258 with a pair of corner panels 90 and 94. Corner walls 252, 254, 256, and 258 each include three layers of panels, and corner walls 162, 164, 166, and 168 (shown in FIG. 2) each include two layers of panels.

Figure 5:
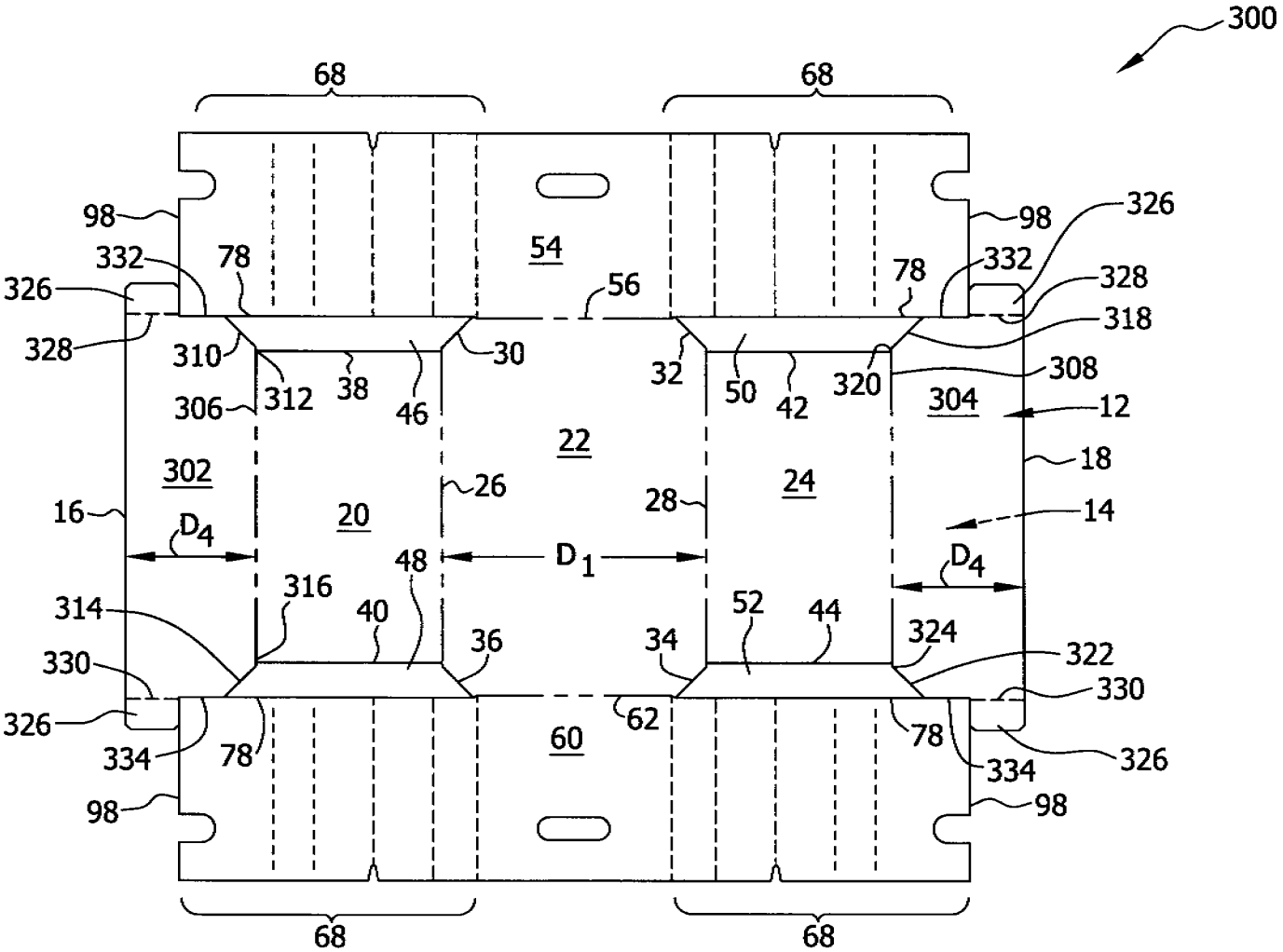
FIG. 5 is a top plan view of a blank of sheet material for constructing a container according to a second alternative embodiment of the present invention.

FIG. 5 is a top plan view of an example embodiment of a blank 300 of sheet material. Blank 300 is essentially similar to blank 10 (shown in FIG. 1) and, as such, similar components are labeled with similar references. More specifically, blank 300 includes top panels 302 and 304. Further, blank 300 includes fold lines 306 and 308 as top edges of front panel 20 and rear panel 24, respectively, rather than leading edge 16 and trailing edge 18 defining top edges of front panel 20 and rear panel 24, respectively.

In the exemplary embodiment, blank 300 includes, in series from leading edge 16 to trailing edge 18, a first top panel 302, front panel 20, bottom panel 22, rear panel 24, and a second top panel 304 coupled together along preformed, generally parallel, fold lines 306, 26, 28, and 308, respectively. More specifically, first top panel 302 extends between leading edge 16 and fold line 306, and second top panel 304 extends from rear panel 24 along fold line 308 to trailing edge 18. When a container 350 (shown in FIG. 6) is formed from blank 300, fold line 306 defines a front edge of top panel 302 and a top edge of front panel 20, and fold line 308 defines a top edge of rear panel 24 and a rear edge of top panel 304.

In the exemplary embodiment, first top panel 302 and second top panel 304 are substantially congruent and have a trapezoidal shape. More specifically, first top panel 302 includes an angled edge 310 extending from an intersection 312 of fold line 306 and free edge 38 toward bottom edge 78 and an angled edge 314 extending from an intersection 316 of fold line 306 and free edge 40 toward bottom edge 78. Similarly, second top panel 304 includes an angled edge 318 extending from an intersection 320 of fold line 308 and free edge 42 toward bottom edge 78 and an angled edge 322 extending from an intersection 324 of fold line 308 and free edge 44 toward bottom edge 78. Angled edge 310, free edge 38, angled edge 30, and bottom edge 78 define cutout 46; angled edge 318, free edge 42, angled edge 32, and bottom edge 78 define cutout 50; angled edge 322, free edge 44, angled edge 34, and bottom edge 78 define cutout 52; and angled edge 314, free edge 40, angled edge 36, and bottom edge 78 define cutout 48.

In addition, first and second top panels 302 and 304 have a depth $D_4$ that is smaller than half of depth $D_1$. In an alternative embodiment, depth $D_4$ is substantially equal to or larger than half of depth $D_1$. In the exemplary embodiment, front panel 20 and rear panel 24 and/or bottom panel 22 and top panels 302 and 304 are equally dimensioned, however, front panel 20 and rear panel 24 and/or bottom panel 22 and top panels 302 and 304 may be other than equally dimensioned. Further, first and second top panels 302 and 304 each have a pair of opposing closure flaps 326 that extend from a first side fold line 328 and a second side fold line 330 of each of first and second top panels 302 and 304. Moreover, first top panel 302 is separated from adjacent reinforcing panels 68 by a first side edge 332 and a second side edge 334. Similarly, second top panel 304 is separated from adjacent reinforcing panels 68 by first side edge 332 and second side edge 334.

Figure 6:
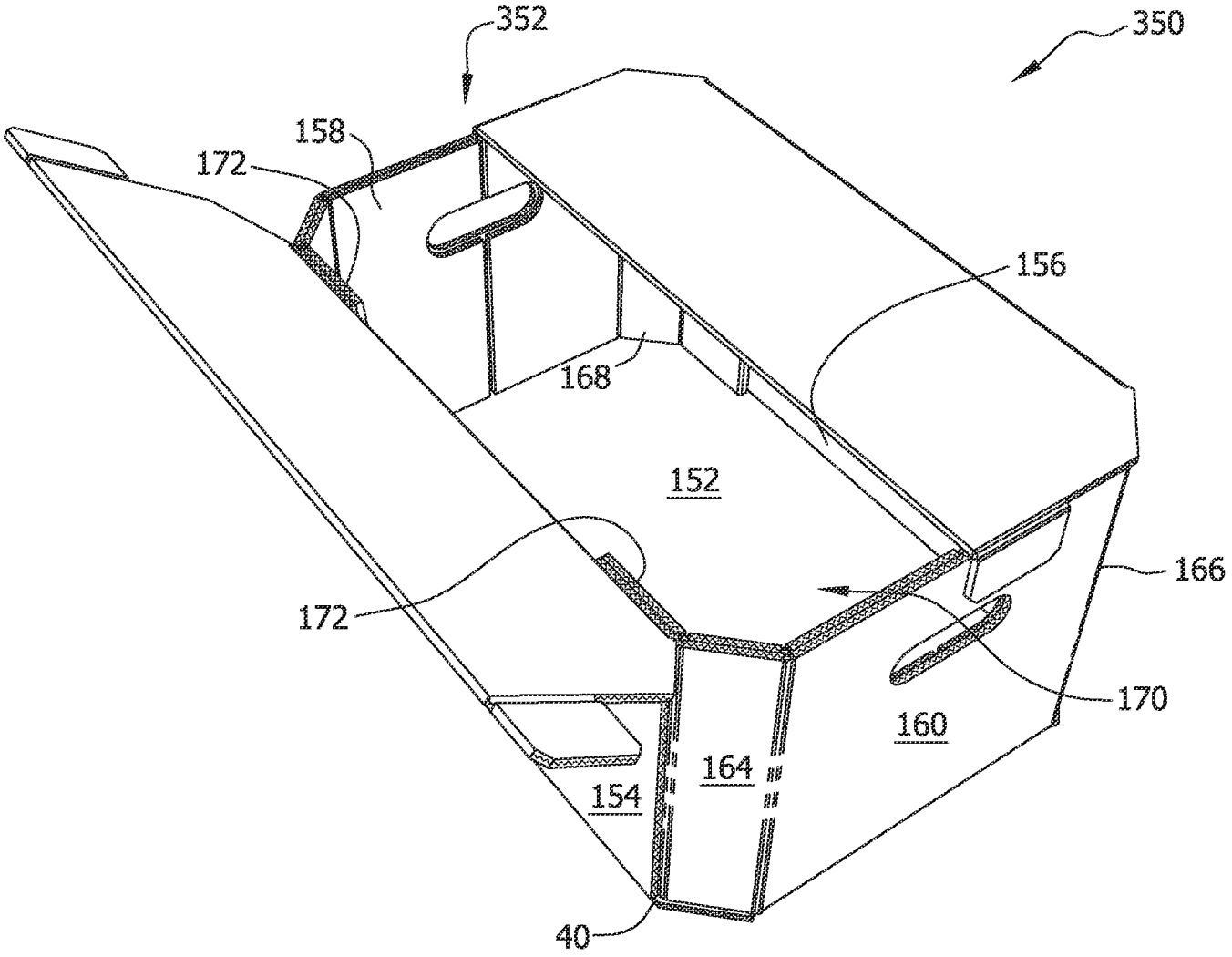
FIG. 6 is a perspective view of a container formed from the blank shown in FIG. 5.

FIG. 6 is a perspective view of container 350 that is formed from blank 300 (shown in FIG. 5). Container 350 is essentially similar to container 150 (shown in FIG. 2) and, as such, similar components are labeled with similar references. Although container 350 is shown as being formed without a product to be contained therein, container 350 may also be formed having a product therein. Further, container 350 may include any suitable number of products of any suitable shape. To construct container 350 from blank 300 a method that is substantially similar to the method for forming container 150 from blank 10 is used. By forming a top wall 352 of container 350, container 350 is considered to be in a "closed configuration" rather than the open configuration of containers 150 and 250.

To close container 350 and form top wall 352, first top panel 302 is rotated about fold line 306 toward cavity 170 such that first top panel 302 is substantially perpendicular to front panel 20 and substantially parallel to bottom panel 22. Further, second top panel 304 is rotated about fold line 308 toward cavity 170 such that second top panel 304 is substantially perpendicular to rear panel 24 and substantially parallel to bottom panel 22. Closure flaps 326 are then rotated toward exterior surface 14 of first and second side panels 54 and 60 and are secured thereto. In the exemplary embodiment, interior surface 12 of each closure flap 326 is adhered to exterior surface 14 of side panels 54 or 60. First and second top panels 302 and 304 form top wall 352 of container 350.

Figure 7:
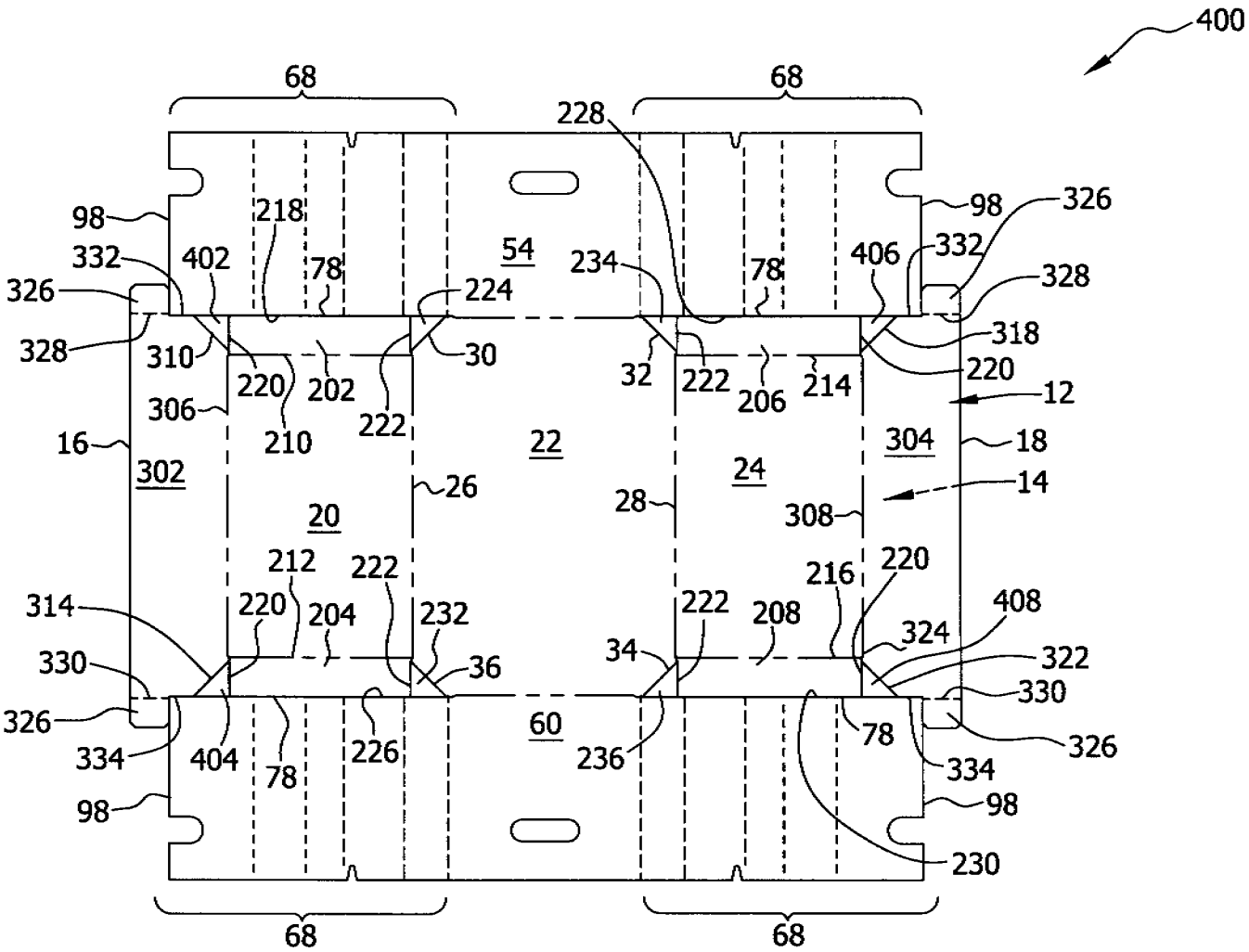
FIG. 7 is a top plan view of a blank of sheet material for constructing a container according to a third alternative embodiment of the present invention.

FIG. 7 is a top plan view of an example embodiment of a blank 400 of sheet material. Blank 400 is essentially similar to blank 200 (shown in FIG. 3) and blank 300 (shown in FIG. 5) and, as such, similar components are labeled with similar references. More specifically, blank 400 is similar to blank 300 and includes outer reinforcing corner panels 202, 204, 206, and 208, as shown and described with respect to FIG. 3. Further, blank 400 includes fold lines 210, 212, 214, and 216 rather than free side edges 38, 40, 42, and 44 (shown in FIG. 5), as shown and described with respect to FIG. 3.

In the exemplary embodiment, in addition to cutouts 224, 232, 234, and 236, blank 400 includes cutouts 402, 404, 406, and 408. More specifically, angled edge 310, top edge 220, and bottom edge 78 define a first cutout 402; angled edge 314, top edge 220, and bottom edge 78 define a second cutout 404; angled edge 318, top edge 220, and bottom edge 78 define a third cutout 406; and angled edge 322, top edge 220, and bottom edge 78 define a fourth cutout 408.

Figure 8:
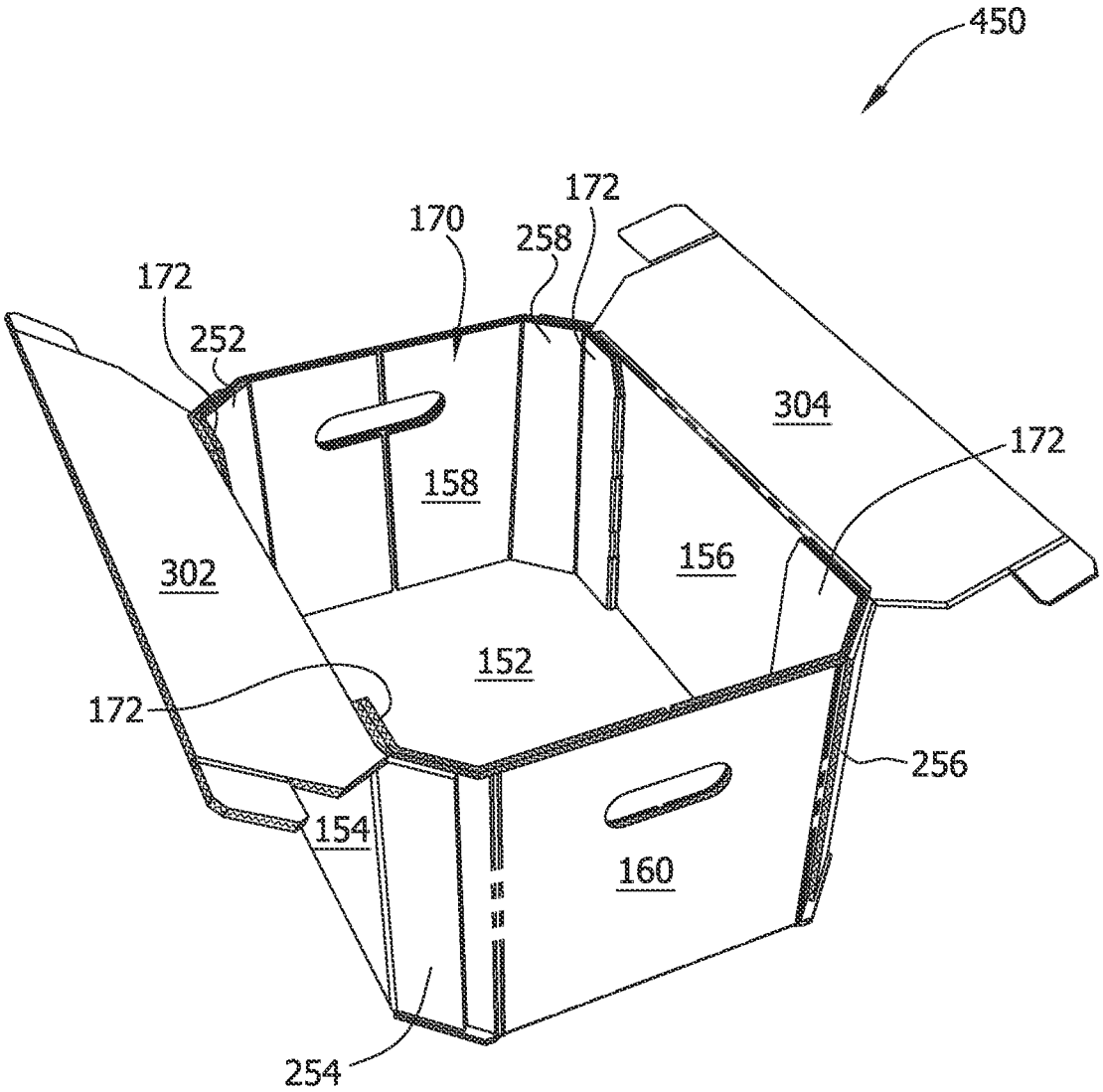
FIG. 8 is a perspective view of a container that is partially formed from the blank shown in FIG. 7.
Figure 9:
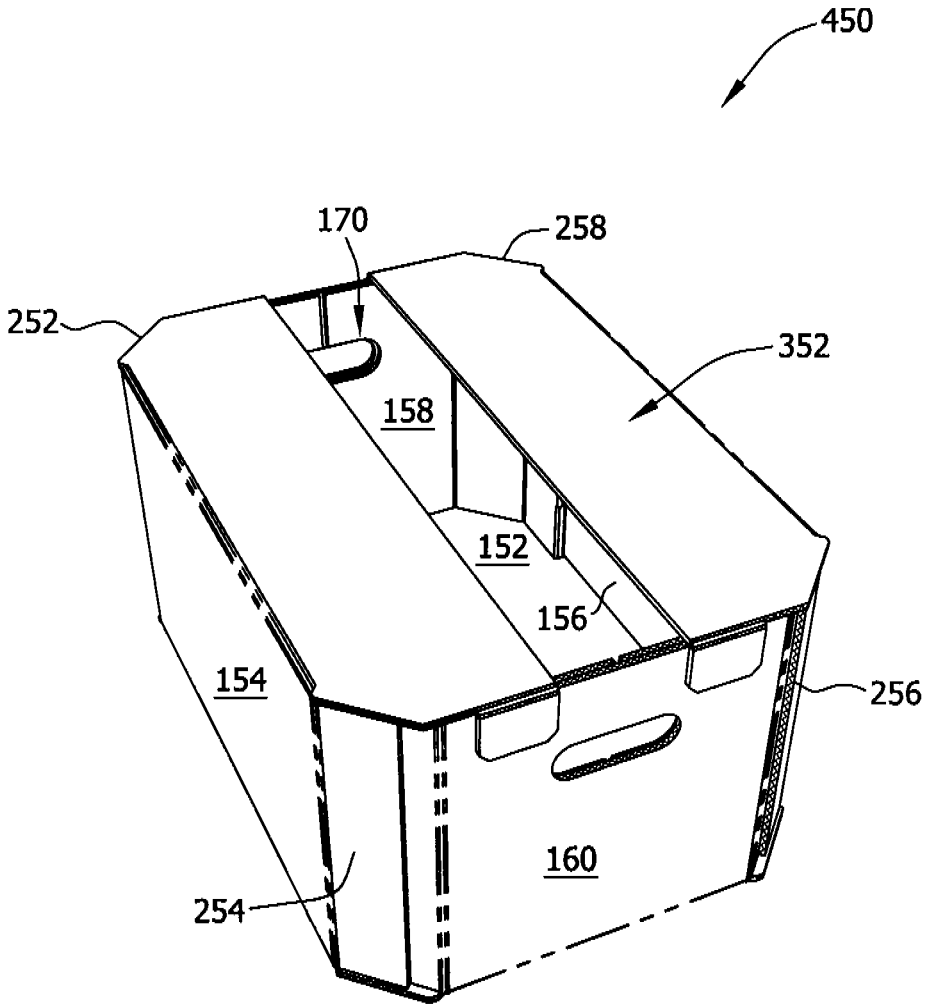
FIG. 9 is a perspective view of a container formed from the blank shown in FIG. 7.

FIG. 8 is a perspective view of a container 450 that is partially formed from blank 400 (shown in FIG. 7). FIG. 9 is a perspective view of container 450 formed from blank 400. Container 450 is essentially similar to container 250 (shown in FIG. 4) and container 350 (shown in FIG. 6) and, as such, similar components are labeled with similar references. Although container 450 is shown as being formed without a product to be contained therein, container 450 may also be formed having a product therein. Further, container 450 may include any suitable number of products of any suitable shape. To construct container 450 from blank 400 a method that is substantially similar to the method for forming container 250 from blank 200 is used. To close container 450, top wall 352 is formed using the method used to construct container 350 from blank 300.

Figure 10:
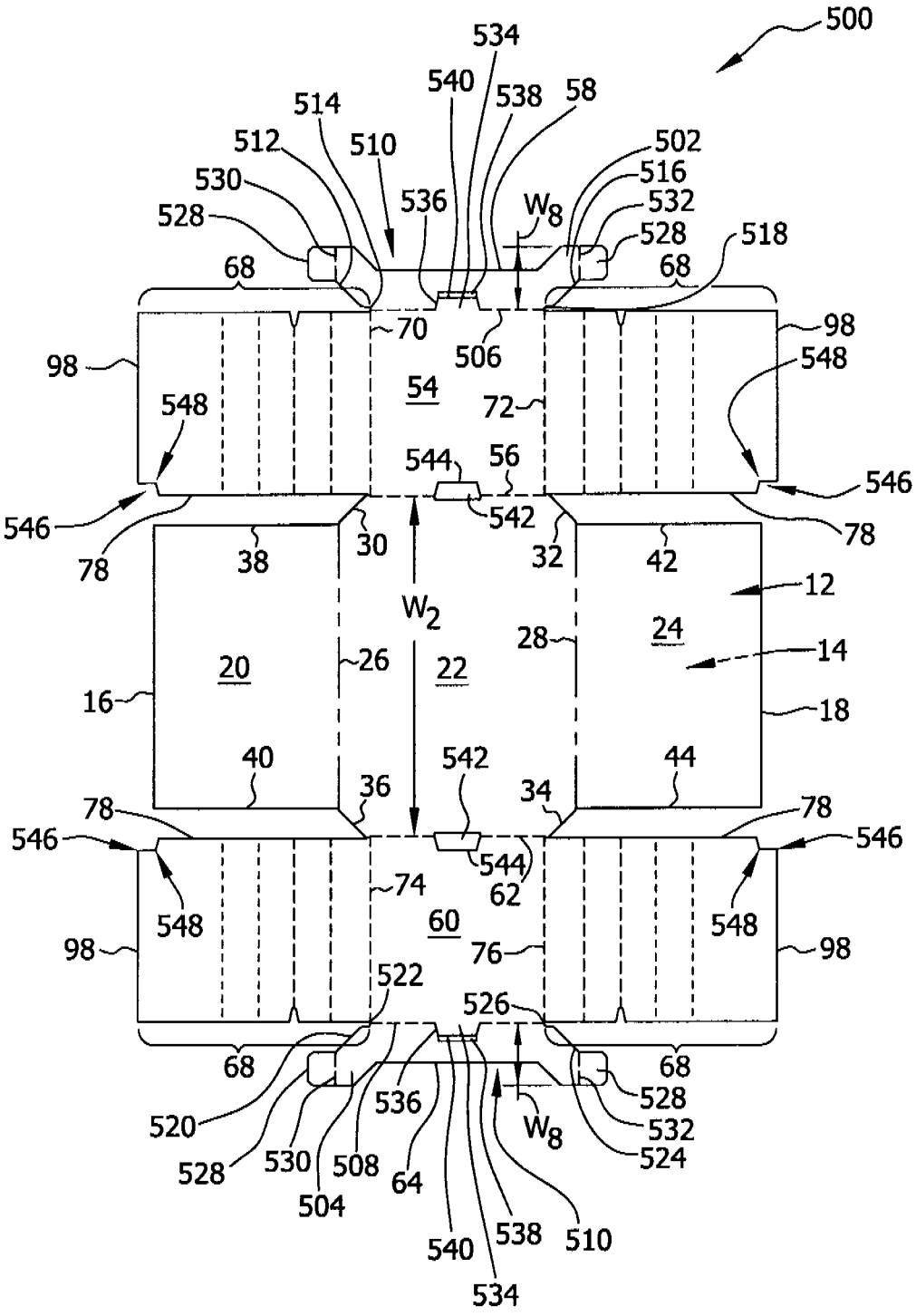
FIG. 10 is a top plan view of a blank of sheet material for constructing a container according to a fourth alternative embodiment of the present invention.

FIG. 10 is a top plan view of an example embodiment of a blank 500 of sheet material. Blank 500 is essentially similar to blank 10 (shown in FIG. 1) and, as such, similar components are labeled with similar references. More specifically, blank 500 includes top panels 502 and 504. Further, blank 500 includes fold lines 506 and 508 as top edges of side panels 54 and 60, respectively, rather than free edge 58 and free edge 64 (shown in FIG. 1) defining top edges of side panels 54 and 60, respectively. Moreover, blank 500 does not include cutouts 66 and 106 (shown in FIG. 1), however, it will be understood that blank 500 may include cutouts 66 and/or 106.

In the exemplary embodiment, blank 500 includes, in series from free edge 58 to free edge 64, a first top panel 502, side panel 54, bottom panel 22, side panel 60, and a second top panel 504 coupled together along preformed, generally parallel, fold lines 506, 56, 62, and 508, respectively. More specifically, first top panel 502 extends between free edge 58 and fold line 506, and second top panel 504 extends from side panel 60 along fold line 508 to free edge 64. When a container 550 (shown in FIG. 11) is formed from blank 500, fold line 506 defines a side edge of top panel 502 and a top edge of side panel 54, and fold line 508 defines a side edge of top panel 504 and a top edge of side panel 60.

In the exemplary embodiment, first top panel 502 and second top panel 504 are substantially congruent and have a trapezoidal shape with a cutout portion 510 defined along free edges 58 and 64, respectively. Cutout portion 510 has any suitable configuration that enables blank 500 and/or container 550 to function as described herein. In one embodiment, cutout portion 510 is configured to enable access to cavity 170 (shown in FIG. 11) of container 550. Alternatively, top panel 502 and/or 504 does not include cutout portion 510. In the exemplary embodiment, first top panel 502 includes an angled edge 512 extending outwardly from an intersection 514 of fold line 506 and fold line 70 and an angled edge 516 extending outwardly from an intersection 518 of fold line 506 and fold line 72. Similarly, second top panel 504 includes an angled edge 520 extending outwardly from an intersection 522 of fold line 508 and fold line 74 and an angled edge 524 extending outwardly from an intersection 526 of fold line 508 and fold line 76. Angled edges 512, 516, 520, and 524 are configured similarly to angled edges 30, 32, 34, and 36, respectively.

In addition, first and second top panels 502 and 504 have a width $W_8$ that is smaller than half of width $W_2$. More specifically, top panels 502 and 504 each have width $W_8$ such that each top panel 502 and 504 forms a top shoulder 552 and 554 (shown in FIG. 11), respectively, when container 550 is formed from blank 500. In an alternative embodiment, width $W_8$ is substantially equal to or larger than half of width $W_2$. Alternatively, width $W_8$ is sized to form a partial top wall. In the exemplary embodiment, top panels 502 and 504 are equally dimensioned, however, top panels 502 and 504 may be other than equally dimensioned. Further, first and second top panels 502 and 504 each have a pair of opposing closure flaps 528 that extend from a front fold line 530 and a rear fold line 532 of each of first and second top panels 502 and 504.

In the exemplary embodiment, fold line 506 and fold line 508 each include a tab 534 defined therein. More specifically, a cut line 536 divides each fold line 506 and 508 to form tab 534. Further, a slot 538 defined in each top panel 502 and 504 defines a top 540 of each tab 534. Alternatively, fold line 506 and/or fold line 508 does not include tab 534 and/or top panel 502 and/or top panel 504 does not include slot 538. Moreover, it will be understood that tab 534 and/or slot 538 may be included in any of the embodiments described herein. For example, tab 534 may extend from free edge 58 and/or free edge 64 in any embodiment including such free edges. Further, tab 534 may extend from leading edge 16, trailing edge 18, fold line 306, and/or fold line 308 of the embodiments described herein.

In the exemplary embodiment, fold line 56 and fold line 62 each include a cutout 542 defined therein. More specifically, a cut line 544 divides each fold line 56 and 62 and defines cutout 542. Cutout 542 may have any suitable configuration that enables blank 500 and/or container 550 to function as described herein. In one embodiment, cutout 542 is sized to receive tab 534 for stacking containers 550 and/or to provide venting for cavity 170. Alternatively, fold line 56 and/or fold line 62 does not include cutout 542. Moreover, it will be understood that cutout 542 may be included in any of the embodiments described herein. For example, cutout 542 may be defined in fold lines 26, 28, 56 and/or 62 of the embodiments described herein.

Further, in the exemplary embodiment, each inner side panel 84 includes a notch 546 defined in a lower free corner 548 thereof. More specifically, notch 546 is defined at corner 548 defined by free edge 98 and bottom edge 78 on each inner side panel 84. Notch 546 is configured to correspond to a portion of cutout 542 such that cutout 542 is not obstructed by inner side panels 84 when container 550 is formed. In an alternatively embodiment, notch 546 may have any suitable configuration that enables blank 500 and/or container 550 to function as described herein. Alternatively, at least one inner side panel 84 does not include notch 546. Moreover, it will be understood that notch 546 may be included in any of the embodiments described herein on any suitable panel.

Figure 11:
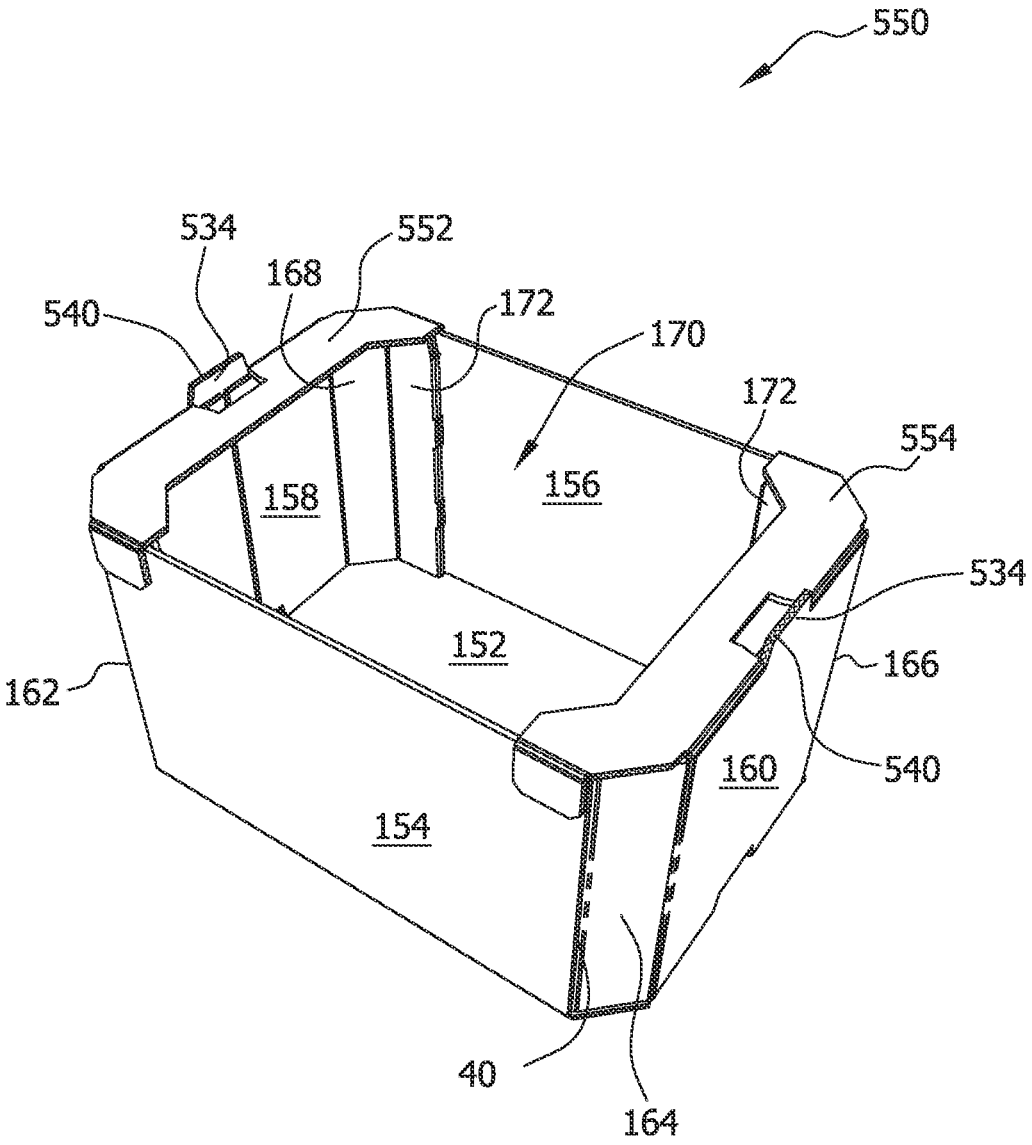
FIG. 11 is a perspective view of a container formed from the blank shown in FIG. 10.

FIG. 11 is a perspective view of container 550 that is formed from blank 500 (shown in FIG. 10). Container 550 is essentially similar to container 150 (shown in FIG. 2) and, as such, similar components are labeled with similar references. Although container 550 is shown as being formed without a product to be contained therein, container 550 may also be formed having a product therein. Further, container 550 may include any suitable number of products of any suitable shape. To construct container 550 from blank 500 a method that is substantially similar to the method for forming container 150 from blank 10 is used. By forming top shoulders 552 and 554 of container 550, container 550 is considered to be in the closed configuration rather than the open configuration of containers 150.

To close container 550 and form top shoulders 552 and 554, first top panel 502 is rotated about fold line 506 toward cavity 170 such that first top panel 502 is substantially perpendicular to first side wall 158 and substantially parallel to bottom wall 152. Further, second top panel 504 is rotated about fold line 508 toward cavity 170 such that second top panel 504 is substantially perpendicular to second side wall 160 and substantially parallel to bottom wall 152. Closure flaps 528 are then rotated toward exterior surface 14 of front panel 20 and rear panel 24 and are secured thereto to form portions of front wall 154 and rear wall 156, respectively. In the exemplary embodiment, interior surface 12 of each closure flap 528 is adhered to exterior surface 14 of front panel 20 or rear panel 24. First and second top panels 502 and 504 form top shoulders 552 and 554 of container 550.

Figure 12:
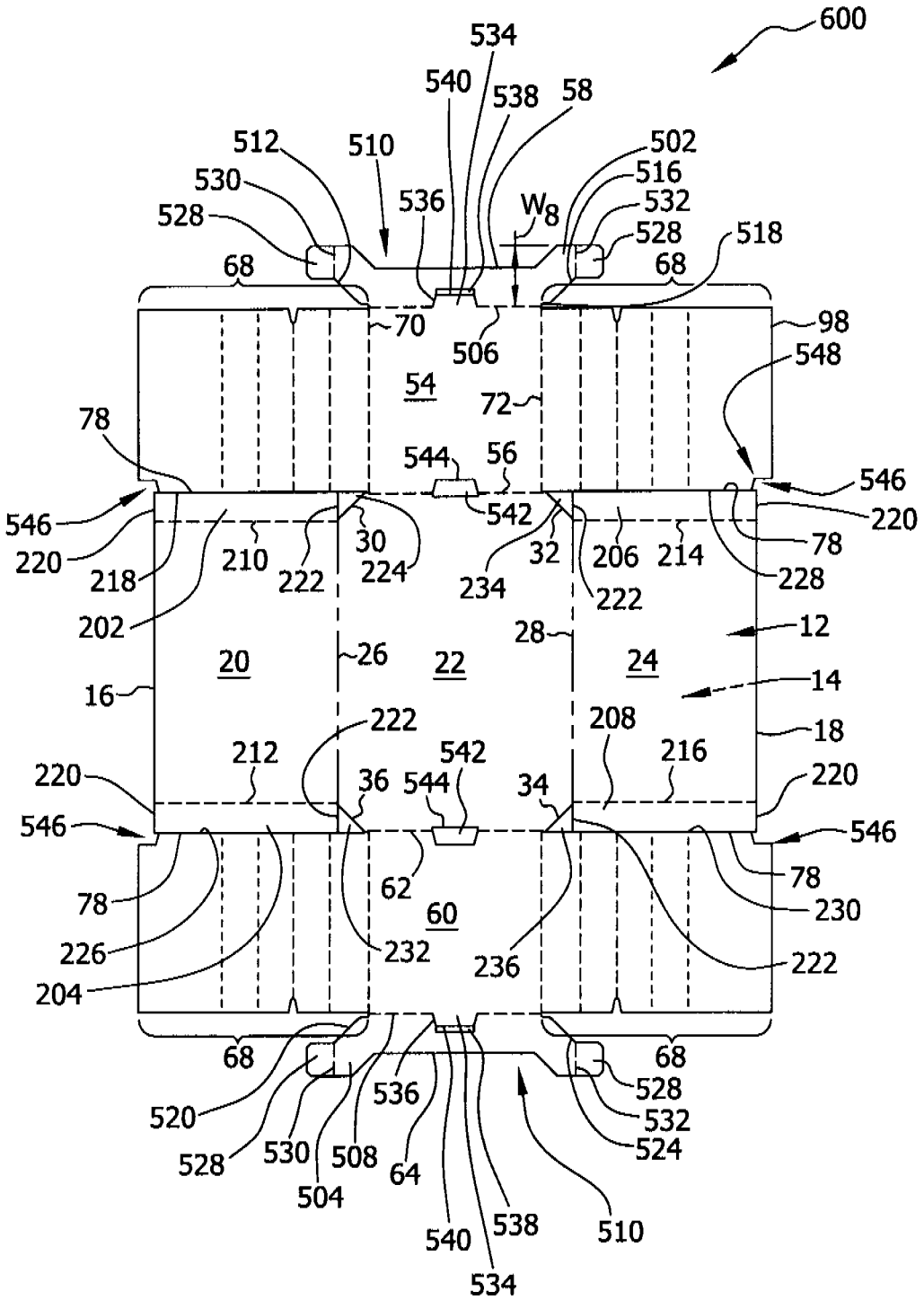
FIG. 12 is a top plan view of a blank of sheet material for constructing a container according to a fifth alternative embodiment of the present invention.

FIG. 12 is a top plan view of an example embodiment of a blank 600 of sheet material. Blank 600 is essentially similar to blank 200 (shown in FIG. 3) and blank 500 (shown in FIG. 10) and, as such, similar components are labeled with similar references. More specifically, blank 600 is similar to blank 500 and includes outer reinforcing corner panels 202, 204, 206, and 208, as shown and described with respect to FIG. 3. Further, blank 600 includes fold lines 210, 212, 214, and 216 rather than free side edges 38, 40, 42, and 44 (shown in FIG. 10), as shown and described with respect to FIG. 3.

Figure 13:
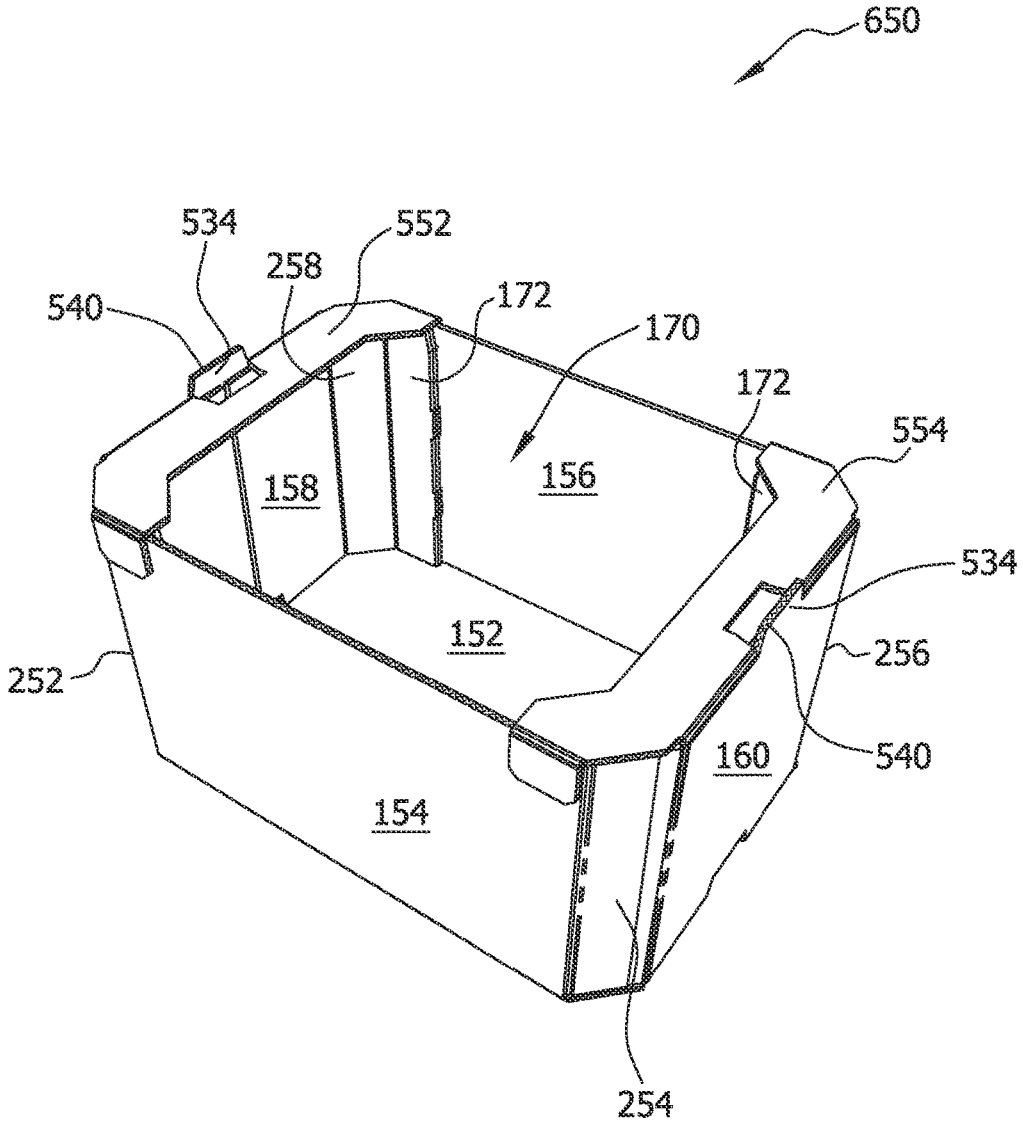
FIG. 13 is a perspective view of a container formed from the blank shown in FIG. 12.

FIG. 13 is a perspective view of a container 650 that is partially formed from blank 600 (shown in FIG. 12). Container 650 is essentially similar to container 250 (shown in FIG. 4) and container 550 (shown in FIG. 11) and, as such, similar components are labeled with similar references. Although container 650 is shown as being formed without a product to be contained therein, container 650 may also be formed having a product therein. Further, container 650 may include any suitable number of products of any suitable shape. To construct container 650 from blank 600 a method that is substantially similar to the method for forming container 250 from blank 200 is used. To close container 650, top shoulders 552 and 554 are formed using the method used to construct container 550 from blank 500.

Figure 14:
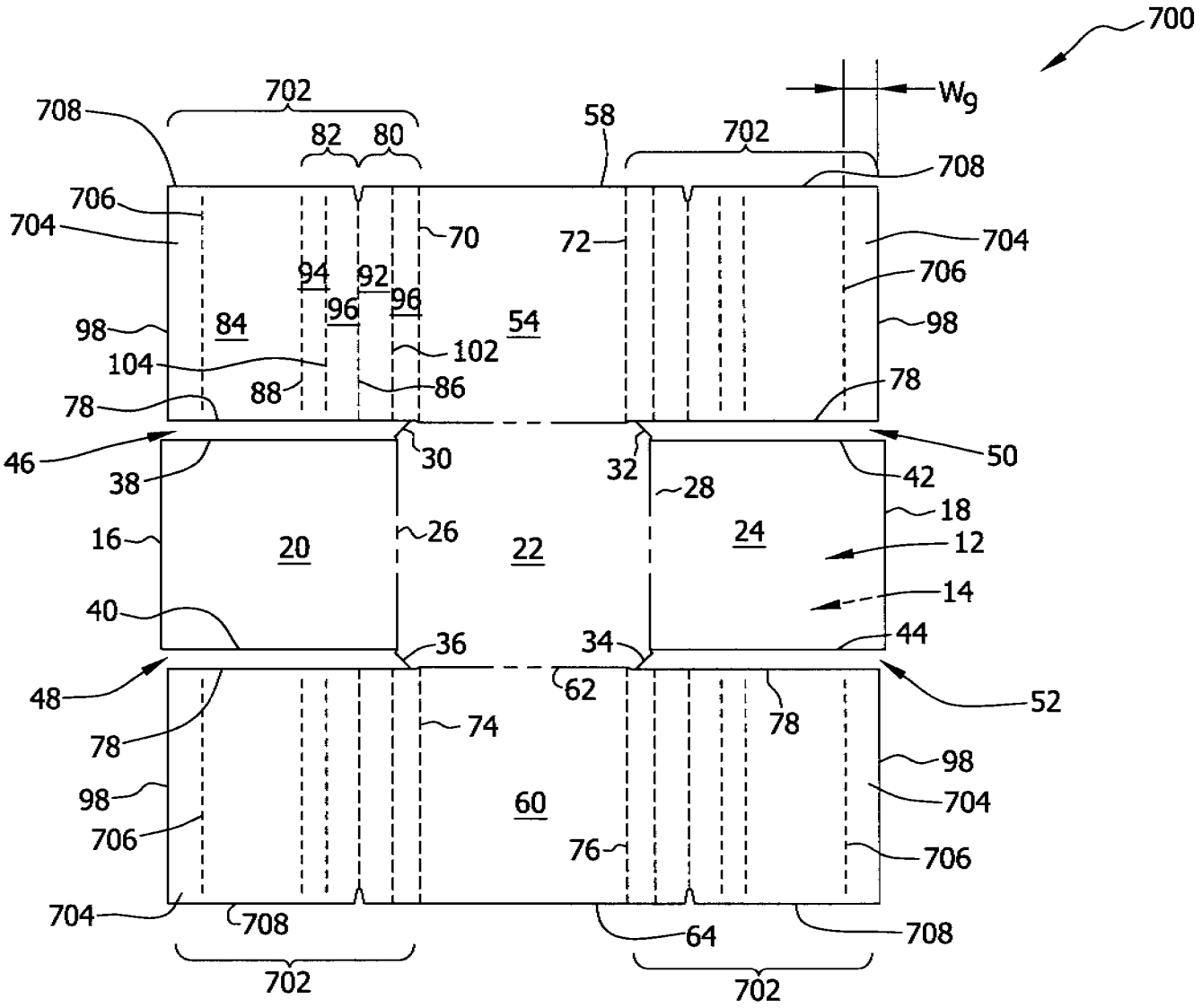
FIG. 14 is a top plan view of a blank of sheet material for constructing a container according to a sixth alternative embodiment of the present invention.
Figure 15:
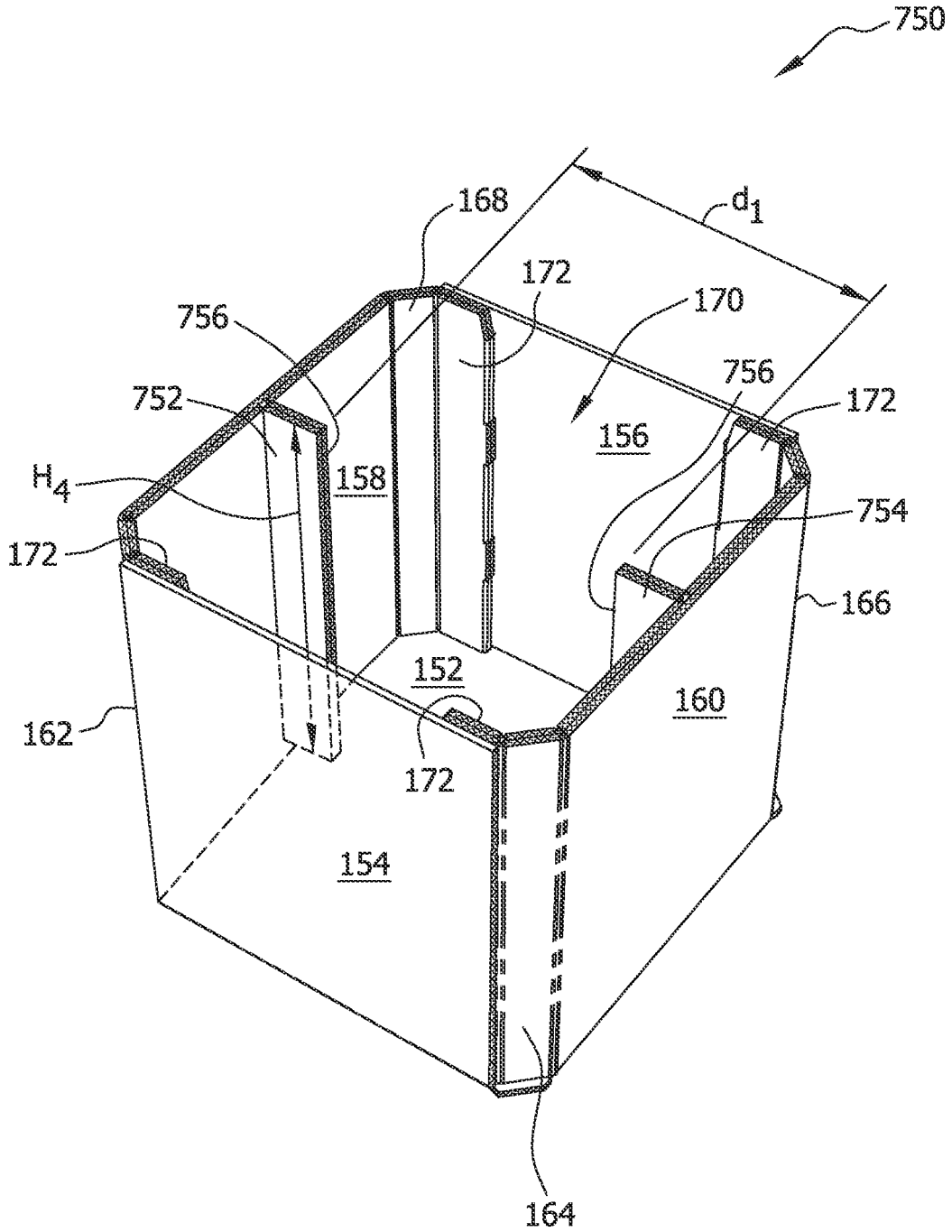
FIG. 15 is a perspective view of a container formed from the blank shown in FIG. 14.

FIG. 14 is a top plan view of an example embodiment of a blank 700 of sheet material for forming a container 750 (shown in FIG. 15). Blank 700 is essentially similar to blank 10 (shown in FIG. 1) and, as such, similar components are labeled with similar references. More specifically, blank 700 includes reinforcing panels 702 that each include a support panel 704. Moreover, blank 700 does not include cutouts 66 and 106, however, it will be understood that blank 700 may include cutouts 66 and/or 106 on side panels 54 and/or 60, front panel 20, and/or rear panel 24. Further, in an alternative embodiment, blank 700 includes top panels 302 and 304, as shown as described with respect to FIG. 5, and/or top panels 502 and 504, as shown and described with respect to FIG. 10.

In the exemplary embodiment, blank 700 includes a reinforcing panel 702 that extends from each side edge of side panels 54 and 60. Reinforcing panel 702 is also referred to herein as a reinforcing panel assembly that includes a plurality of panels as described in more detail herein. More specifically, a reinforcing panel 702 extends from each of fold lines 70, 72, 74, and 76. Further, each reinforcing panel 702 includes free bottom edge 78. Each free bottom edge 78 at least partially defines cutouts 46, 48, 50, and 52. Moreover, each reinforcing panel 702 is substantially similar and includes, in series from a fold line 70, 72, 74, or 76 to free edge 98, outer reinforcing panel 80, inner reinforcing panel 82, inner side panel 84, and support panel 704, connected along substantially parallel fold lines 86, 88, and 706. Fold line 706 defines a side edge of inner side panel 84 and a side edge of support panel 704, and free edge 98 defines a side edge of support panel 704.

Outer reinforcing panel 80 includes corner panel 90 and first reinforcing end panel 92, and inner reinforcing panel 82 includes inner reinforcing corner panel 94 and second reinforcing end panel 96. More specifically, support panel 704 extends between free edge 98 and fold line 706, inner side panel 84 extends from support panel 704 along fold line 706, inner reinforcing corner panel 94 extends from inner side panel 84 along fold line 88, second reinforcing end panel 96 extends from inner reinforcing corner panel 94 along fold line 104, first reinforcing end panel 92 extends from second reinforcing end panel 96 along fold line 86, and corner panel 90 extends from first reinforcing end panel 92 along fold line 102 to a respective fold line 70, 72, 74, or 76.

In the exemplary embodiment, each support panel 704 is substantially rectangularly shaped, although it will be understood that support panel 704 may have any suitable shape and/or configuration that enables blank 700 and/or container 750 to function as described in herein. Further, in the exemplary embodiment, support panel 704 has a width $W_9$ that is substantially constant from a top edge 708 of reinforcing panel 702 to bottom edge 78. Alternatively, width $W_9$ may be other than constant between top edge 708 and bottom edge 78. In the exemplary embodiment, width $W_9$ is less than half of width $W_2$ of bottom panel 22. Alternatively, width $W_9$ is equal to or greater than width $W_2$ such that support walls 752 and 754 (shown in FIG. 15) formed from support panels 704 divide container 750 and provide support to container 750. In the exemplary embodiment, each support panel 704 includes the same width $W_9$. In an alternative embodiment, at least one support panel 704 includes a width that is different than width $W_9$ of other support panels 704.

FIG. 15 is a perspective view of container 750 that is formed from blank 700 (shown in FIG. 14). Container 750 is essentially similar to container 150 (shown in FIG. 2) and, as such, similar components are labeled with similar references. Although container 750 is shown as being formed without a product to be contained therein, container 750 may also be formed having a product therein. Further, container 750 may include any suitable number of products of any suitable shape. To construct container 750 from blank 700 a method that is substantially similar to the method for forming container 150 from blank 10 is used except support walls 752 and 754 are formed. In the exemplary embodiment, container 750 has an open configuration, however, it will be understood that container 750 may include a top wall and be in a closed configuration.

To construct container 750 from blank 700, each inner side panel 84 and respective inner reinforcing panel 82 are folded about fold line 86 such that inner reinforcing panel 82 and outer reinforcing panel 80 are in an at least partially overlying relationship, and such that inner side panel 84 is in an at least partially overlying relationship with at least a portion of first or second side panel 54 or 60. More specifically, blank 700 is folded along fold line 86 such that corner panel 90 and inner reinforcing corner panel 94 are substantially aligned in an at least partially overlying relationship, first and second reinforcing end panels 92 and 96 are substantially aligned in an at least partially overlying relationship, and inner side panel 84 and at least a portion of first or second side panel 54 or 60 are substantially aligned in an at least partially overlying relationship. As blank 700 is being folded about fold line 86, support panels 704 are folded about fold lines 706 such that exterior surface 14 of support panel 704 is rotated towards exterior surface 14 of inner side panel 84. Alternatively, support panels 704 are rotated about fold lines 706 before or after blank 700 is folded about fold line 86. In the exemplary embodiment, after blank 700 is folded about fold lines 86 and 706, one support panel 704 is aligned in at least partially overlying relationship within another support panel 704 such that interior surfaces 12 of support panels 704 are adjacent to each other.

In the exemplary embodiment, inner side panel 84, a respective side panel 54 or 60, reinforcing end panels 92 and 96, corner panels 90 and 94 and/or support panels 704 are secured in the above-described relationships. For example, inner side panel 84, a respective side panel 54 or 60, reinforcing end panels 92 and 96, corner panels 90 and 94 and/or support panels 704 are held against the product to be contained by a force on exterior surface 14 as container 750 continues to be erected. In another example, inner side panel 84 may be adhered to a respective side panel 54 or 60, reinforcing end panels 92 and 96 may be adhered together, corner panels 90 and 94 may be adhered together, and/or support panels 704 may be adhered together. Reinforcing walls 80 and 82, reinforcing end panels 92 and 96 are rotated about fold lines 70, 72, 74, 76, 88, 102, and/or 104 as described with respect to container 150. Further, the remainder of container 750 is constructed similarly to container 150.

When container 150 is formed, support panels 704 form a first support wall 752 and a second support wall 754 extending into cavity 170. More specifically, first support wall 752 extends from first side wall 158, and second support wall 754 extends from second side wall 160. In the exemplary embodiment, support panels 704 forming each support wall 752 and 754 are in contact with each other along a height $H_4$ of each support wall 752 and 754. Alternatively, a gap may be defined between support panels 704 forming support wall 752 and/or 754 along at least a portion of height $H_4$. Further, in the exemplary embodiment, support wall 752 is separated from support wall 754 by a distance $d_1$. Alternatively, support walls 752 and 754 are in contact along at least a portion of an inner edge 756 of each support wall 752 and 754. In an alternative embodiment, at least a portion of support wall 752 overlaps support wall 754.

Figure 16:
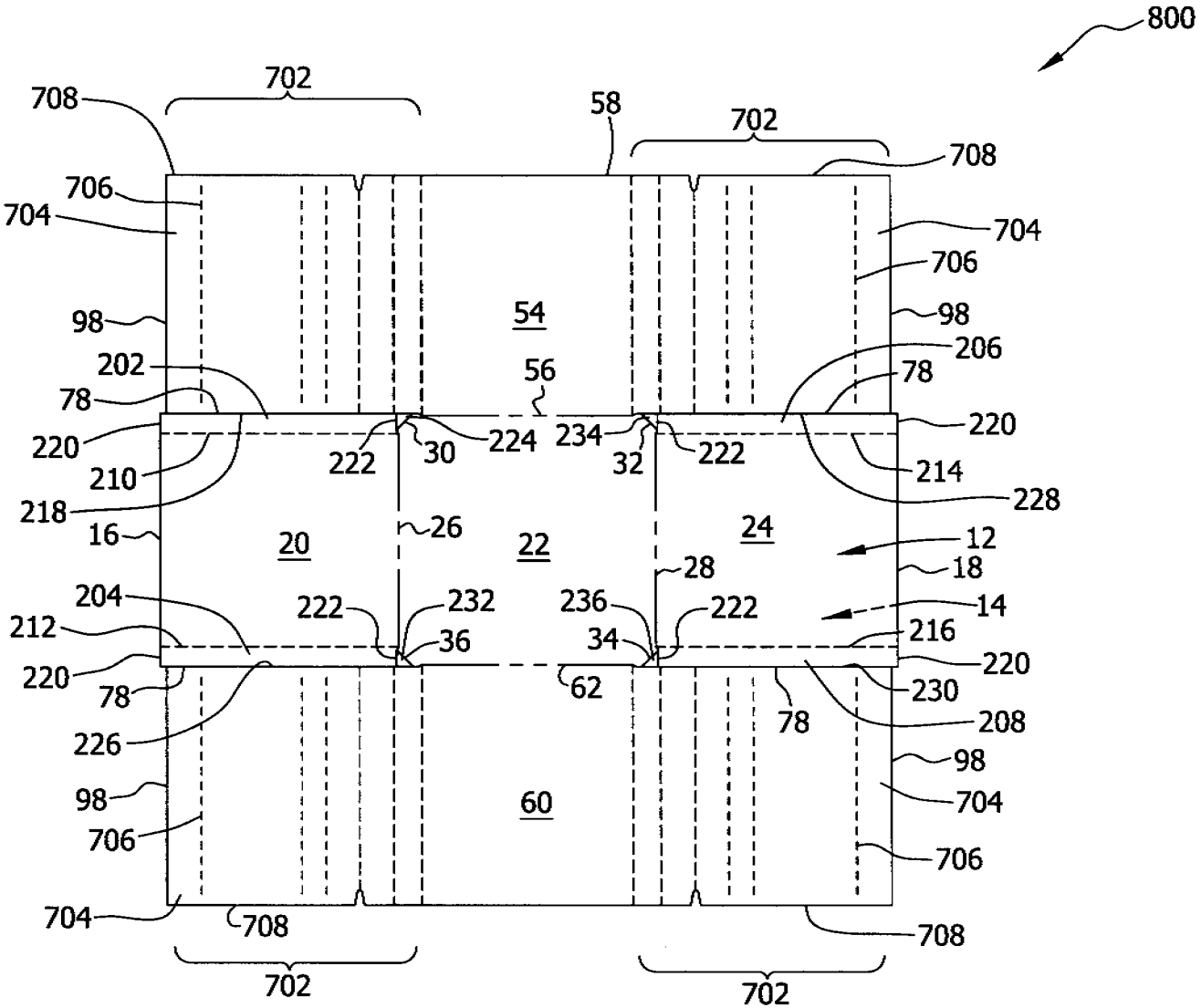
FIG. 16 is a top plan view of a blank of sheet material for constructing a container according to a seventh alternative embodiment of the present invention.

FIG. 16 is a top plan view of an example embodiment of a blank 800 of sheet material. Blank 800 is essentially similar to blank 200 (shown in FIG. 3) and blank 700 (shown in FIG. 14) and, as such, similar components are labeled with similar references. More specifically, blank 800 is similar to blank 700 and includes outer reinforcing corner panels 202, 204, 206, and 208, as shown and described with respect to FIG. 3. Further, blank 700 includes fold lines 210, 212, 214, and 216 rather than free side edges 38, 40, 42, and 44 (shown in FIG. 14), as shown and described with respect to FIG. 3.

In the exemplary embodiment, blank 800 does not include cutouts 66 and 106 (shown in FIG. 3), however, it will be understood that blank 800 may include cutouts 66 and/or 106 on side panels 54 and/or 60, front panel 20, and/or rear panel 24. Further, in an alternative embodiment, blank 800 includes top panels 302 and 304, as shown as described with respect to FIG. 5, and/or top panels 502 and 504, as shown and described with respect to FIG. 10.

Figure 17:
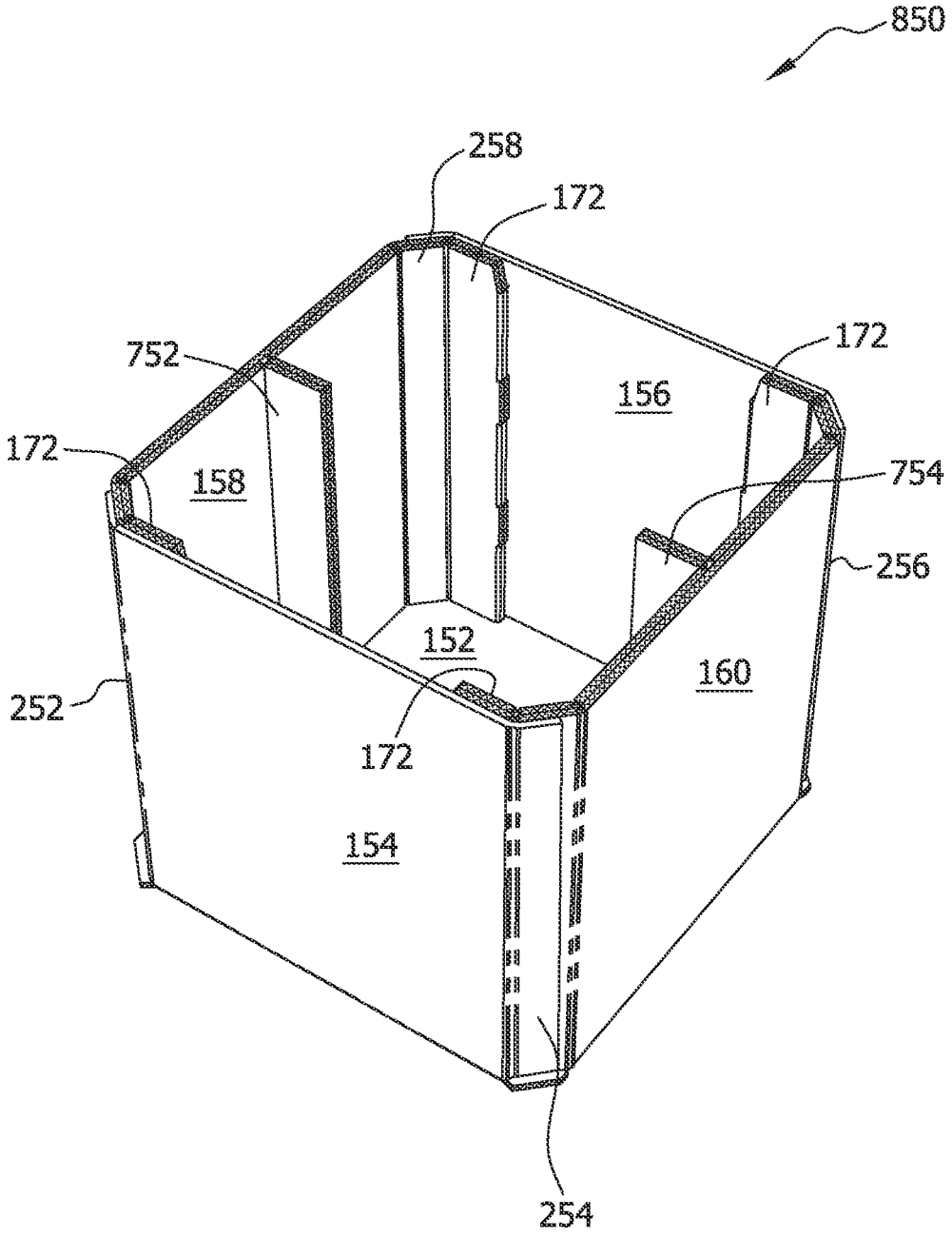
FIG. 17 is a perspective view of a container formed from the blank shown in FIG. 16.

FIG. 17 is a perspective view of a container 850 that is partially formed from blank 800 (shown in FIG. 16). Container 850 is essentially similar to container 250 (shown in FIG. 4) and container 750 (shown in FIG. 15) and, as such, similar components are labeled with similar references. Although container 850 is shown as being formed without a product to be contained therein, container 850 may also be formed having a product therein. Further, container 850 may include any suitable number of products of any suitable shape. To construct container 850 from blank 800 a method that is substantially similar to the methods for forming container 250 and container 750 are used.

Figure 18:
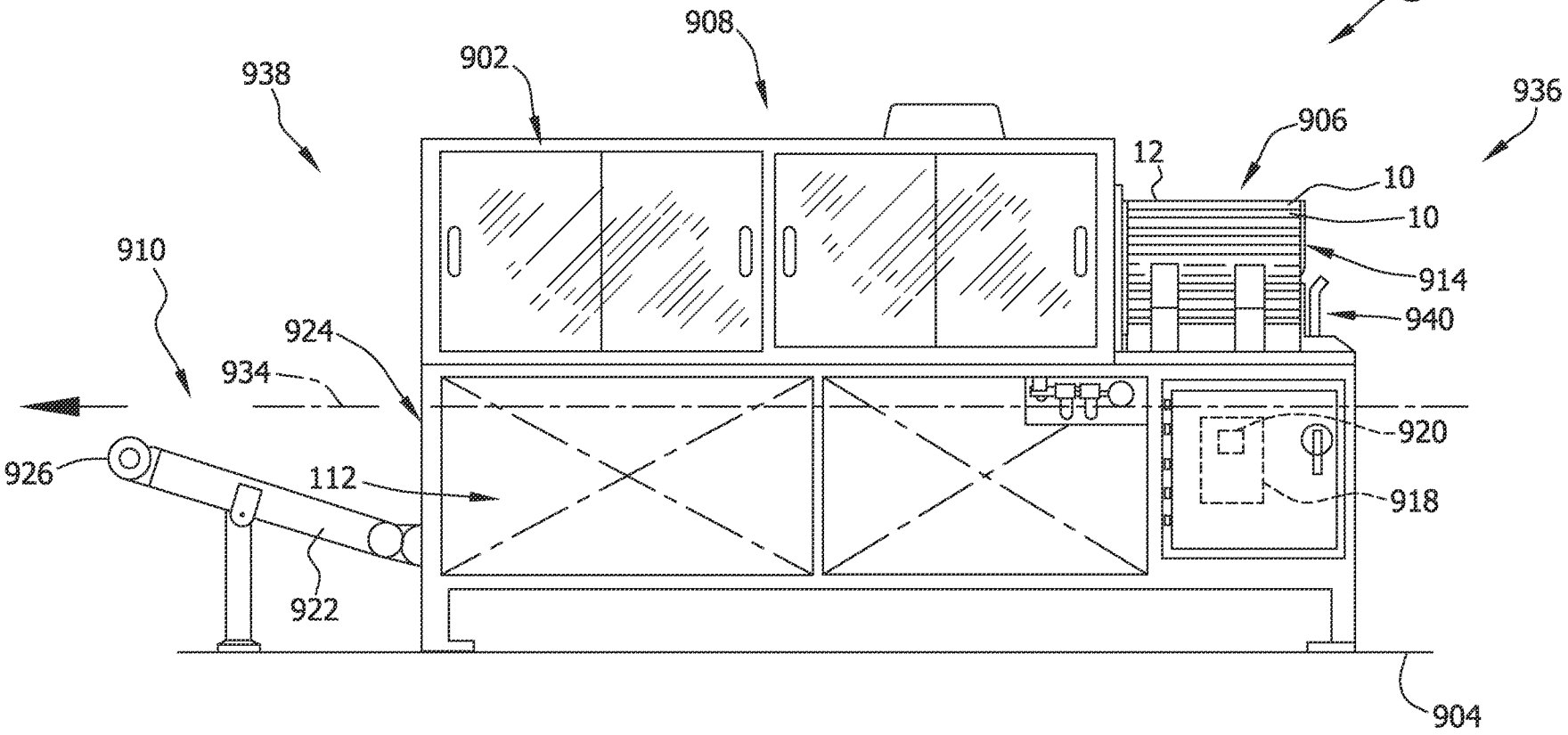
FIG. 18 is a side view of a machine for forming a container from a blank.
Figure 19:
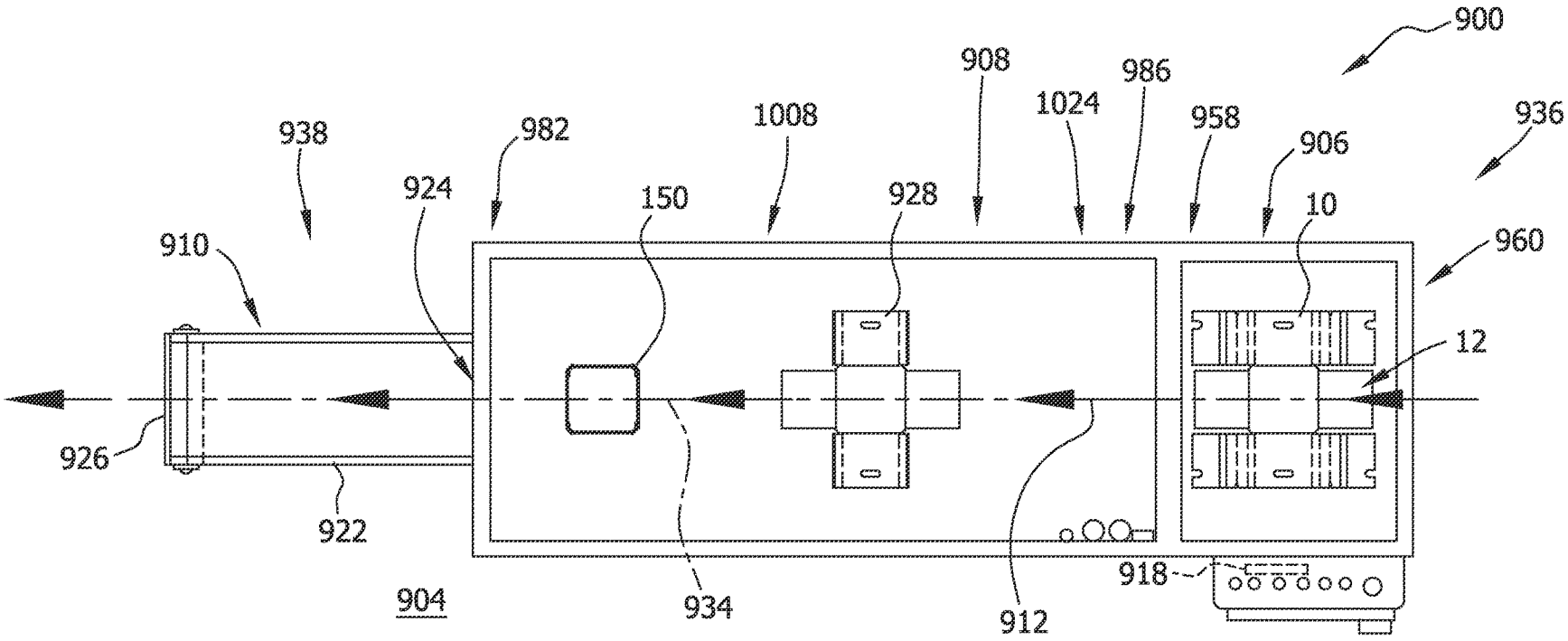
FIG. 19 is a top view of the machine shown in FIG. 18.

FIG. 18 is a side view of a machine 900 for forming a container from a blank. FIG. 19 is a top view of machine 900. Blank 10 and container 150 are illustrated as being formed using machine 900; however, it will be understood that any of the above-described blanks can be formed into a respective container using machine 900. As used herein, the terms "downward," "down," and variations thereof refer to a direction from a top 902 of machine 900 toward a surface or floor 904 on which machine 900 is supported, and the terms "upward," "up," and variations thereof refer to a direction from floor 904 on which machine 900 is supported toward top 902 of machine 900. Further, as used herein, "operational control communication" refers to a link, such as a conductor, a wire, and/or a data link, between two or more components of machine 900 that enables signals, electric currents, and/or commands to be communicated between the two or more components. The link is configured to enable one component to control an operation of another component of machine 900 using the communicated signals, electric currents, and/or commands.

In the exemplary embodiment, machine 900 includes a hopper station 906, a forming station 908, and an ejection station 910. More specifically, hopper station 906, forming station 908, and ejection station 910 are connected by a transport system 912, such as any suitable conveyor(s) and/or motorize device(s) configured to move blank 10 and/or container 150 through machine 900. In the exemplary embodiment, hopper station 906 is configured to store a stack 914 of blanks 10 in a horizontal orientation. More specifically, blanks 10 are stored with interior surface 12 facing upward and exterior surface 14 facing downward.

Forming station 908 is generally aligned with a bottom 916 of hopper station 906 and includes any suitable number and/or configuration of components, such as plows, arms, actuators, and/or other devices for forming container 150 from blank 10. In the exemplary embodiment, components of forming station 908 are in communication with a control system 918. Control system 918 is configured to control and/or monitor components of forming station 908 to form container 150 from blank 10. In the exemplary embodiment, control system 918 includes computer-readable instructions for performing the methods described herein. In one embodiment, an operator can select which blank 10, 200, 300, 400, 500, 600, 700, and/or 800 is being manipulated by machine 900 using control system 918 and control system 918 performs the corresponding method using the components of forming station 908.

In the exemplary embodiment, control system 918 is shown as being centralized within machine 900, however control system 918 may be a distributed system throughout machine 900, within a building housing machine 900, and/or at a remote control center. Control system 918 includes a processor 920 configured to perform the methods and/or steps described herein. Further, many of the other components described herein include a processor. As used herein, the term "processor" is not limited to integrated circuits referred to in the art as a computer, but broadly refers to a controller, a microcontroller, a microcomputer, a programmable logic controller (PLC), an application specific integrated circuit, and other programmable circuits, and these terms are used interchangeably herein. It should be understood that a processor and/or control system can also include memory, input channels, and/or output channels.

In the embodiments described herein, memory may include, without limitation, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, input channels may include, without limitation, sensors and/or computer peripherals associated with an operator interface, such as a mouse and a keyboard. Further, in the exemplary embodiment, output channels may include, without limitation, a control device, an operator interface monitor, and/or a display.

Processors described herein process information transmitted from a plurality of electrical and electronic devices that may include, without limitation, sensors, actuators, compressors, control systems, and/or monitoring devices. Such processors may be physically located in, for example, a control system, a sensor, a monitoring device, a desktop computer, a laptop computer, a PLC cabinet, and/or a distributed control system (DCS) cabinet. RAM and storage devices store and transfer information and instructions to be executed by the processor(s). RAM and storage devices can also be used to store and provide temporary variables, static (i.e., non-changing) information and instructions, or other intermediate information to the processors during execution of instructions by the processor(s). Instructions that are executed may include, without limitation, flow control system control commands. The execution of sequences of instructions is not limited to any specific combination of hardware circuitry and software instructions.

In the exemplary embodiment, ejection station 910 is configured to eject container 150 from forming station 908. More specifically, in the exemplary embodiment, ejection station 910 includes an exit conveyor 922 that is oriented on an incline from an exit 924 of forming station 908 to an end 926 of exit conveyor 922. Alternatively, exit conveyor 922 is at any suitable orientation that enables machine 900 to function as described herein. In the exemplary embodiment, exit conveyor 922 is part of transport system 912.

During operation of machine 900 to form container 150 from blank 10, stack 914 of blanks 10 is placed within hopper station 906. Transport system 912 removes one blank 10 from stack 914 and transfers blank 10 to forming station 908. Transport system 912 transfers blank 10 through the components of forming station 908. The components of forming station 908 perform the method for forming container 150 from blank 10, as described in more detail above. Within forming station 908, blank 10 is folded into a partially formed container 928. Partially formed container 928 is formed into container 150 within forming station 908, and a subsequent blank 10 is transferred from hopper station 906 into forming station 908. As such, containers 150 are formed continuously by machine 900. After container 150 is formed in forming station 908, transport system 912 transfers container 150 to ejection station 910 for ejection from machine 900.

Figure 20:
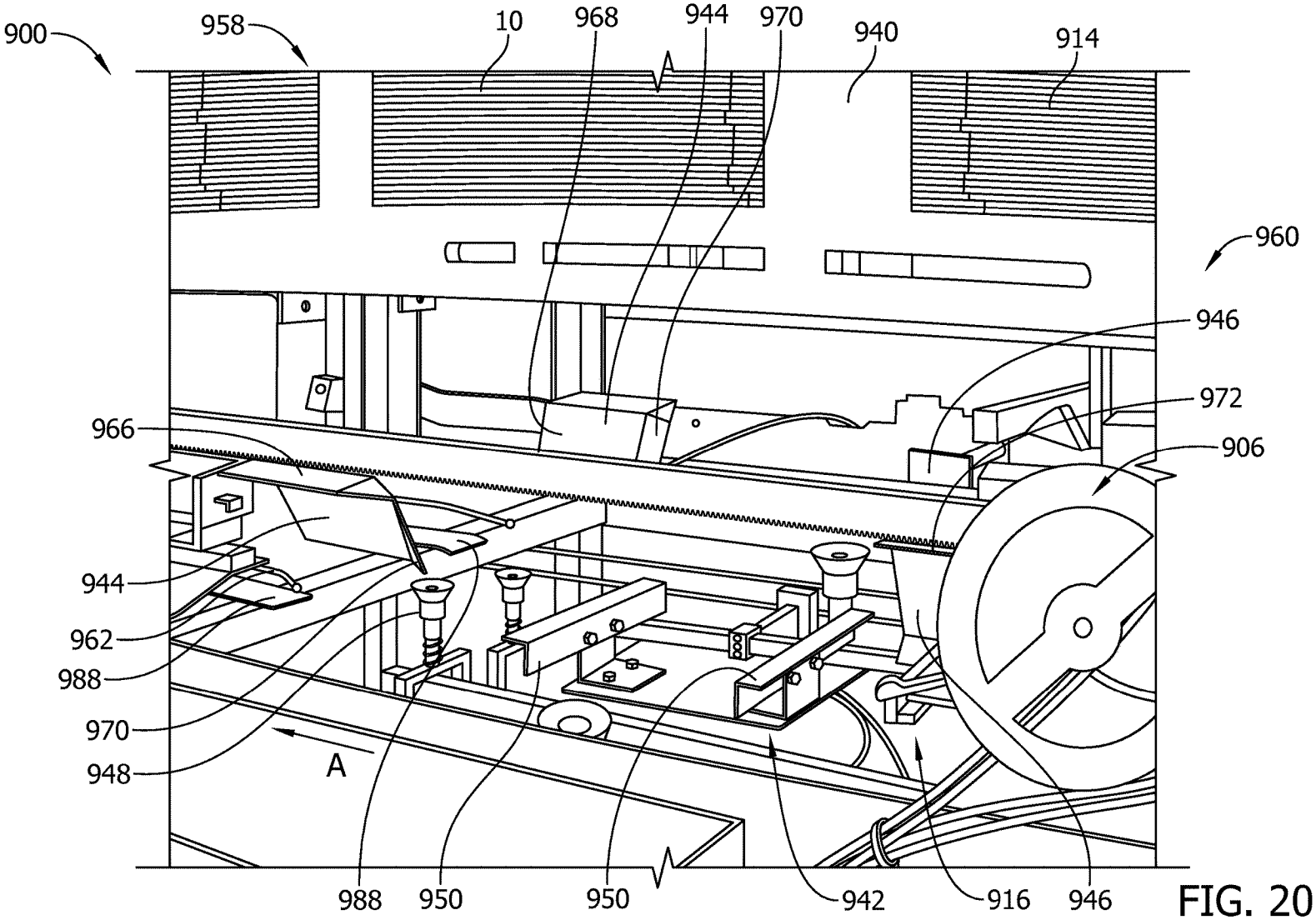
FIG. 20 is a perspective view of a hopper station of the machine shown in FIG. 18.
Figure 21:
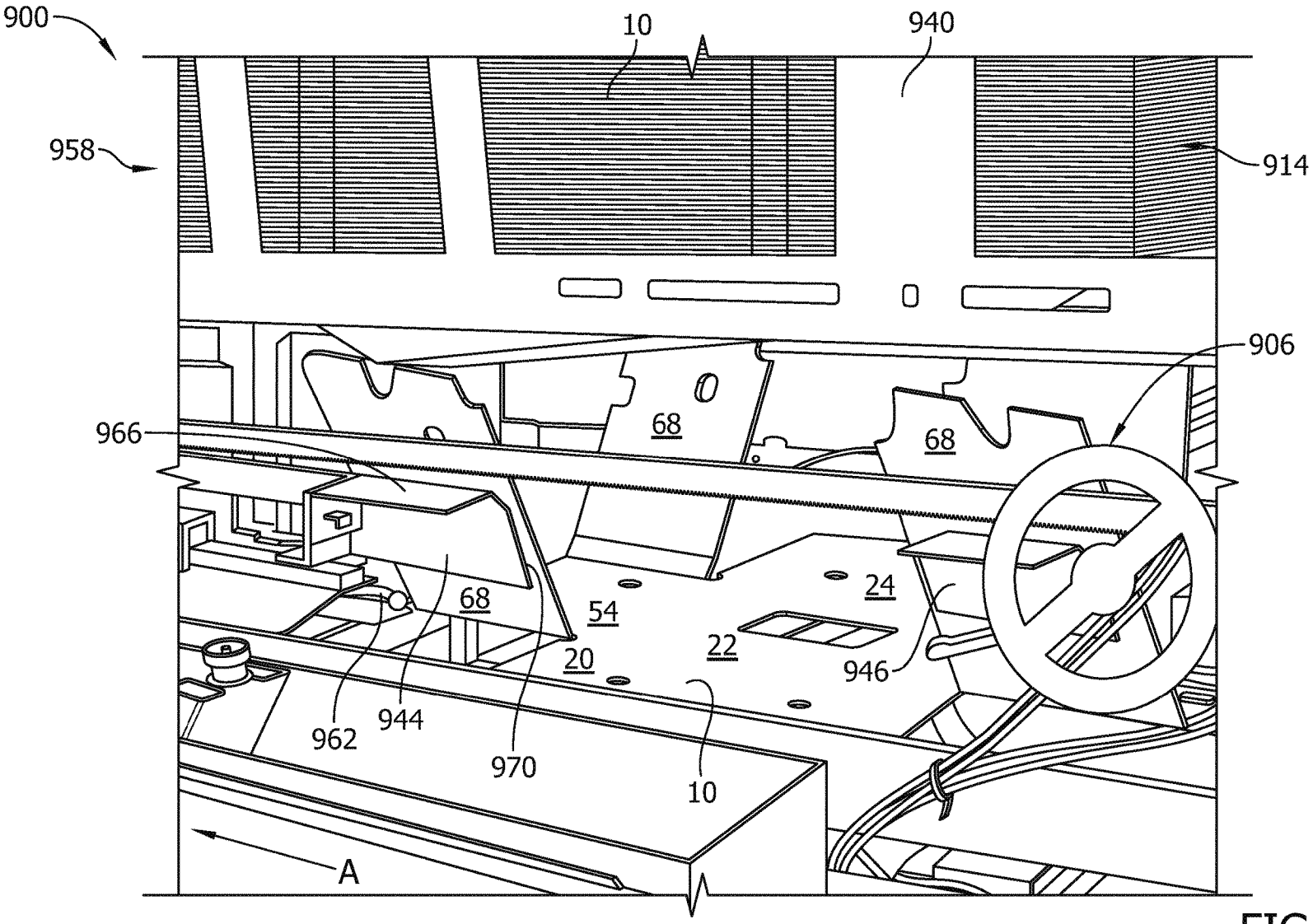
FIG. 21 is a perspective view of the hopper station shown in FIG. 20 with a blank therein.
Figure 22:
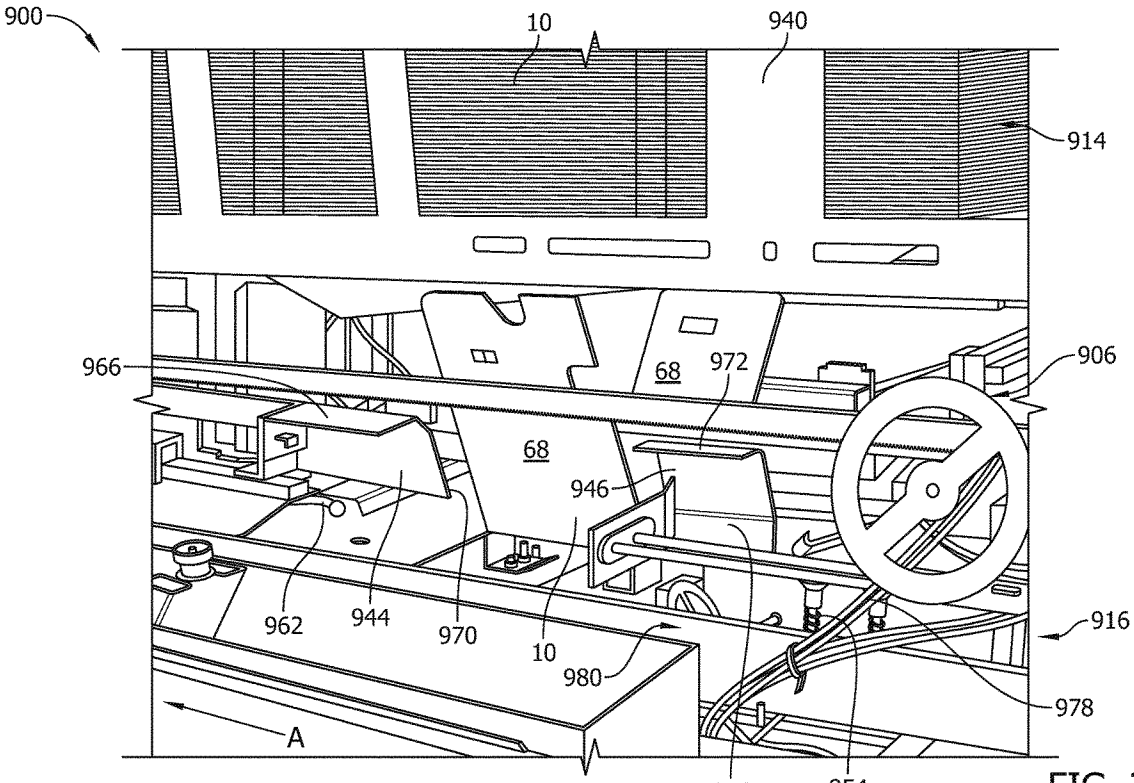
FIG. 22 is a perspective view of the hopper station shown in FIG. 20 while the blank is being transferred to a forming station of the machine shown in FIG. 18.

FIGS. 20-38 show perspective views of machine 900. Arrow A shows a direction of movement of blank 10 and/or container 150 through machine 900. Further, the head of arrow A indicates a "downstream" or "forward" direction and the tail of arrow A indicates an "upstream" or "backward" direction. FIG. 20 shows a perspective view of hopper station 906. The term "front" as used herein with respect to movement through machine 900 refers the downstream end of blank 10, and the term "rear" as used herein with respect to movement through machine 900 refers the upstream end of blank 10. FIG. 21 shows a perspective view of hopper station 906 having a blank 10 therein. FIG. 22 shows a perspective view of hopper station 906 while blank 10 is being transferred to forming station 908.

Figure 23:
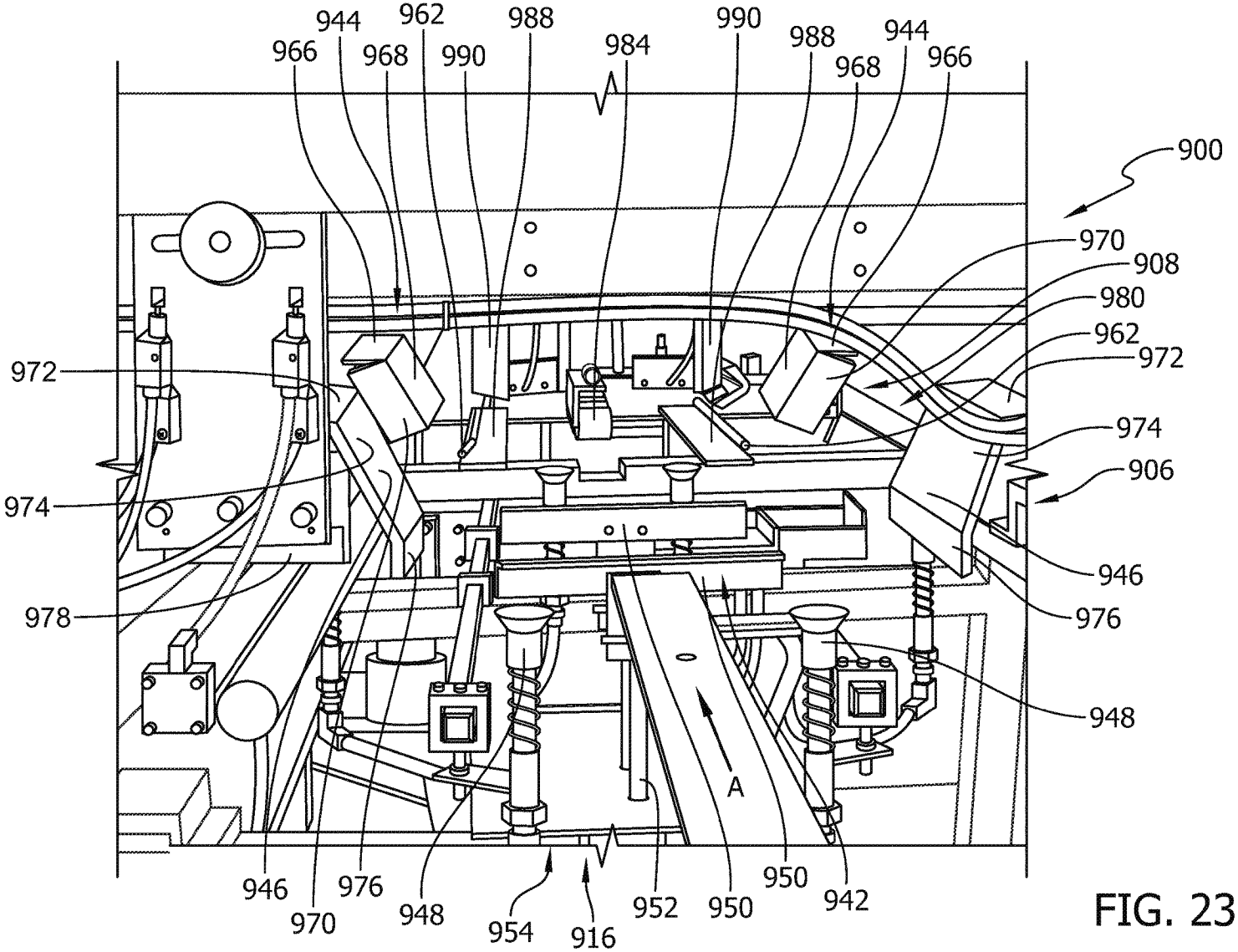
FIG. 23 is a perspective view of the hopper station and the forming station of the machine shown in FIG. 18.
Figure 24:
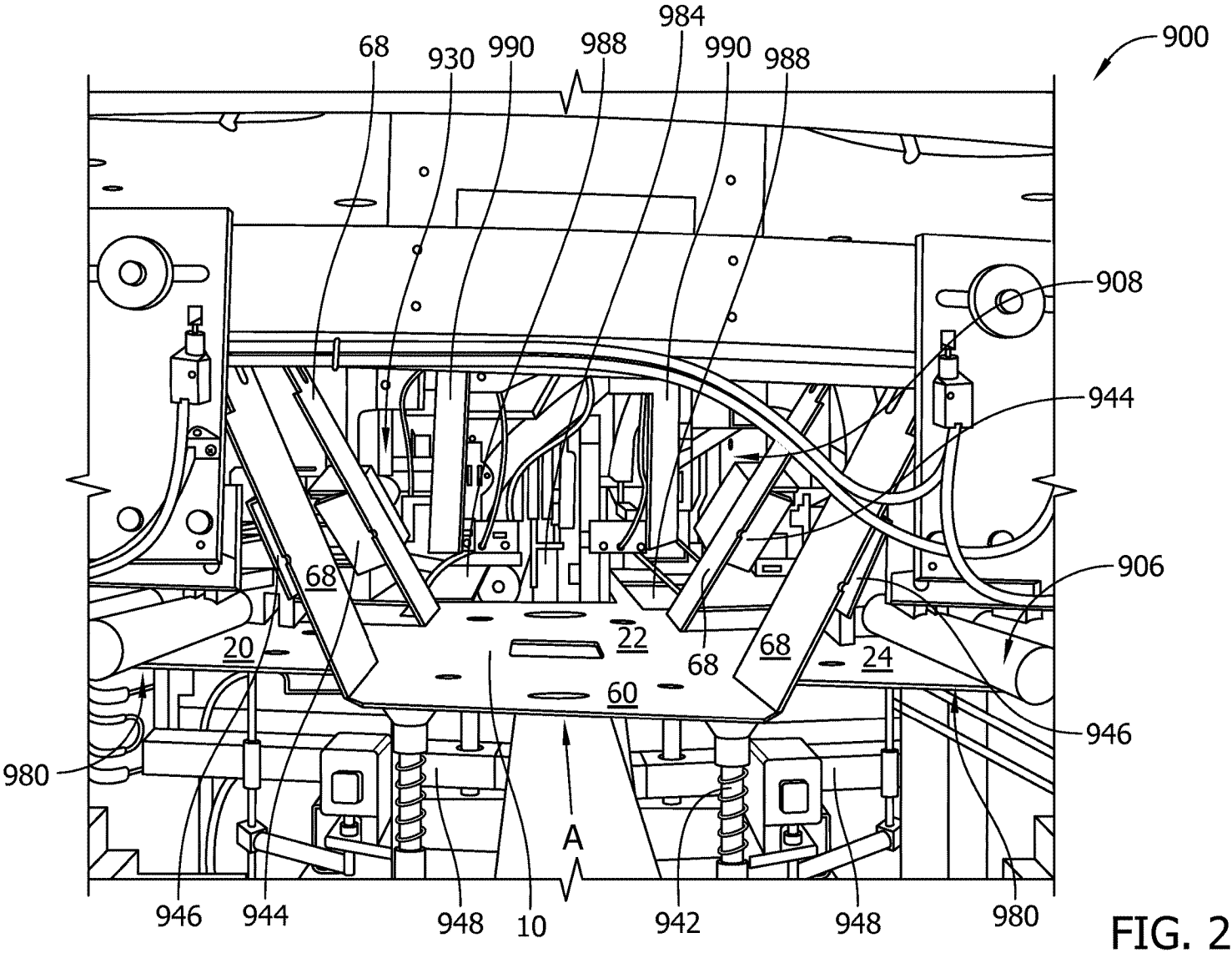
FIG. 24 is a perspective view of the hopper station and the forming station of the machine shown in FIG. 18 with a blank in the hopper station.
Figure 25:
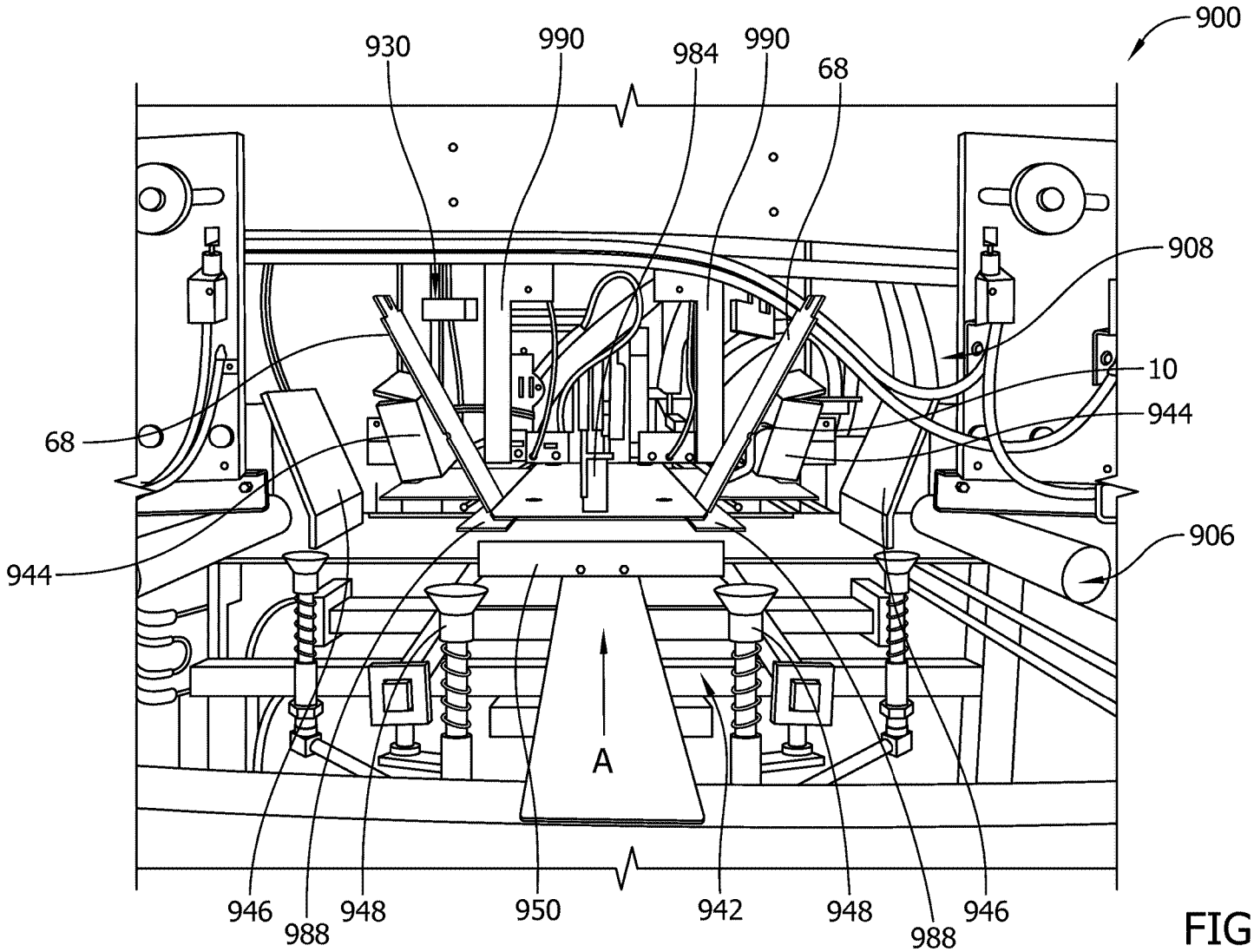
FIG. 25 is a perspective view of the hopper station and the forming station of the machine shown in FIG. 18 with a blank in the forming station.
Figure 26:
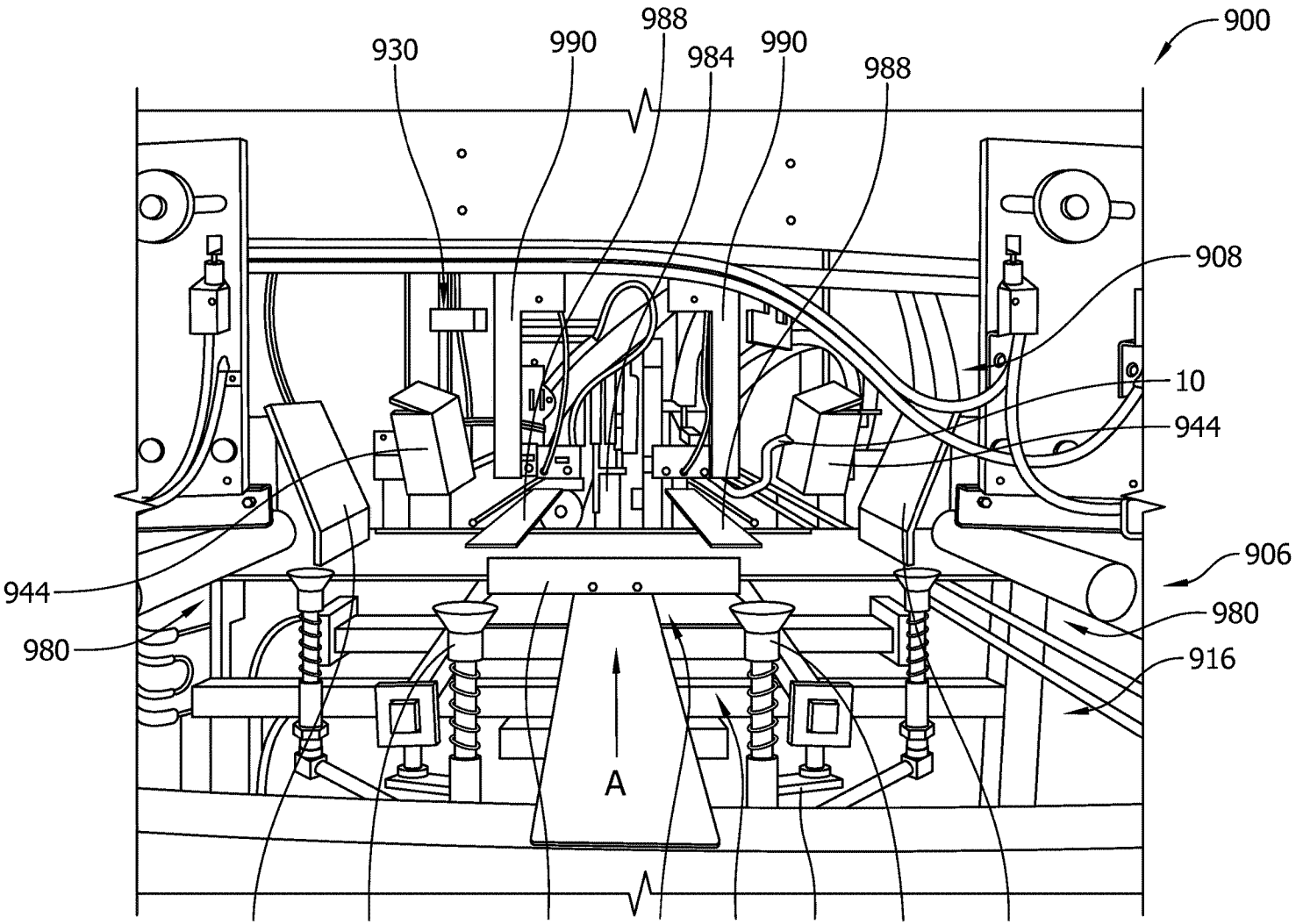
FIG. 26 is a perspective view of the hopper station and the forming station of the machine shown in FIG. 18 with a blank in the forming station.
Figure 27:
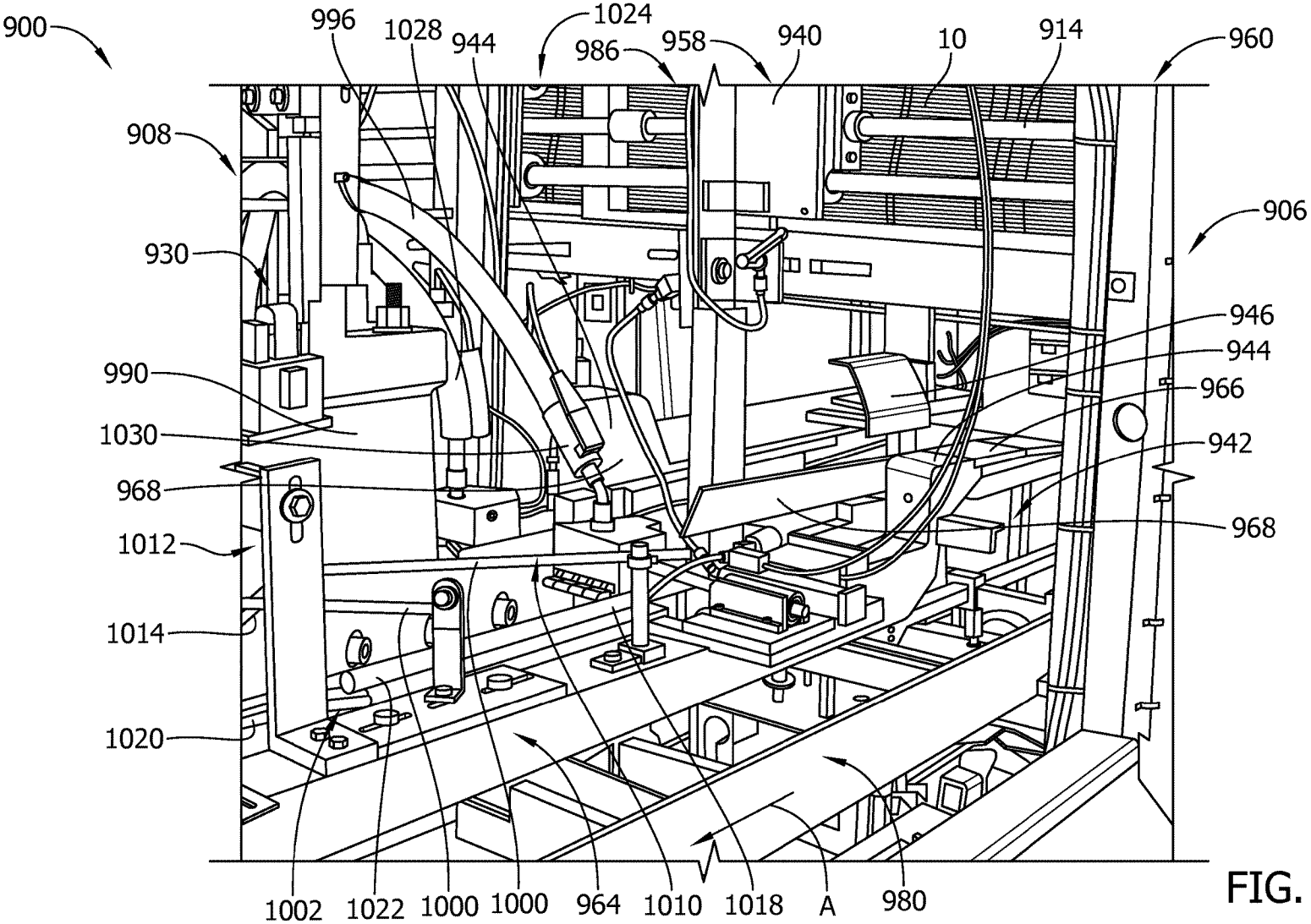
FIG. 27 is a perspective view of the forming station and the hopper station of the machine shown in FIG. 18.

FIG. 23 shows a perspective view of hopper station 906 and forming station 908. FIG. 24 shows a perspective view of hopper station 906 and forming station 908 with a blank 10 in hopper station 906. FIG. 25 shows a perspective view of hopper station 906 and forming station 908 with blank 10 in forming station 908. FIG. 26 shows a perspective view of hopper station 906 and forming station 908 with blank 10 in forming station 908. FIG. 27 shows a perspective view of forming station 908 looking back into hopper station 906.

Figure 28:
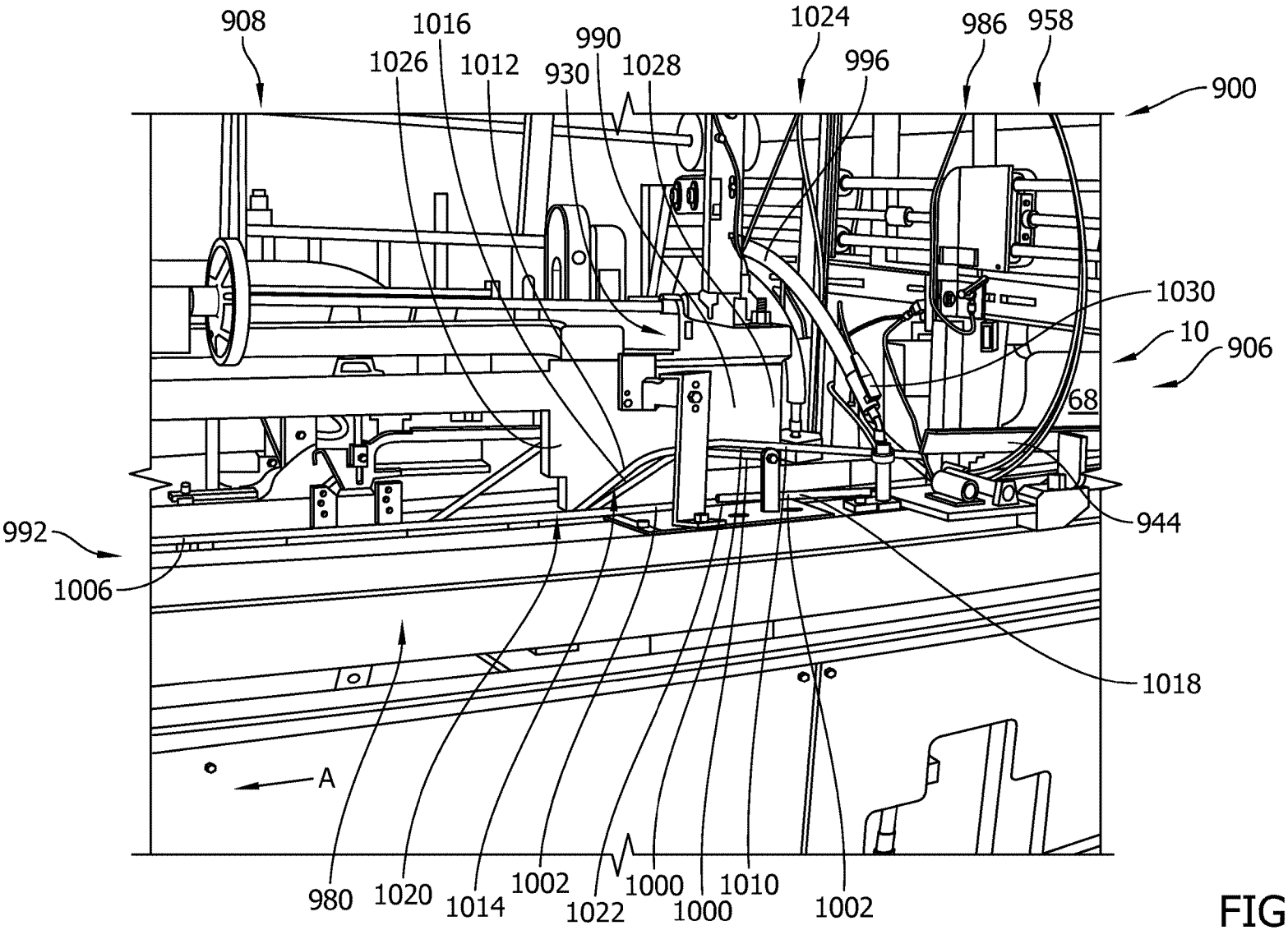
FIG. 28 is a side view of a corner post forming station of the forming station shown in FIGS. 23-27.
Figure 29:
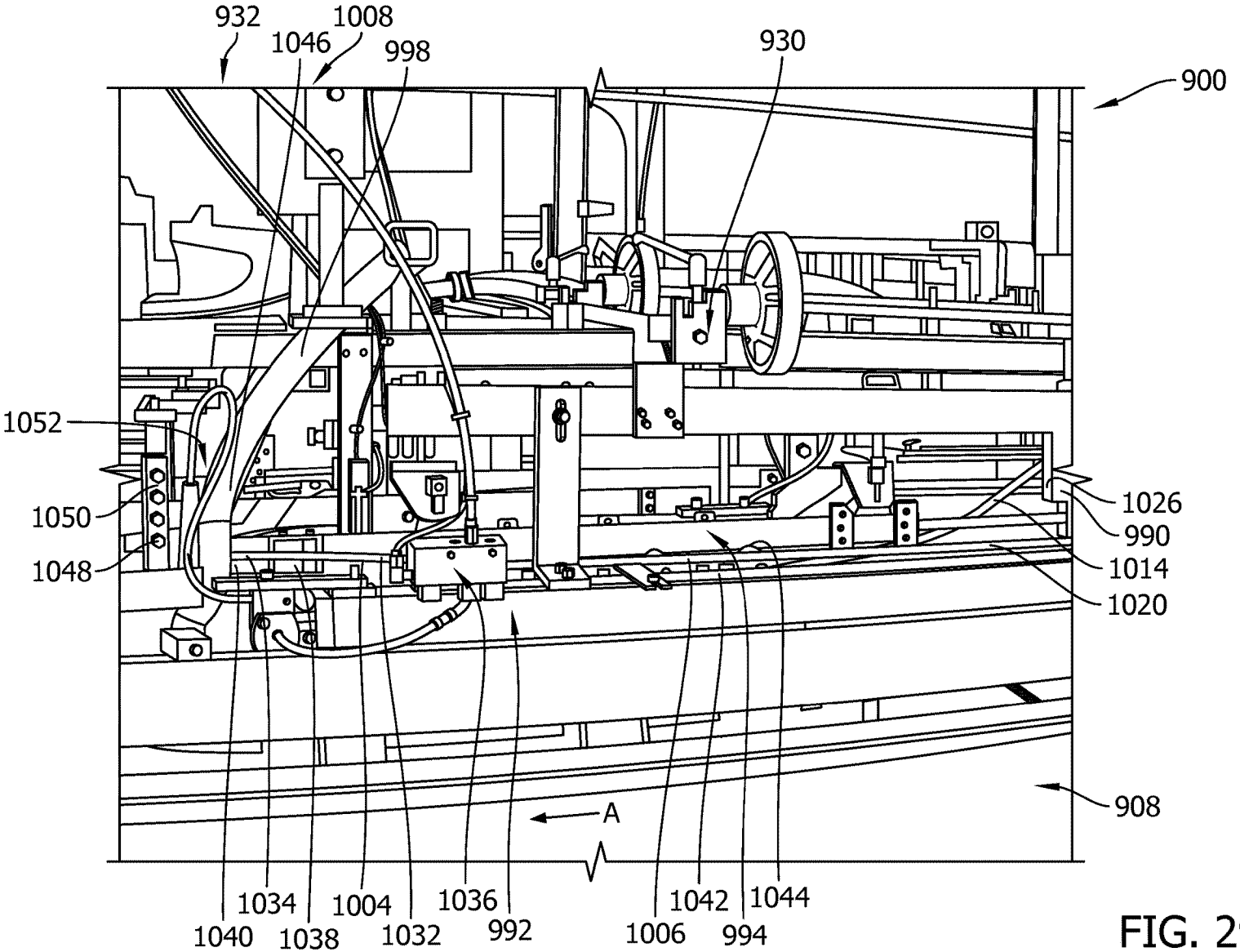
FIG. 29 is a side view of a corner post forming station of the forming station shown in FIGS. 23-28.
Figure 30:
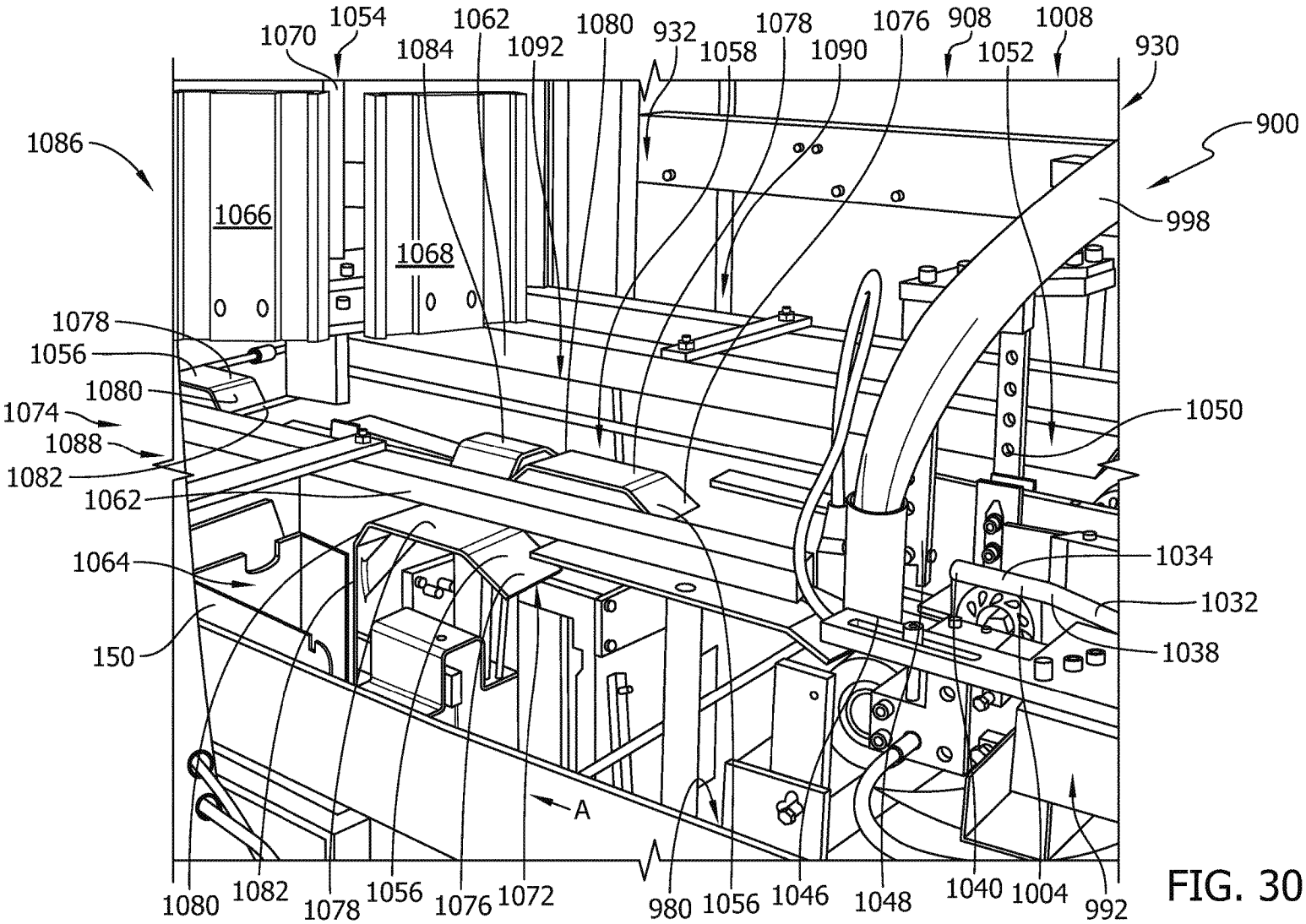
FIG. 30 is a perspective view of a plunger station of the forming station shown in FIGS. 23-29.
Figure 31:
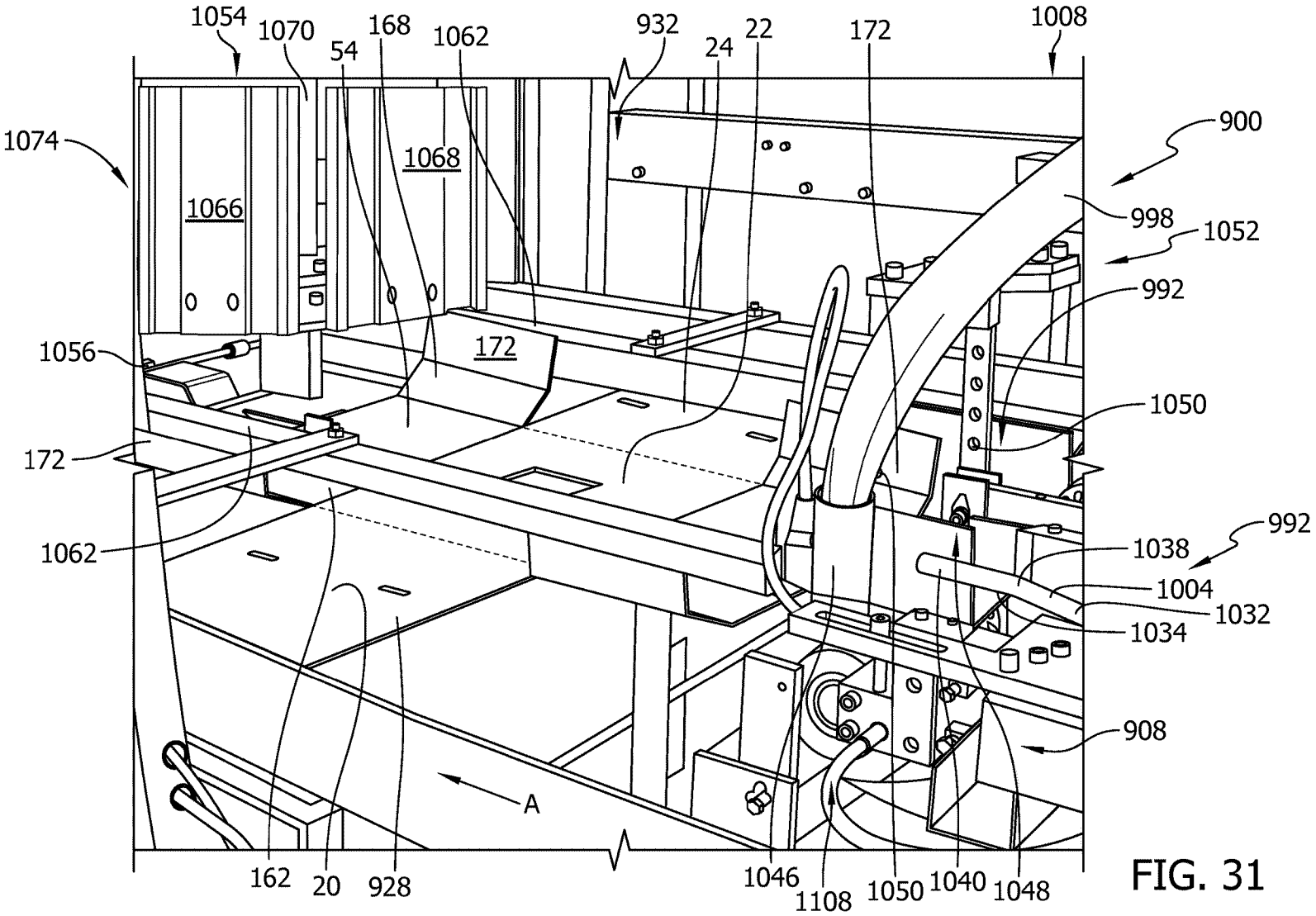
FIG. 31 is a perspective view of the plunger station shown in FIG. 30 having a partially formed container therein.
Figure 32:
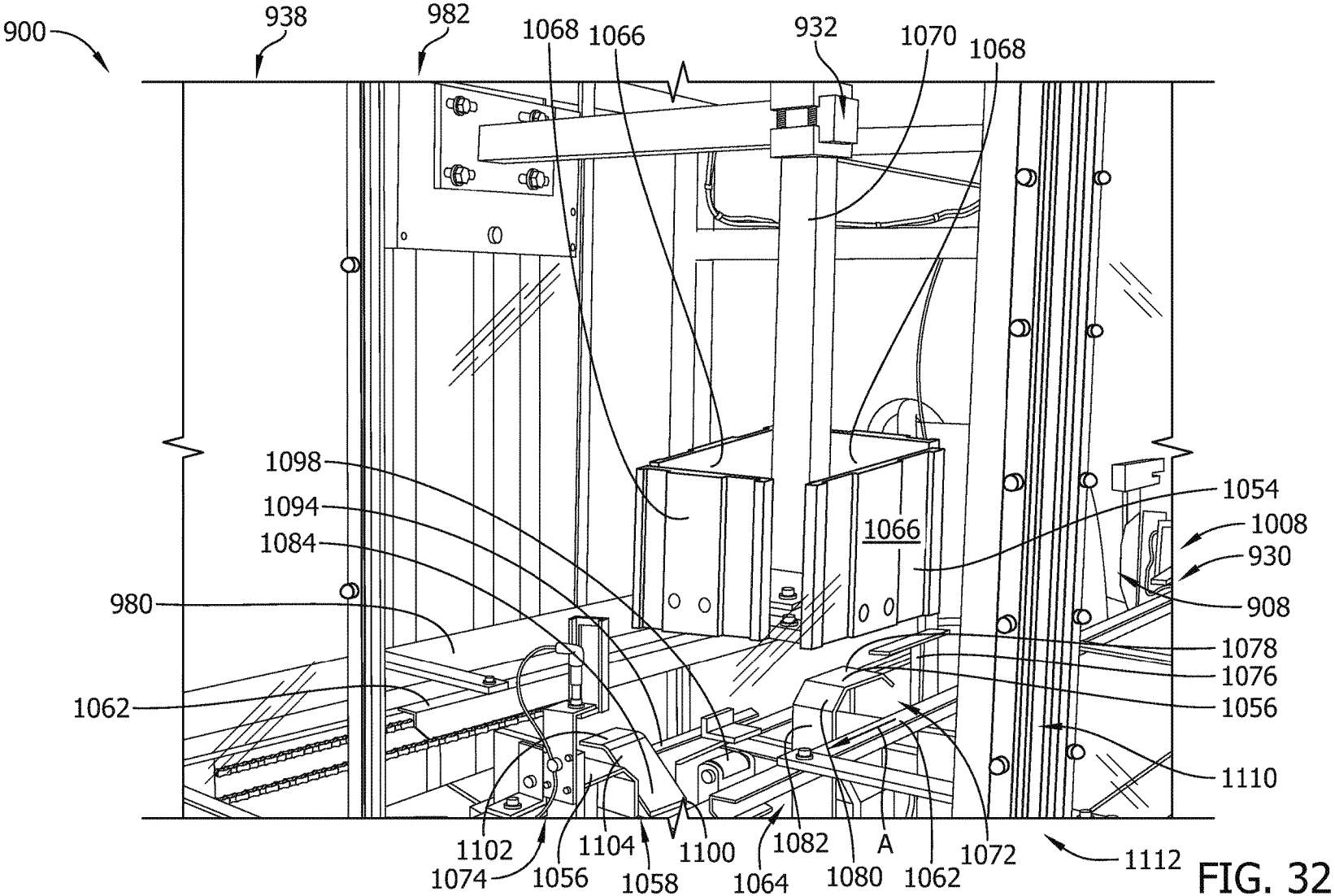
FIG. 32 is a perspective view of the plunger station shown in FIGS. 30 and 31.
Figure 33:
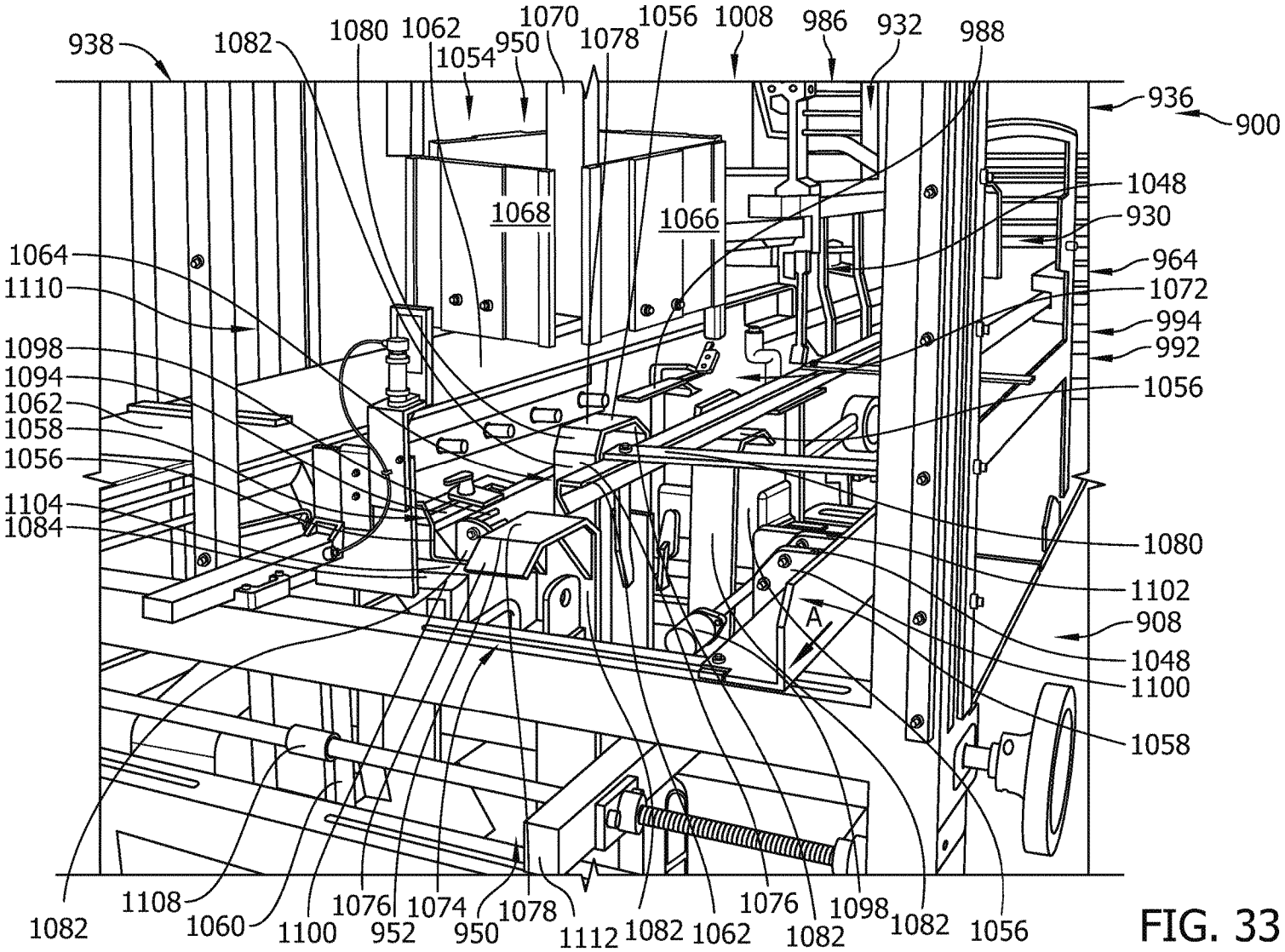
FIG. 33 is a perspective view of the plunger station shown in FIGS. 30-32.
Figure 34:
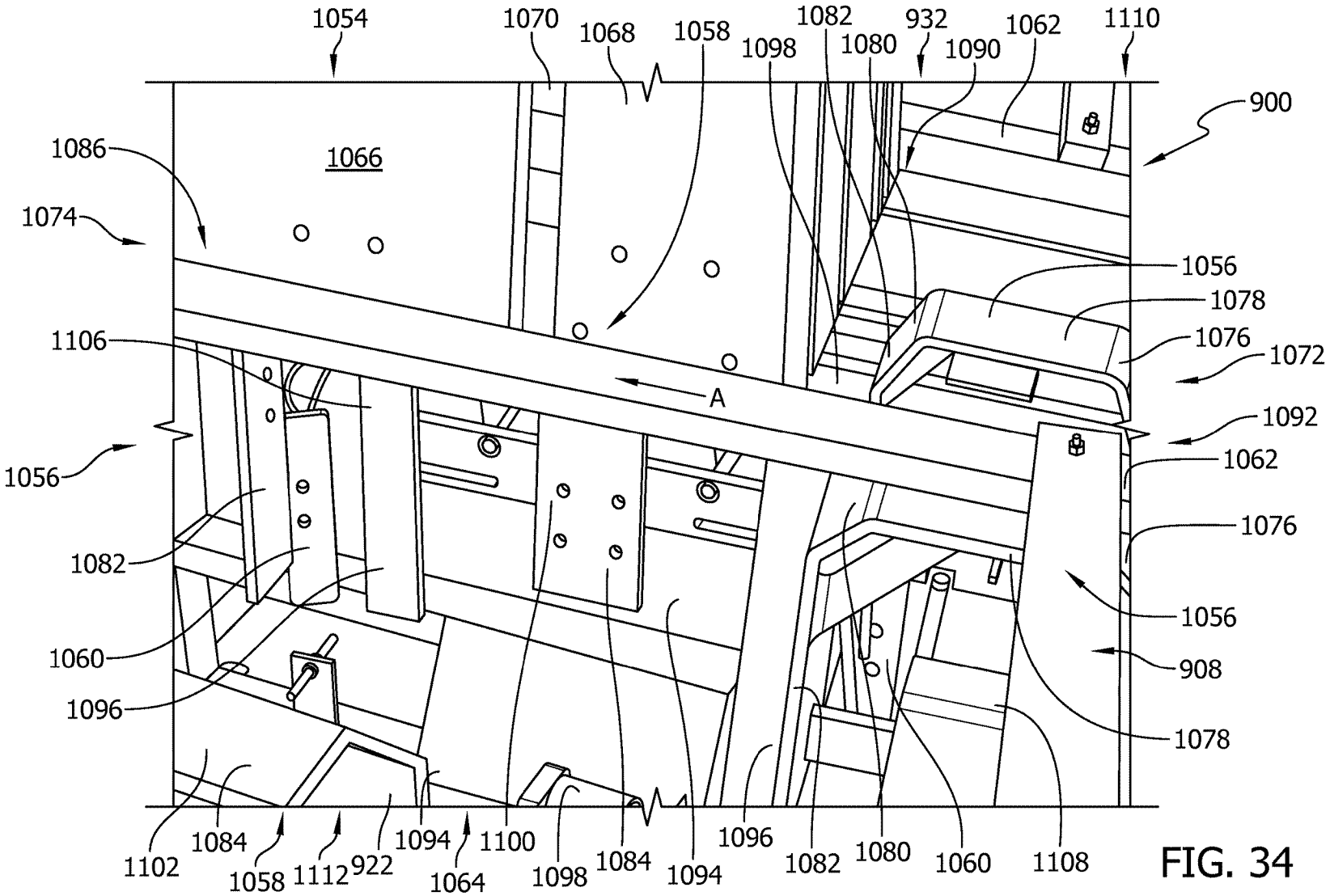
FIG. 34 is a perspective view of the plunger station shown in FIGS. 30-33.
Figure 35:
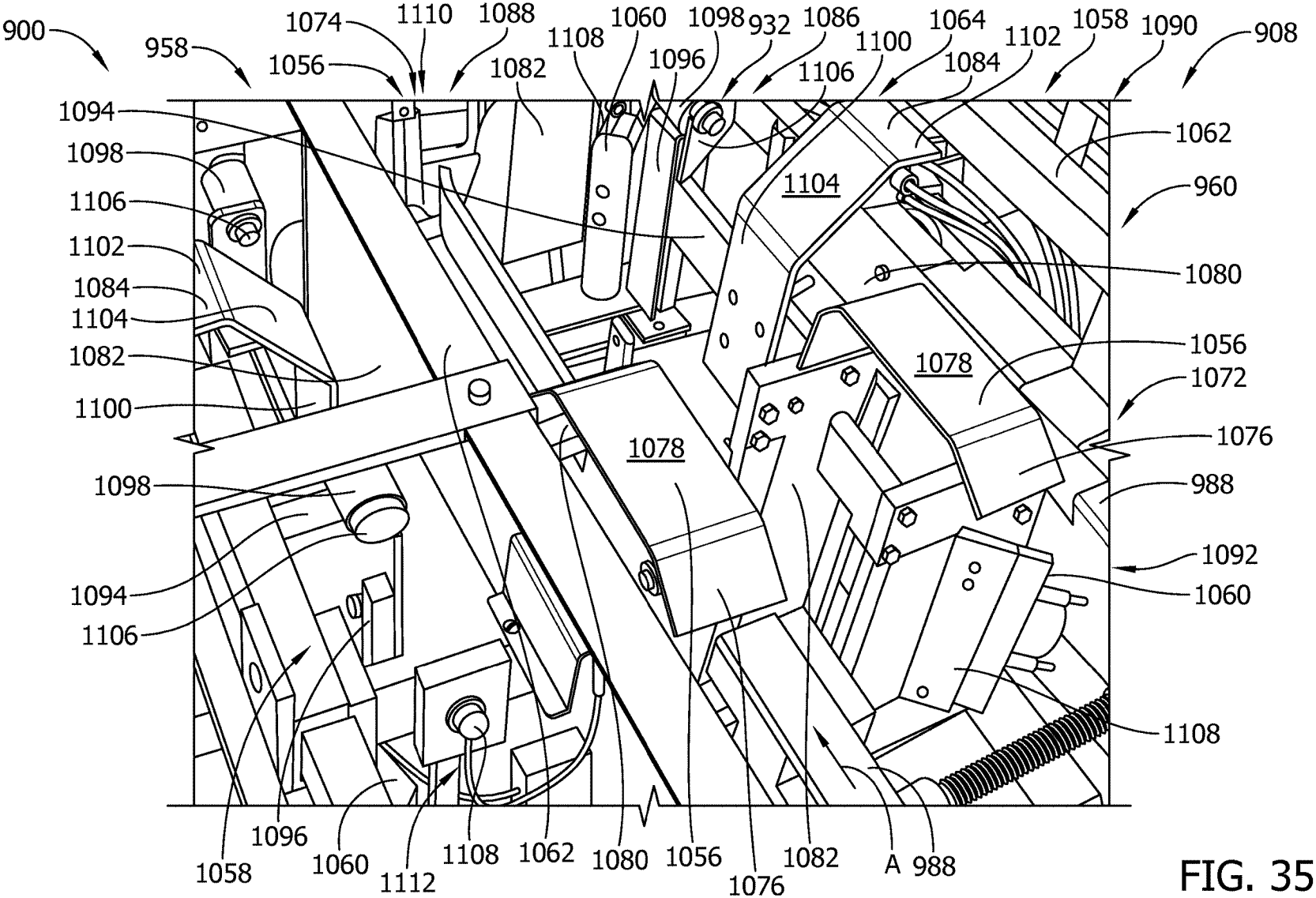
FIG. 35 is a perspective view of the plunger station shown in FIGS. 30-34.
Figure 36:
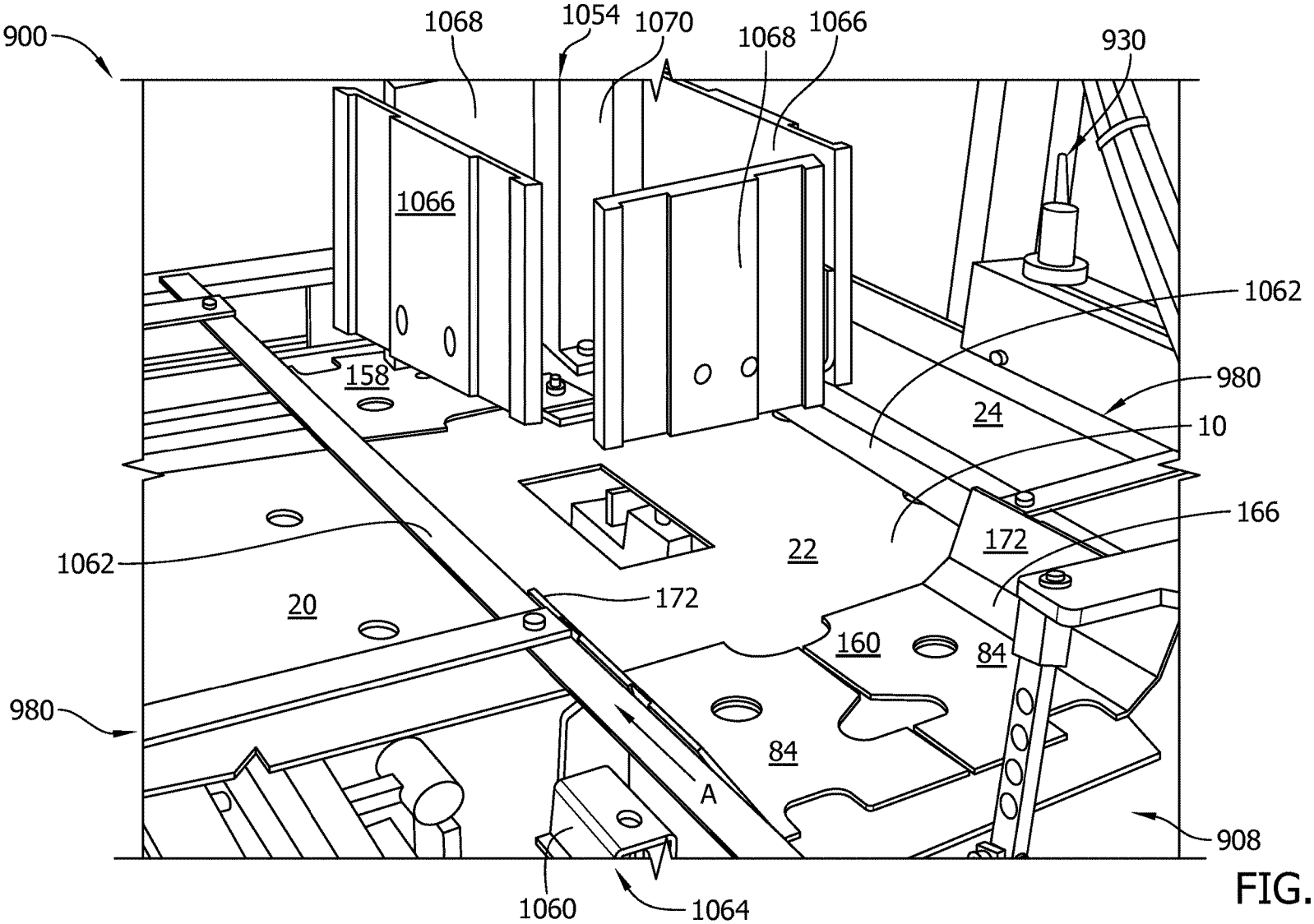
FIG. 36 is a perspective view of the plunger station shown in FIGS. 30-35 having a partially formed container therein.
Figure 37:
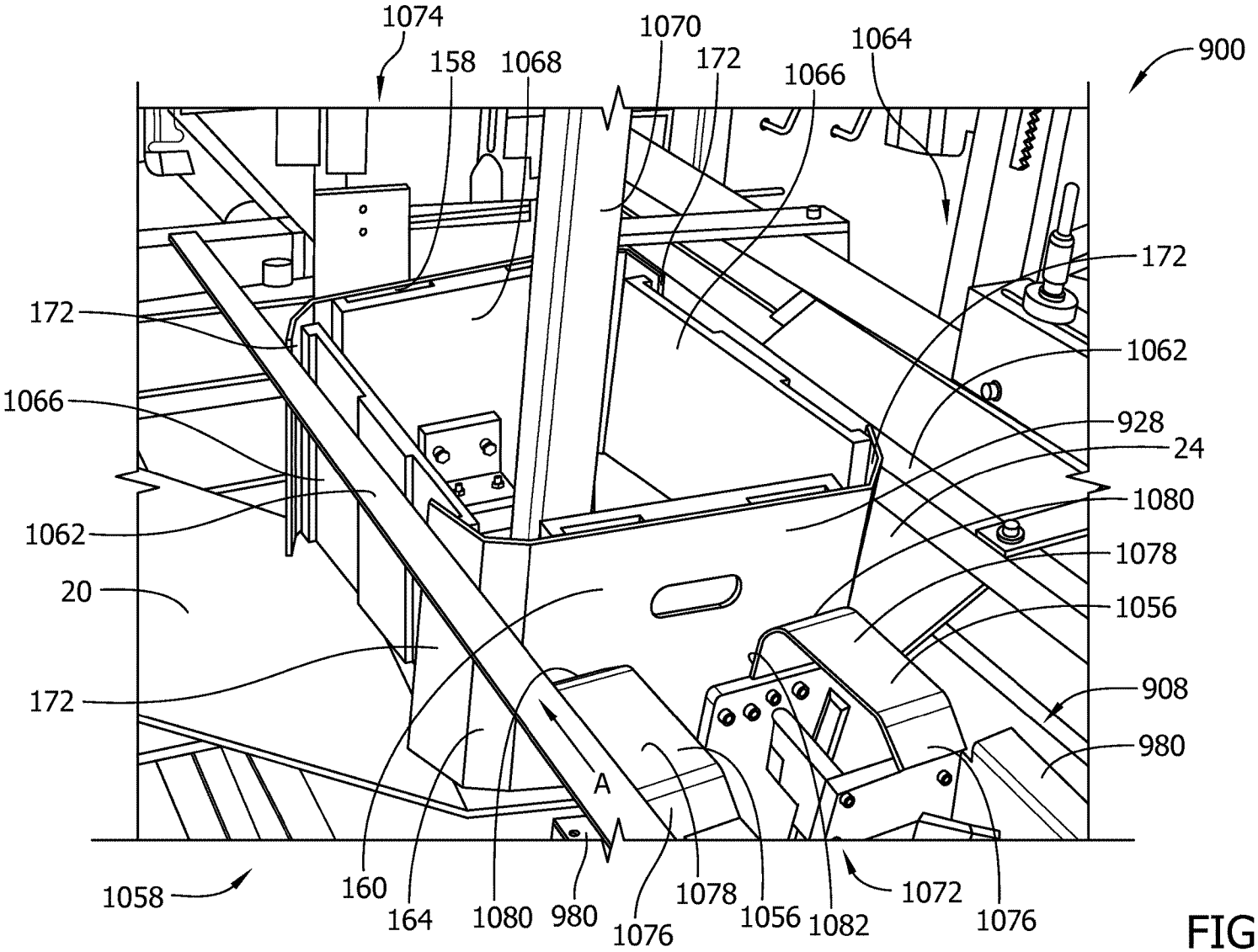
FIG. 37 is a perspective view of a container being formed at the plunger station shown in FIGS. 30-36.
Figure 38:
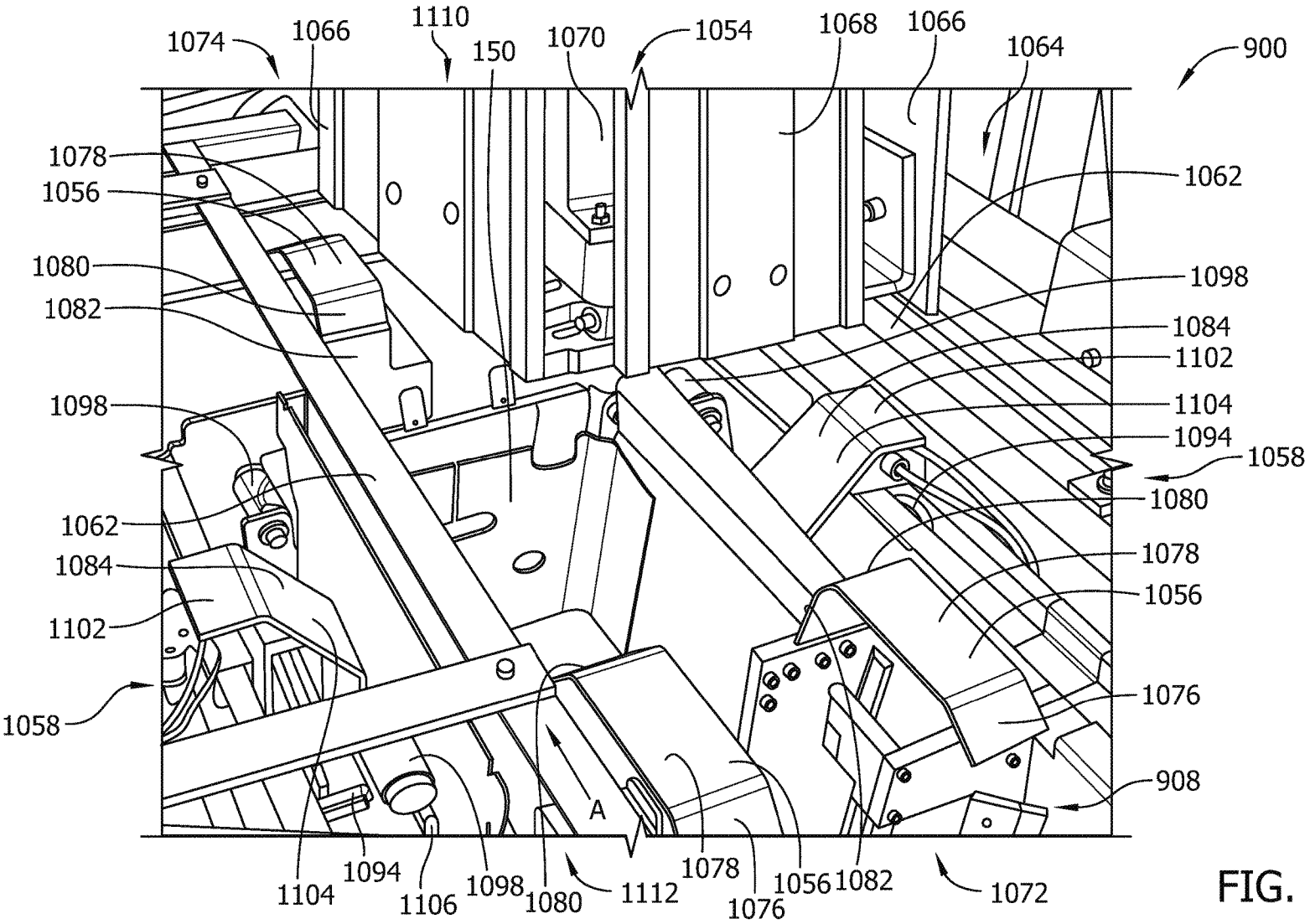
FIG. 38 is a perspective view of a container being formed at the plunger station shown in FIGS. 30-37.

FIGS. 28 and 29 show side views of a corner post forming station 930 of forming station 908. FIG. 30 show a perspective view of a plunger station 932 of forming station 908. FIG. 31 shows a perspective view of plunger station 932 having partially formed container 928 therein. FIGS. 32-35 show perspective views of plunger station 930. FIG. 36 shows a perspective view of plunger station 930 having partially formed container 928 therein. FIGS. 37 and 38 show perspective views of container 150 being formed at plunger station 932.

Figure 39A:
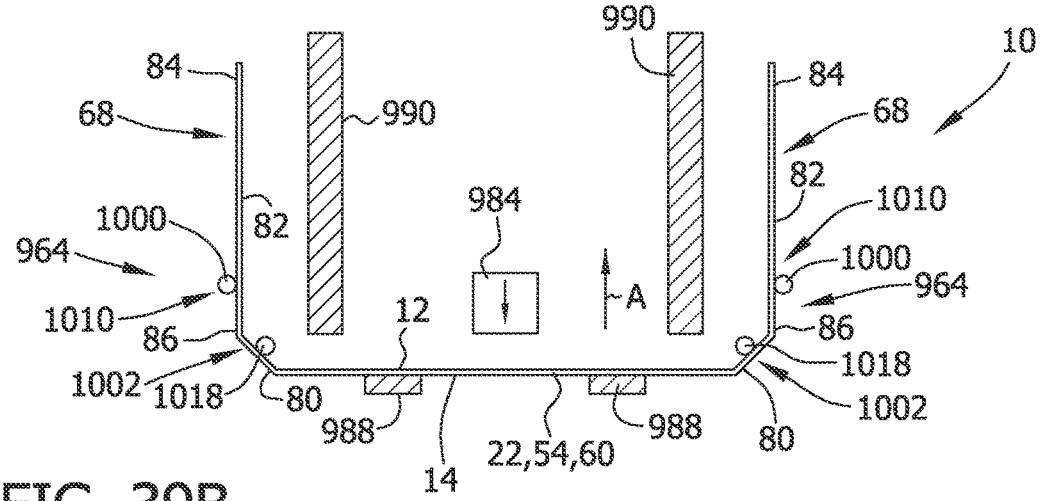
FIGS. 39A, 39B, and 39C are schematic views of a blank being formed into a partially formed container using the machine shown in FIGS. 18-38.
Figure 39B:
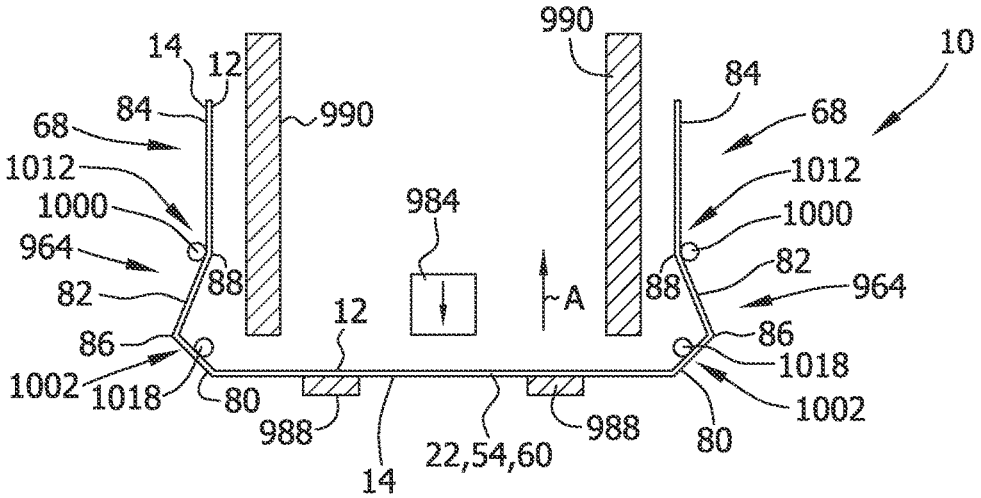
Figure 39C:
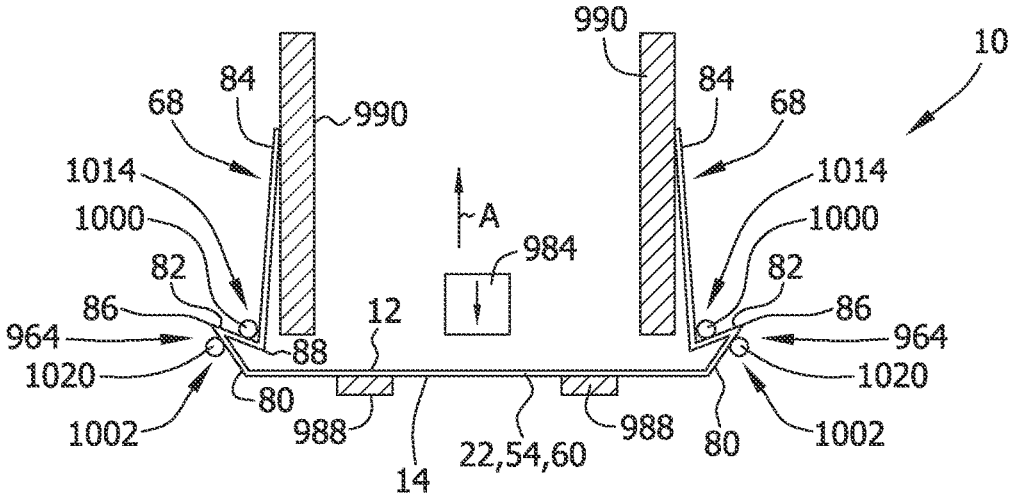
Figure 40:
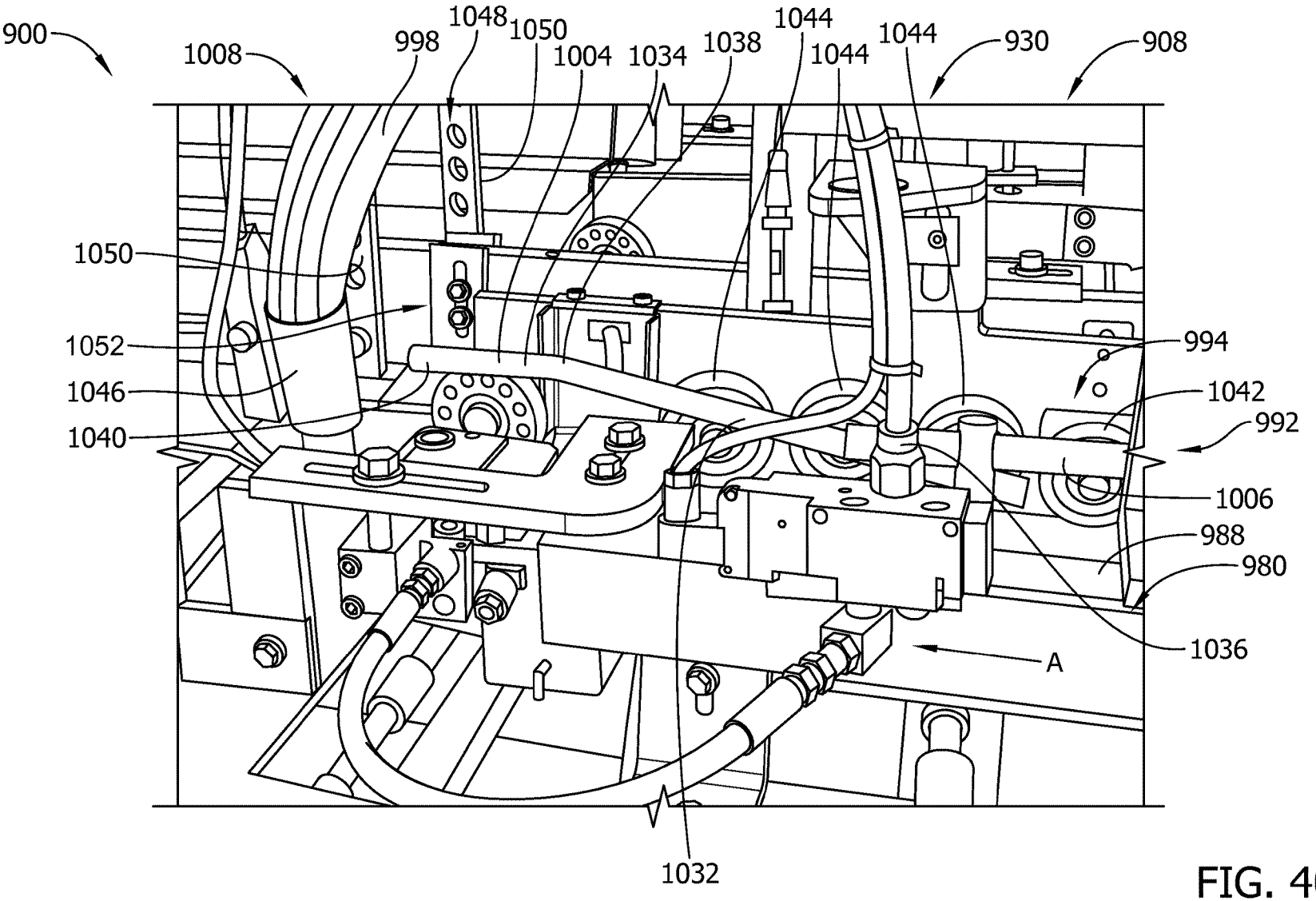
FIG. 40 is a perspective view of a corner post forming station that may be used with the machine shown in FIGS. 18-38.
Figure 41A:
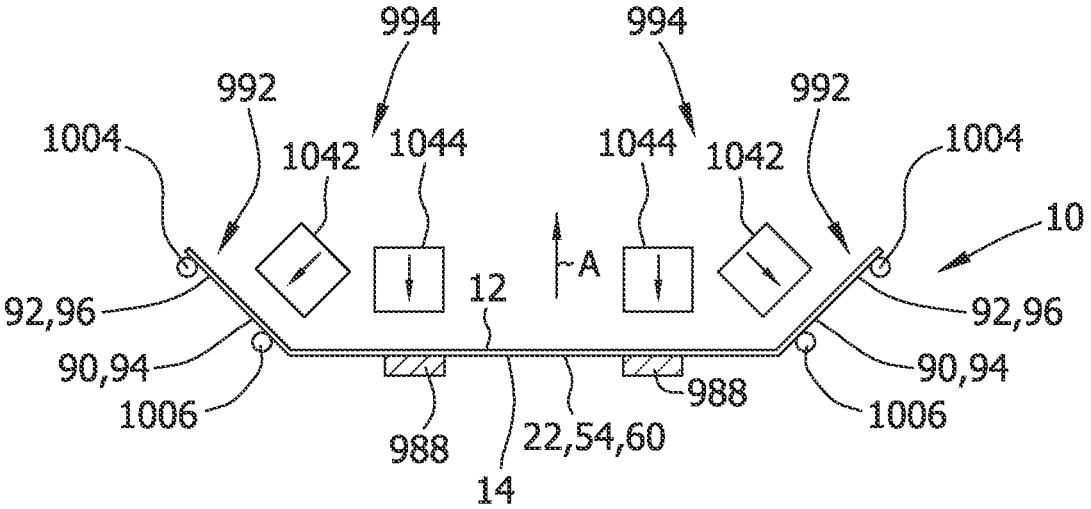
FIGS. 41A and 41B are schematic views of a blank being formed into partially formed container using the machine shown in FIGS. 18-38.
Figure 41B:
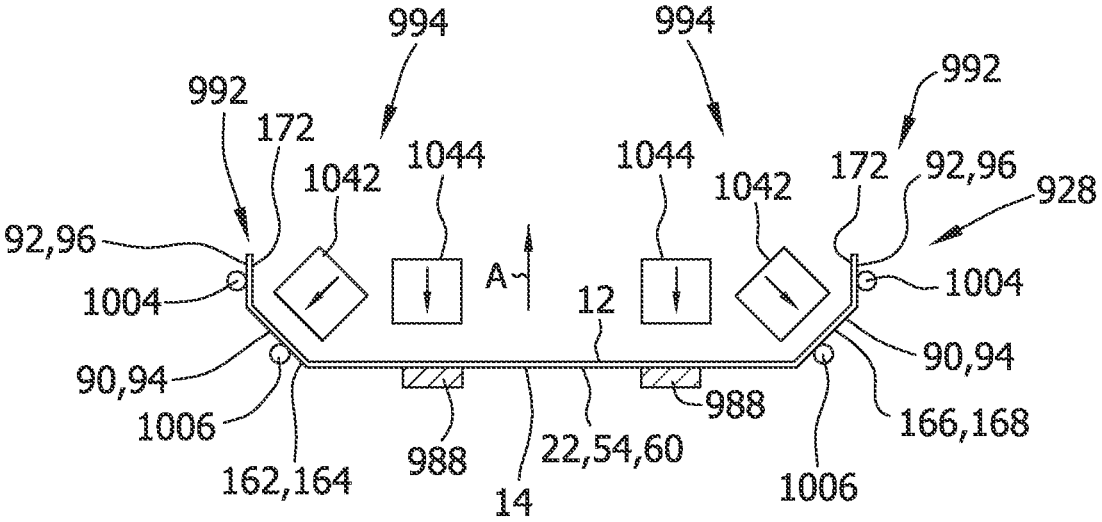

FIGS. 39A, 39B, and 39C show schematic views of blank 10 being formed into partially formed container 928. FIG. 40 shows a perspective view of corner post forming station 930. FIGS. 41A and 41B show schematic views of blank 10 being formed into partially formed container 928.

Referring to FIGS. 1, 2, and 18-38, machine 900 is substantially symmetrical about a longitudinal axis 934 that extends from a rear end 936 of machine 900 to a front end 938 of machine 900. As a blank 10 is formed using machine 900, blank 10 moves along longitudinal axis 934 from rear end 936 to front end 938.

Referring to FIGS. 20-27, hopper station 906 includes a hopper 940, a feed mechanism 942, stationary plows 944, and moving plows 946. Hopper 940 is configured to support stack 914 of blanks 10 above feed mechanism 942 such that exterior surfaces 14 of blanks 10 are facing downward and interior surfaces 12 of blanks 10 are facing upward. Blanks 10 within hopper 940 are in an unformed, substantially planar state. Hopper 940 is further configured to maintain end panels 20 and 24 on the same plane as bottom panel 22 while at least partially rotating reinforcing panels 68 about fold lines 70, 72, 74, and 76 toward respective side panels 54 and 60.

In the exemplary embodiment, hopper 940 includes members that are configured to inhibit downward movement of reinforcing panels 68 as blank 10 is pulled downward, until blank 10 is at a predetermined vertical position within hopper station 906. More specifically, the members apply a restraining force to exterior surface 14 of reinforcing panels 68 as blank 10 is pulled downward. When blank 10 is at the predetermined vertical position, the members no longer contact reinforcing panels 68 and reinforcing panels 68 to apply the restraining force, and reinforcing panels 68 are pulled downward with blank 10. As such, as blank 10 is pulled downward, the members rotate interior surface 12 of reinforcing panels 68 toward interior surface 12 of side panels 54 and 60. The members also support stack 914 of blanks 10 within hopper 940. In an alternative embodiment, hopper 940 does not fold reinforcing panels 68 as blank 10 is pulled downward.

Feed mechanism 942 includes suction cups 948, support bars 950, a vertical actuator 952, and a horizontal actuator 954. Suction cups 948 and support bars 950 are supported on vertical actuator 952, and vertical actuator 952 is supported on horizontal actuator 954. Suction cups 948 are in flow communication with a pump for creating a vacuum in suction cups 948 when the pump is activated. In one embodiment, control system 918 is configured to activate the pump. As an alternative to suction cups 948 and the pump, feed mechanism 942 includes any suitable device(s) for attaching to blank 10 in hopper 940. In the exemplary embodiment, support bars 950 are aligned substantially perpendicularly to longitudinal axis 934, however support bars 950 may have any configuration and/or orientation that enable machine 900 to function as described herein. In the exemplary embodiment, support bars 950 are configured to support bottom panel 22 as bottom panel 22 is pulled downward through hopper station 906 and as blank 10 is moved forward by feed mechanism 942.

Vertical actuator 952 is pneumatically, hydraulically, and/or otherwise driven vertically through hopper station 906. More specifically, vertical actuator 952 moves between a first position adjacent hopper 940 and a second position adjacent forming station 908. The first position is also referred to as a top position, and the second position as a bottom position. Control system 918 is in operational control communication with vertical actuator 952 to activate vertical actuator 952 for movement between the top position and the bottom position. In the exemplary embodiment, horizontal actuator 954 is positioned within a bottom end 916 of hopper station 906 and is configured to move between a first position, also referred to as a rear position, and a second position, also referred as a front position. More specifically, control system 918 is in operational control communication with horizontal actuator 954 to control movement of horizontal actuator 954 between the rear position and the front position. Vertical actuator 952 and horizontal actuator 954 are also considered to be components of transport system 912.

Hopper station 906 further includes stationary plows 944 and moving plows 946 that are each configured to fold reinforcing panels 68 relative to side panels 54 and/or 60 and retain reinforcing panels 68 in position as blank 10 is transferred to forming station 908. More specifically, a pair of stationary plows 944 is positioned adjacent forming station 908 and a pair of moving plows 946 is positioned upstream from stationary plows 944. Stationary plows 944 are positioned substantially symmetrically about longitudinal axis 934, and moving plows 946 are positioned substantially symmetrically about longitudinal axis 934. Stationary plows 944 are positioned at a front 958 of hopper station 906 and extend into forming station 908, and moving plows 946 are positioned at a rear 960 of hopper station 906. In the exemplary embodiment, stationary plows 944 extend from hopper station 906 to a beginning end 962 of a first set of rails 964 within corner post forming station 930 of forming station 908.

Each stationary plow 944 includes an upper surface 966, an inner angled surface 968, and a rear angled surface 970. Upper surface 966 is horizontally oriented and substantially parallel to exterior surface 14 of bottom panel 22. Upper surface 966 is configured to contact exterior surface 14 of reinforcing panels 68 at front 958 of hopper station 906 and rotate front reinforcing panels 68 toward a respective side panel 54 or 60. Inner angled surfaces 968 are configured to contact exterior surface 14 of front reinforcing panels 68 as front reinforcing panels 68 slide off of upper surface 966. Inner angled surfaces 968 extend into forming station 908 and are further configured to maintain reinforcing panels 68 at a first oblique angle to the respective side panel 54 or 60. More specifically, inner angled surfaces 968 maintain front reinforcing panels 68 at the first oblique angle to the respective side panel 54 or 60, and maintain rear reinforcing panels 68 at the first oblique angle to a respective side panel 54 or 60 as blank 10 is moved forward into forming station 908. In one embodiment, the first oblique angle is between about 120° and about 150°. In the exemplary embodiment, the first oblique angle is about 135°. Rear angled surfaces 970 are configured to contact rear reinforcing panels 68 and to direct rear reinforcing panels 68 onto inner angled surface 968 as blank 10 is moved forward through hopper station 906.

Each moving plow 946 includes an upper surface 972, an angled inner surface 974, and a vertical inner surface 976. Upper surface 972 is horizontally oriented and substantially parallel to exterior surface 14 of bottom panel 22. Upper surface 972 is configured to contact exterior surface 14 of reinforcing panels 68 at rear 960 of hopper station 906 and rotate rear reinforcing panels 68 toward a respective side panel 54 or 60. Angled inner surfaces 974 are configured to contact exterior surface 14 of rear reinforcing panels 68 as rear reinforcing panels 68 slide off of upper surface 972. Angled inner surfaces 974 are further configured to maintain rear reinforcing panels 68 at the first oblique angle to the respective side panel 54 or 60. More specifically, angled inner surfaces 974 maintain rear reinforcing panels 68 at the first oblique angle to the respective side panel 54 or 60 as blank 10 is moved forward into forming station 908.

Moving plows 946 are configured to move toward stationary plows 944 during operation of machine 900 to maintain a position of rear reinforcing panels 68. More specifically, each moving plow 946 is coupled to a horizontally oriented actuator rod 978 the moves a respective moving plow from a first position, also referred to as a rear position, to a second position, also referred to as a front position. Control system 918 is in operational control communication with actuator rod 978 for controlling the movement of moving plows 946 between the first position and the second position.

Machine 900 further includes a pair of outer support plates 980 that extend from rear end 960 of hopper station 906 through corner post forming station 920 to a front end 982 of plunger station 932. Outer support plates 980 are substantially symmetrical about longitudinal axis 934 and are configured to support end panels 20 and/or 24 as blank 10 is transported from hopper 906 through forming station 908. At least one roller 984 is positioned substantially on longitudinal axis 934. Roller 984, and/or other suitable conveying device, is positioned between hopper station 906 and forming station 908 to draw blank 10 into forming station 908. In the exemplary embodiment, roller 984 contacts interior surface 12 of blank 10 such that, when roller 984 is rotated, roller 984 forces blank 10 from hopper station 906 into forming station 908. Control system 918 is in operational control communication with roller 984 for control thereof. Roller 984 is also considered to be a component of transport system 908. At a rear end 986 of forming station 908, a pair of center support plates 988 are positioned proximate roller 984 and are substantially symmetrically positioned with respect to longitudinal axis 934. Center plates 988 extend through corner post forming station 908 to support bottom panel 22 as blank 10 is conveyed through corner post forming station 908.

Referring to FIGS. 27-29, forming station 908 includes corner post forming station 930 and plunger station 932. Corner post forming station 930 includes a pair of first rail sets 964, a pair of stop plates 990, a pair of second rail sets 992, a pair of a series of rollers 994, a first adhesive applicator 996, and a second adhesive applicator 998. Although two rail sets 964 and 992 are described herein, it should be understood that machine 900 may include any suitable number of rails, include one rail, and/or any suitable configuration of rails and/or plates that enable corner post forming station 930 to function as described herein.

Each set of first rail set 964 includes an upper rail 1000 and a lower rail 1002 positioned on one side of longitudinal axis 934. First rail sets 964 are positioned substantially symmetrically with respect to longitudinal axis 934. Each second rail set 992 includes an upper rail 1004 and a lower rail 1006 positioned on one side of longitudinal axis 934. Second rail sets 992 are positioned substantially symmetrically with respect to longitudinal axis 934 forward of first rail sets 964. Stop plates 990 are positioned within first rail sets 964 such that one stop plate 990 is adjacent each first rail set 964. Stop plates 990 are positioned substantially symmetrically with respect to longitudinal axis 934. The pair of series of rollers 994 is positioned within second rail sets 992 such that one series of rollers 994 is positioned substantially symmetrically about longitudinal axis 934 the other series of rollers 994. First adhesive applicator 996 is positioned within first rail sets 964 near a rear end 986 of forming station 908. Second adhesive applicator 998 is positioned within second rail sets 992 at a front end 1008 of corner post forming station 930.

Each first rail set 964 extends generally parallel to longitudinal axis 934 and/or to other first rail set 964. First rail set 964 is configured to fold inner reinforcing panels 82 toward outer reinforcing panels 80 and to fold inner side panels 84 about fold lines 88. More specifically, upper rail 1000 is configured to engage exterior surface 14 of inner reinforcing panels 82, and lower rail 1002 is configured to engage interior surface 12 of outer reinforcing panel 80 as blank 10 is transported into corner post forming station 930. In the exemplary embodiment, upper rail 1000 contacts inner reinforcing panel 82 adjacent fold line 88 to apply a force near fold line 88 as blank 10 is transported through first rail set 964. As such, upper rail 1000 is configured to rotate inner reinforcing panel 82 about fold line 86 and inner side panel 84 about fold line 88 to fold exterior surface 14 of inner reinforcing panel 82 toward exterior surface 14 of inner side panel 84. In the exemplary embodiment, upper rail 1000 is an assembly of rails, however, upper rail 1000 may include any number, dimensions, and/or configuration of rails that enables first rail sets 964 to function as described herein.

Referring further to FIGS. 39A-C, upper rail 1000 is contoured to include an upwardly sloping region 1010, an apex 1012, and a downwardly sloping region 1014. Upwardly sloping region 1010 and downwardly sloping region 1014 are angled inward toward longitudinal axis 934 to facilitate folding inner reinforcing panels 82 and inner side panels 84 inwardly toward longitudinal axis 934. Upwardly sloping region 1010 engages reinforcing panel 68 at a front edge thereof and rotates reinforcing panel 68 toward longitudinal axis 934 about fold lines 70, 72, 74, and/or 76. As blank 10 moves past upper rail 1000, upper rail 1000 is positioned adjacent fold line 88 by the upward slope, and reinforcing panel 68 is rotated inward by the inward angle. Apex 1012 is configured to contact fold line 88 to apply the force thereto. Downwardly sloping region 1014 forces fold line 88 downwardly to rotate inner reinforcing panel 82 about fold line 86 and to rotate inner side panel 84 about fold line 88. At a front end 1016 of downwardly sloping region 1014, interior surface 12 of inner reinforcing panel 82 is forced into contact with interior surface 12 of outer reinforcing panel 80 by the downward slope of upper rail 1000. Front end 1016 of downwardly sloping region is also the front end of upper rail 1000.

Referring to FIGS. 27-29 and FIGS. 39A-C, in the exemplary embodiment, lower rail 1002 contacts outer reinforcing panel 80 adjacent fold line 86 to apply a force near fold line 86 as blank 10 is transported through first rail set 964. As such, lower rail 1002 is configured to rotate inner reinforcing panel 82 about fold line 86 and to maintain a position of outer reinforcing panel 80 with respect to side panel 54 or 60 at the first oblique angle. Accordingly, lower rail 1002 folds interior surface 12 of inner reinforcing panel 82 toward interior surface 12 of outer reinforcing panel 80. In the exemplary embodiment, lower rail 1002 is an assembly of rails, however, lower rail 1002 may include any number, dimensions, and/or configuration of rails that enables first rail sets 964 to function as described herein. More specifically, in the exemplary embodiment, lower rail 1002 includes a first rail 1018 and a second rail 1020 in series along longitudinal axis 934. First rail 1018 engages interior surface 12 of outer reinforcing panel 80 and is substantially parallel to longitudinal axis 934. First rail 1018 extends from rear end 986 of forming station 908 to about apex 1012 of upper rail 1000. Second rail 1020 is positioned a distance from a front end 1022 of first rail 1018 and extends into second rail set 992, becoming lower rail 1006 of second rail set 992. Second rail 1020 engages exterior surface 14 of outer reinforcing panel 80 and, more particularly, corner panel 90, to maintain the first oblique angle between corner panel 90 and a respective side panel 54 or 60 as blank 10 is transported through corner post forming station 930.

Stop plates 990 are substantially vertically oriented and extend from a rear end 1024 of corner post forming station 930 to front end 1016 of upper rail 1004. Stop plate 990 is configured to contact interior surface 12 of inner side panel 84 when upper rail 1000 rotates reinforcing panel 68 inward toward longitudinal axis 934. When stop plate 990 engages inner side panel 84, stop plate 990 applies a force to interior surface 12 of inner side panel 84 to facilitate rotating inner side panel 84 about fold line 88 toward inner reinforcing panel 82. At front ends 1026 of stop plates 990, inner side panels 84 are allowed to continue rotating toward side panels 54 and/or 60 to enable contact of interior surface 12 of inner side panel 84 with interior surface 12 of a respective side panel 54 or 60, as described in more detail below. As such, side walls 158 and 160 are formed after blank 10 passes through first rail sets 964.

Referring to FIGS. 27 and 28, first adhesive applicator 996 is configured to apply an adhesive, such as glue, to side panels 54 and 60 as blank 10 is transported through corner post forming station 930. Activation of first adhesive applicator 996 is controlled by control system 918. In the exemplary embodiment, first adhesive applicator 996 is positioned proximate rear ends 1028 of stop plates 990, within first rail sets 964. Further, first adhesive applicator 996 includes a pair of glue nozzles 1030 positioned substantially symmetrically about longitudinal axis 934. Alternatively, first adhesive applicator 996 includes any suitable device(s) for applying glue and/or any other suitable adhesive material to side panels 54 and 60.

Referring to FIGS. 29-31 and 40, in the exemplary embodiment, each second rail set 992 extends generally parallel to longitudinal axis 934 and/or to other second rail set 992. Second rail set 992 is configured to fold first and second reinforcing end panels 92 and 96 toward corner panels 90 and 94 about fold lines 102 and 104. More specifically, upper rail 1004 is configured to engage exterior surface 14 of first reinforcing end panel 92, and lower rail 1006 is configured to engage exterior surface 14 of corner panel 90 as blank 10 is transported into second rail sets 992. In the exemplary embodiment, upper rail 1004 contacts first reinforcing end panel 92 to apply a force to first and second reinforcing end panels 92 and 96. As such, upper rail 1004 is configured to rotate reinforcing end panels 92 and 96 about fold lines 102 and 104 such that exterior surface 14 of second reinforcing end panel 96 is rotated toward exterior surface 14 of reinforcing corner panel 94. Upper rail 1004 is configured to rotate reinforcing end panels 92 and 96 to be a second oblique angle to corner panels 90 and 94. In one embodiment, the second oblique angle is between about 120° and about 150°. In the exemplary embodiment, the second oblique angle is about 135°. In the exemplary embodiment, upper rail 1004 is a single rail, however, upper rail 1004 may include any number, dimensions, and/or configuration of rails that enables second rail sets 992 to function as described herein.

Referring further to FIGS. 40, 41A, and 41B, lower rails 1006 are extensions of second lower rails 1020 of first rail sets 964. Lower rail 1006 is substantially parallel to longitudinal axis 934. Lower rail 1006 is configured to contact corner panel 90 to apply a force to exterior surface 14 of corner panel 90 as blank 10 is transported through second rail set 992. As such, lower rail 1006 is configured to maintain a position of corner panel 90 with respect to side panel 54 or 60 at the first oblique angle. In the exemplary embodiment, lower rail 1006 is a single rail, however, lower rail 1006 may include any number, dimensions, and/or configuration of rails that enables second rail sets 992 to function as described herein.

Upper rail 1004 is contoured to include an inwardly angled region 1032 and a linear region 1034. Angled region 1032 extends from a front end 1036 lower rail 1006 to front end 1008 of corner post forming station 930. Angled region 1032 is angled inward toward longitudinal axis 934 to facilitate folding reinforcing end panels 92 and 96. Linear region 1034 extends from a front end 1038 of inwardly angled portion 1032 to a front end 1040 of upper rail 1004. Linear region 1034 is substantially parallel to longitudinal axis 934. Inwardly angled region 1032 and linear region 1034 are configured to form corner walls 162, 164, 166, and 168 and end reinforcing tabs 172 (shown in FIG. 2) by folding reinforcing end panels 92 and 96 with respect to corner panels 90 and 94 such that reinforcing end panels 92 and 96 are at the second oblique angle with respect to corner panels 90 and 94. End reinforcing tabs 172 each include a first reinforcing end panel 92 and a second reinforcing end panel 96. Exterior surface 14 of first reinforcing panel 92 is an exterior surface of end reinforcing tab 172. In the exemplary embodiment, lower rail 1006 engages exterior surface 14 of outer reinforcing panel 80, then upper rail 1004 engages exterior surface 14 of first reinforcing end panel 92 after reinforcing panel 68 passes lower rail 1006.

Each series of rollers 994 is position adjacent a respective second rail set and includes angled rollers 1042 and vertical rollers 1044. Control system 918 is in operational control communication with angled rollers 1042 and vertical rollers 1044 for control thereof. Angled rollers 1042 and vertical rollers 1044 are also considered to be a component of transport system 912. In one embodiment, roller 984 and series of rollers 994 are spaced apart along longitudinal axis 934 such that series of rollers 994 contacts a forward end of blank 10 before a rear end of blank 10 passes roller 984. As such, roller 984 and series of rollers 994 function in concert to transport blank 10 through corner post forming station 930. In the exemplary embodiment, angled rollers 1042 and vertical rollers 1044 alternate along longitudinal axis 934 of machine 900 for at least a portion of series of rollers 994 such that each angled roller 1042 is adjacent at least one vertical roller 1044.

Each vertical roller 1044 is substantially perpendicular to longitudinal axis 934 and is configured to contact side walls 158 and 160 and bottom panel 22 and blank 10 is transported through corner post forming station 930. In one embodiment, vertical rollers 1044 are configured to press inner side panels 84 to side panels 54 and/or 60 to secure inner side panels 84 to a respective side panel 54 or 60. Each angled roller 1042 is at a predetermined angle to vertical rollers 1044 to maintain the first oblique angle between corner panels 90 and 94 and a respective side panel 54 or 60 as blank 10 is transported through second rail sets 992. More specifically, angled rollers 1042 are configured to contact exterior surface 14 of reinforcing corner panels 94. Together, angled rollers 1042 and lower rail 1006 press interior surface 12 of reinforcing corner panel 94 into contact with interior surface 12 of corner panel 90.

After passing though second rail sets 992, blank 10 is formed into partially formed container 928. Partially formed container 928 includes side walls 158 and 160, corner walls 162, 164, 166, and 168, and end reinforcing tabs 172. End walls 154 and 156 are unformed in the partially formed state.

Second adhesive applicator 998 is configured to apply an adhesive, such as glue, to first reinforcing end panels 92 as blank 10 is transported through corner post forming station 930. When blank 200, 400, 600, and/or 800 is formed using machine 900, second adhesive applicator 998 applies adhesive to interior surface 12 of outer reinforcing corner panels 202, 204, 206, and/or 208 and/or exterior surface 14 of corner panels 90. Activation of second adhesive applicator 998 is controlled by control system 918. In the exemplary embodiment, second adhesive applicator 998 is positioned proximate front ends 1040 of upper rails 1004, outward from upper rail 1004. Further, second adhesive applicator 998 includes a pair of glue nozzles 1046 positioned substantially symmetrically about longitudinal axis 934. Alternatively, second adhesive applicator 998 includes any suitable device(s) for applying glue and/or any other suitable adhesive material to first reinforcing end panels 92.

Referring to FIGS. 30 and 31, a pusher arm 1048 is positioned between corner post forming station 930 and plunger station 932. In the exemplary embodiment, pusher arm 1048 includes a pair of vertically-oriented bars 1050 and a horizontal actuator 1052. Horizontal actuator 1052 is configured to move bars 1050 between a first position, also referred to as rear position, and a second position, also referred to as a forward position. Control system 918 is in operational control communication with pusher arm 1048 to control horizontal actuator 1052. Bars 1050 are configured to engage a rear edge of partially formed container 928 as partially formed container 928 is ejected from corner post forming station 930. When bars 1050 engage the rear edge, pusher arm 1048 transfers partially formed container 928 from corner post forming station 930 into plunger station 932. Pusher arm 1048 is a component of transport system 912.

Referring to FIGS. 30-38, in the exemplary embodiment, plunger station 932 includes a plunger 1054, two pairs of side panel plows 1056, a pair of end panel plow assemblies 1058, a plurality of corner pushers 1060, and a pair of guide rails 1062. Side panel plows 1056 and end panel plow assemblies 1058 define a plunger opening 1064 that extends between top ends of side panel plows 1056 and end panel plow assemblies 1058 and exit conveyor 922. More specifically, plunger 1054 has a shape that corresponds to a cross sectional shape of container 150. In the exemplary embodiment, plunger 1054 corresponds to end walls 154 and 156 and side walls 158 and 160 of container 150. Plunger 1054 is open at corner walls 162, 164, 166, and 168. Alternatively, plunger 1054 may also include walls at corner walls 162, 164, 166, and/or 168.

In the exemplary embodiment, plunger 1054 includes at least four upright plates 1066 and 1068 coupled to a vertical actuator 1070. More specifically, end wall upright plates 1066 extend substantially parallel to longitudinal axis 934 and are oriented substantially vertically, and side wall upright plates 1068 are substantially perpendicular to end wall upright plates 1066 and longitudinal axis 934 and are oriented substantially vertically. Upright plates 1066 and 1068 are configured to prevent over-rotation of end panels 20 and 24 and side panels 54 and 60 into cavity 170 (shown in FIG. 2) of container 150. Vertical actuator 1070 is configured to move plunger 1054 between a first position, also referred to as a top position, and a second position, also referred to as a bottom position. Control system 918 is in operational control communication with vertical actuator 1070 for controlling movement of plunger 1054 between the first position and the second position.

Plunger station 932 includes a rear pair 1072 of side panel plows 1056 and a front pair 1074 of side panel plows 1056. Each side panel plow 1056 is stationary with respect to machine 900 and is configured to rotate a side panel 54 or 60 toward bottom panel 22. More specifically, front pair 1074 is configured to fold a front side panel 54 or 60, and rear pair 1072 is configured to fold a rear side panel 54 or 60. Each side panel plow 1056 includes an angled outer surface 1076, a top surface 1078, an angled inner surface 1080, and a vertical plate 1082. As used with respect to side panel plows 1056 and end panel plows 1084, the term "inner" refers to a direction toward plunger opening 1064, and the term "outer" refers to a direction away from plunger opening 1064. In the exemplary embodiment, top surface 1078 is substantially parallel to longitudinal axis 934 and extends between angled outer surface 1076 and angled inner surface 1080. Vertical plate 1082 extends into plunger opening 1064 to at least partially define plunger opening 1064. For front pair 1074 of side panel plows 1056, angled outer surface 1076 is at an upstream end 1086 of front pair 1074, and angled inner surface 1080 and vertical plate 1082 are at a downstream end 1088 of front pair 1074. For rear pair 1072 of side panel plows 1056, angled outer surface 1076 is at a downstream end 1090 of rear pair 1072, and angled inner surface 1080 and vertical plate 1082 are at an upstream end 1092 of rear pair 1072.

Each end panel plow assembly 1058 includes a frame 1094 having an end panel plow 1084, a pair of glue plates 1096, and a pair of glue rollers 1098 coupled thereto. Frame 1094 is configured to rotate inward toward plunger opening 1064 and outward away from plunger opening 1064. As such, frame 1094 moves between a first position, also referred to as an outer position, and a second position, also referred to as an inner position. Control system 918 is in operational control communication with each end panel plow assembly 1084 for control of frame 1094 between the first position and the second position. In the exemplary embodiment, a sensor determines when partially formed container 928 is positioned over plunger opening 1064. End plow assemblies 1058 are moved to the second position when the sensor determines partially formed blank 928 is positioned over and/or within plunger opening 1064. End panel plow 1084 is positioned between glue plates 1096 such that a vertical inner wall 1100 of end panel plow 1084 is located between glue plates 1096. Although only one end panel plow 1084 is described as being coupled to each frame 1094, it should be understood that any suitable number of end panel plows 1084 may be coupled to end panel plow assembly 1058.

In the exemplary embodiment, each end panel plow 1058 includes a substantially horizontal upper surface 1102, an angled inner surface 1104, and a substantially vertical inner wall 1100. Angled inner surfaces 1104 are configured to rotate end panels 20 and/or 24 inward toward plunger opening 1064 and/or plunger 1054. Vertical inner walls 1100 at least partially define plunger opening 1064. Glue plates 1096 are each substantially vertically aligned and co-planar with vertical inner wall 1100. As such, glue plates 1096 also at least partially define plunger opening 1064. At a top end 1106 of each glue plate 1096, a glue roller 1098 is coupled to frame 1094. Glue roller 1098 and a respective glue plate 1096 press an end panel 20 or 24 into contact with adjacent reinforcing end tabs 172.

A corner pusher 1060 is positioned between a glue plate 1096 and an adjacent side wall plow vertical plate 1082. Each corner pusher 1060 is coupled to a horizontal actuator 1108 that moves a corner pusher 1060 between a first position, also referred to as an outer position, and a second position, also referred to as an inner position. As such, horizontal actuator 1108 moves corner pusher 1060 toward and away from plunger opening 1064. Control system 918 is in operational control communication with each horizontal actuator 1108 for controlling corner pushers 1060. In the exemplary embodiment, a sensor determines when partially formed container 928 is positioned over plunger opening 1064, and corner pushers 1060 are moved to the second position when the sensor determines partially formed container 928 is positioned over and/or within plunger opening 1064.

Each guide rail 1062 extends from front end 1008 of corner post forming station 930 to front end 982 of plunger station 932. Guide rails 1062 are substantially parallel to longitudinal axis 934. Guide rails 1062 are at a top end 1110 of plunger opening 1064 and adjacent to a respective end panel plow assembly 1058. Guide rails 1062 are configured to maintain the positions of reinforcing end panels 92 and 96 and corner panels 90 and 94 as partially formed container 928 is positioned over plunger opening 1064 and pushed downward into plunger opening 1064. More specifically, reinforcing end panels 92 and 96 and corner panels 90 and 94 are maintained at the first oblique angle and at the second oblique angle by guide rails 1062.

Exit conveyor 922 extends through a bottom 1112 of plunger station 932 to receive containers 150 from forming station 908. More specifically, exit conveyor 922 continuously runs while machine 900 is being operated to form containers 150. Alternatively, exit conveyor 922 is operated intermittently when a container 150 is positioned within bottom 1112 of plunger station 932. In the exemplary embodiment, container 150 is secured within plunger opening 1064 by end panel plow assemblies 1058 and/or corner pushers 1060 over exit conveyor 922. As such, when end panel plow assemblies 1058 are rotated to outer position and/or corner pushers 1060 are moved to outer positioned, container 150 is released from plunger opening 1064 onto exit conveyor 922. Control system 918 is in operational control communication with exit conveyor 922 for control thereof. When blank 300 and/or 400 is formed using machine, top panels 302 and 304 remain unfolded with respect to a respective end panel 20 or 24, and container 350 and/or 450 is ejected from machine 900 in the open configuration. Similarly, when blank 500, 600 is formed using machine, top panels 502 and 504 remain unfolded with respect to a respective side panel 54 or 60, and container 550 and/or 650 is ejected from machine 900 in the open configuration.

Figure 42A:
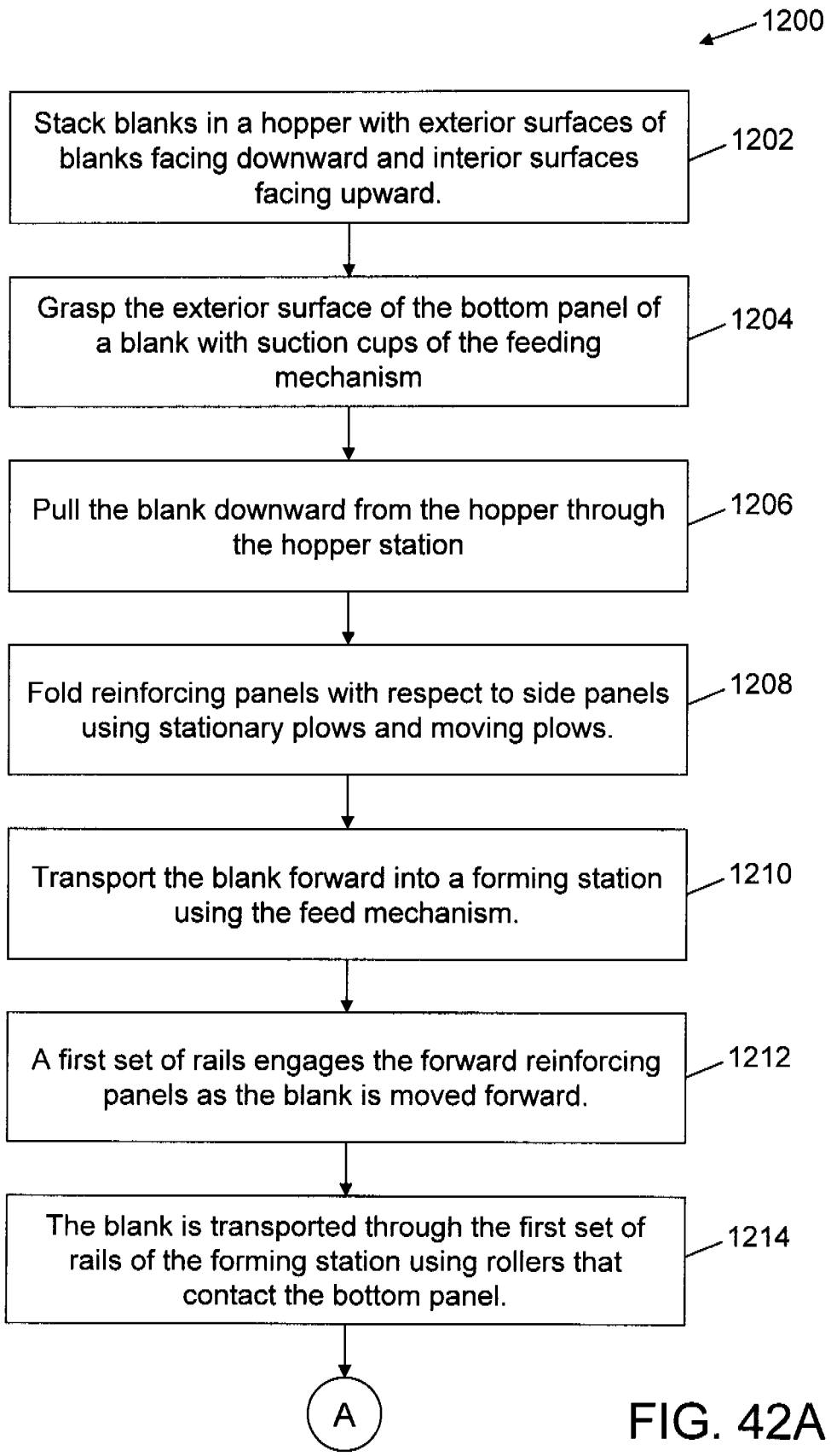
FIGS. 42A, 42B, and 42C are a flowchart of a method for forming a container that may be used with the machine shown in FIGS. 18-38.
Figure 42B:
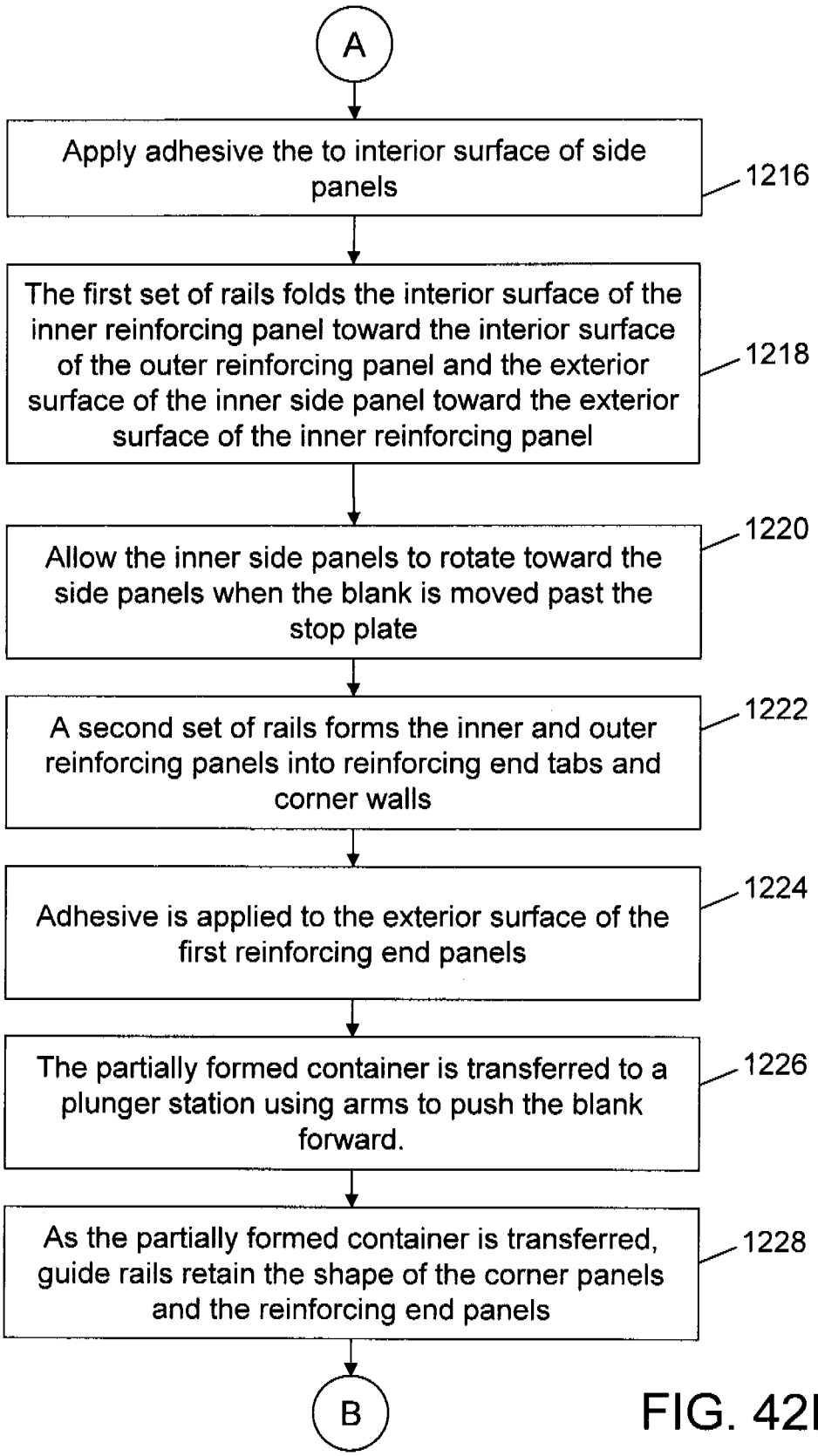
Figure 42C:
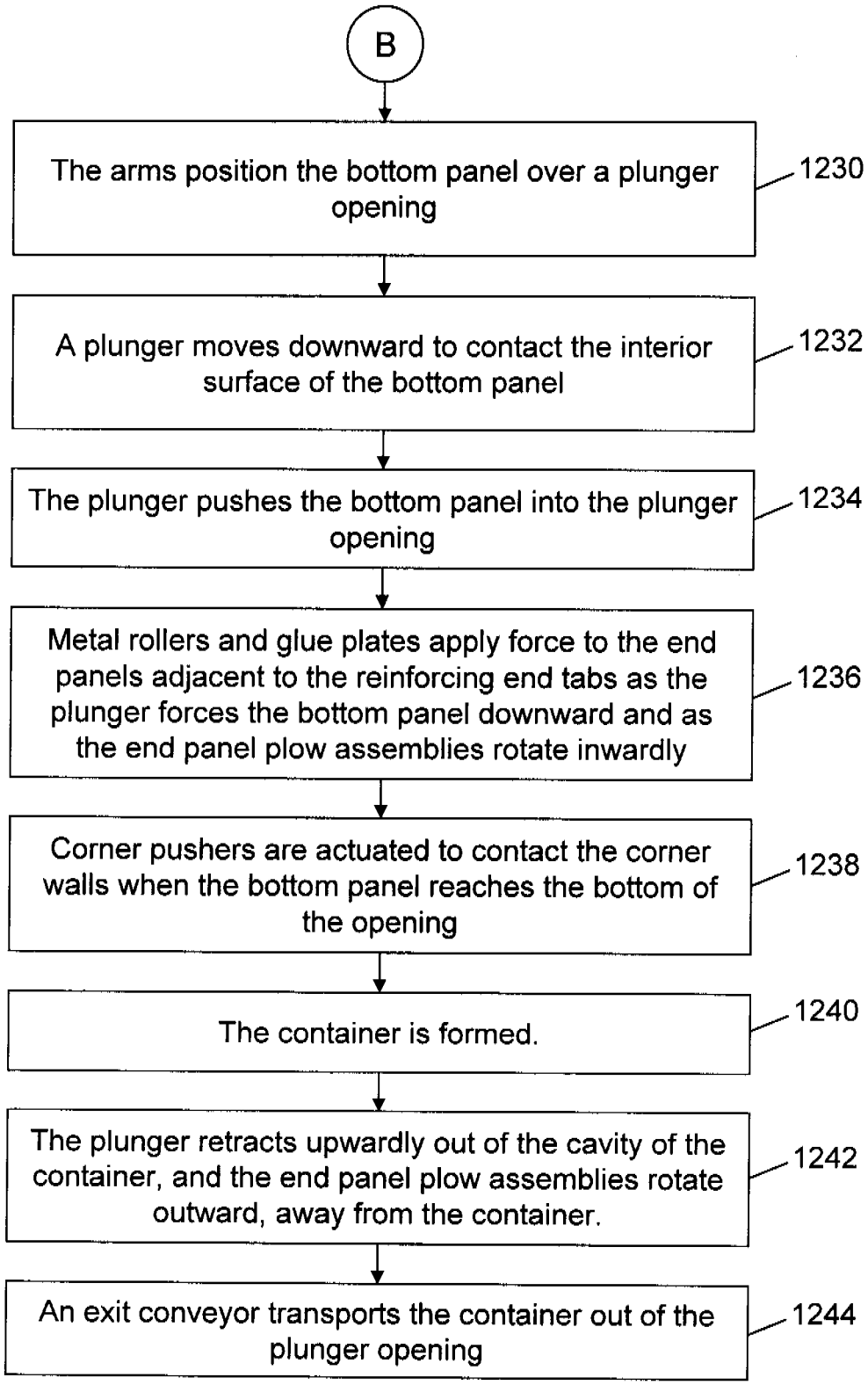

FIGS. 42A, 42B, and 42C are a flowchart of a method 1200 for forming a container 150 (shown in FIG. 2) from blank 10 (shown in FIG. 1) that may be used with machine 900 (shown in FIGS. 18-41). It should be understood that method 1200 may be used to form any suitable container, such as containers 250, 350, 450, 550, 650, 750, and/or 850 (shown in FIGS. 4, 6, 8, 9, 11, 13, 15, 17), using machine 900. Method 1200 is performed by control system 918 (shown in FIGS. 18 and 19) sending commands and/or instructions to components of machine 900. Processor 920 (shown in FIG. 18) within control system 918 is programmed with code segments configured to perform method 1200. Alternatively, method 1200 is encoded on a computer-readable medium that is readable by control system 918. In such an embodiment, control system 918 and/or processor 920 is configured to read computer-readable medium for performing method 1200.

Referring to FIGS. 18-42, method 1200 includes stacking 1202 blanks 10 in hopper 940 with exterior surfaces 14 of blanks 10 facing downward and interior surfaces 12 facing upward. Exterior surface 14 of bottom panel 22 of a first blank 10 is grasped 1204 with suction cups 948 of the feed mechanism 942. First blank 10 is pulled 1206 downward from hopper 940 through hopper station 906 using vertical actuator rods 952 to move feed mechanism 942 from the upper positioned to the lower position. The support members of hopper 940 begin folding 1208 reinforcing panels 68 towards side panels 54 and/or 60 by applying the restraining force to exterior surface 14 of reinforcing panels 68. Reinforcing panels 68 are folded 1208 with respect to side panels 54 and/or 60 to be at the first oblique angle using stationary plows 944 and moving plows 946. Moving plows 946 are stationary at the rear position as blank 10 is pulled past moving plows 946.

First blank 10 is transported 1210 forward into forming station 908 using feed mechanism 942. More specifically, horizontal actuators 954 move feed mechanism 942 in a substantially horizontal direction from the rear position to the forward position with suction cups 948 attached to bottom panel 22. Moving plows 946 follow the motion of blank 10 and/or feed mechanism 942 to retain the position of rear reinforcing panels 68. As blank 10 is transported 1210 forward, rear reinforcing panels 68 are transferred from moving plows 946 to stationary plows 944 to retain the position of reinforcing panels 68. Further, first rail sets 964 engage 1212 the forward reinforcing panels 68 as blank 10 is transported 1210 forward. Blank 10 is transported 1214 through first rail sets 964 of forming station 908 using roller 984 that is in contact with bottom panel 22. End panels 20 and 24 are supported by outer support plates 980, and bottom panel 22 is supported by center support plates 988.

As blank 10 is transported 1210 into forming station 908, adhesive is applied 1216 to interior surface 12 of side panels 54 and 60 using first adhesive applicator 996. By rotating reinforcing panels 68 prior to applying 1216 adhesive and securing inner side walls 84 to a respective side panel 54 or 60 using the adhesive, a fast-setting hot glue may be used to form container 150. More specifically, the hot glue may not allow movement between an inner side panel 84 and a respective side panel 54 or 60 after inner side panel 84 contacts the hot glue. As such, at least corner panels 90 are positioned at a predetermined angle, such as the first oblique angle, to side panels 54 and/or 60 before inner side panels 84 contact the hot glue. Further, interior surface 12 of inner reinforcing panel 82 is rotated into face-to-face contact with interior surface 12 of outer reinforcing panel 80 before inner side panel 84 contacts interior surface of side panel 54 or 60. Alternatively, a slower setting, cold glue may be used to secure inner side panels 84 or side panels 54 and/or 60. The cold glue enables inner side panels 84 to be moved with respect to a respective side panel 54 or 60 after inner side panel 84 contacts the cold glue.

First rail sets 964 fold 1218 interior surface 12 of inner reinforcing panels 82 toward interior surface 12 of a respective outer reinforcing panel 80 and folds 1218 exterior surface 14 of inner side panels 84 toward exterior surface 14 of a respective inner reinforcing panel 82. More specifically, lower rail 1002 contacts interior surface 12 of outer reinforcing panels 80 to retain the angle of outer reinforcing panels 80 with respect to side panels 54 and/or 60. Upper rail 1000 contacts exterior surface 14 of inner side panels 84. Upper rail 1000 is contoured to fold interior surface 14 of inner side panel 84 into contact with stop plate 990 and to fold interior surface 12 of inner reinforcing panel 82 into contact with interior surface 12 of outer reinforcing panel 80.

As blank 10 is transported past stop plates 990, inner side panels 84 are allowed 1220 to rotate toward side panels 54 and/or 60. As such, inner side panels 84 are adhered to side panels 54 and 60. As blank 10 is transported from first rail sets 964 into second rail sets 992, vertical rollers 1044 press inner side panels 84 into contact with adhesive and side panels 54 and/or 60. Second rail sets 992 form 1222 inner and outer reinforcing panels 80 and 82 into reinforcing end tabs 172 and corner walls 162, 164, 166, and 168. Upper rail 1004 rotates first and second reinforcing end panels 92 and 96 toward reinforcing corner panel 94. Vertical rollers 1044 contact inner side panels 84 and/or bottom panel 22, and angled rollers 1042 contact exterior surface 14 of reinforcing corner panel 94 to transport blank 10 through second rail sets 992. More specifically, angled rollers 1042 retain reinforcing corner panels 94 in position with respect to side panels 54 and/or 60. Adhesive is applied 1224 to exterior surface 14 of first reinforcing end panels 92 using second adhesive applicator 998. Partially formed container 928 is formed from blank 10 at front end 1040 of second rail sets 992.

Partially formed container 928 is transferred 1226 to plunger station 932 using pusher arms 1048 to push partially formed container 928 forward. More specifically, horizontal actuator 1052 moves bars 1050 from the rear position to the front position. As partially formed container 928 is transferred 1226, guide rails 1062 retain 1228 the positions of corner panels 90 and 94 and reinforcing end panels 92 and 96 with respect to side panels 54 and/or 60. Pusher arms 1048 position 1230 bottom panel 22 over plunger opening 1064. Plunger 1054 moves 1232 downward from the upper position toward the lower position to contact interior surface 12 of bottom panel 22 using vertical actuator 1070. Plunger 1054 pushes 1234 bottom panel 22 into and through plunger opening 1064.

End panel plow assemblies 1058 rotate inwardly toward plunger opening 1064 to fold end panels 20 and 24 to be perpendicular to bottom panel 22 as bottom panel 22 is forced downward. More specifically, end panel plows 1084 contact exterior surface 14 of end panels 20 and 24 for rotating end panels 20 and 24 about fold lines 28 and 28, respectively. Further, glue rollers 1098 and/or glue plates 1096 press 1236 interior surface 14 of end panels 20 and 24 into contact with adhesive on reinforcing end tabs 172 as partially formed container 928 is moved downward. Glue rollers 1098 and glue plates 1096 apply 1236 a force to end panels 20 and/or 24 adjacent to reinforcing end tabs 172 as plunger 1054 forces bottom panel 22 downward and as end panel plow assemblies 1058 rotate inwardly. End panels 20 and 24 are forced into contact with the adhesive on reinforcing end tabs 172 by glue roller 1098, glue plates 1096, and plunger 1054. Side panel plows 1056 fold side panels 54 and 60 and associated reinforcing end tabs 172 and corner walls 162, 164, 166, and/or 168 to be perpendicular to bottom panel 22 as bottom panel 22 is forced downward. Interior surface 12 of end panels 20 and 24 and exterior surface 14 of inner side panels 84 are positioned adjacent to plunger plates 1066 and 1068, respectively.

Corner pushers 1060 are actuated 1238 to contact corner walls 162, 164, 166, and 168 when bottom panel 22 reaches bottom 1112 of plunger opening 1064. More specifically, when machine 900 forms a container from blank 200, 400, 600, or 800, corner pushers 1060 move toward each outer reinforcing corner panel 202, 204, 206, and 208 (shown in FIG. 3) and apply a force to exterior surface 14 thereof. The applied force secures outer reinforcing corner panels 202, 204, 206, and 208 to respective corner panels 92, which has adhesive applied thereto by second adhesive applicator 998. In the exemplary embodiment, adhesive is applied to interior surface 12 of at least one outer reinforcing corner panel 202, 204, 206, and/or 208 and/or exterior surface 14 of corner panel 90. Corner pusher 1060 is controlled to rotate interior surface 12 of outer reinforcing corner panel 202, 204, 206, and/or 208 toward exterior surface 14 of corner panel 90 and to press outer reinforcing panel 202, 204, 206, and/or 208 into contact with corner panel 90 to secure outer reinforcing panel 202, 204, 206, and/or 208 to a respective corner panel 90 using the adhesive.

Container 150 is then formed 1240 from blank 10. At any suitable time during forming 1240 of container from blank 10, a second blank 10 may be pulled 1206 from hopper 940 to form a second container 150. As such, method 1200 may be performed to continuously form containers 150 using machine 900. After container 150 is formed 1240, end panel plow assemblies 1058 and/or corner pushers 1060 secure container 150 within plunger opening 1064. Plunger 1054 retracts 1242 upwardly out of cavity 170 of container 150 to the upper position, end panel plow assemblies 1058 rotate 1242 outward to the outer position, and/or corner pushers 1060 move 1242 to the outer position. As such, container 150 is released from plunger opening 1064 to fall downward to exit conveyor 922. Exit conveyor 922 transports 1244 container 150 from plunger opening 1064 and/or forming station 908. More specifically, exit conveyor 922 extends from ejection station 910 into bottom 1112 of plunger station 932 for receiving container 150 from plunger 1054 and transferring container 150 from forming station 908 to ejection station 910. When machine 900 forms a container having top panels, the container is ejected from machine 900 without the top panels rotated into position such that the container is configured to have a product placed therein.

The above-described blanks and containers provide a reinforcing polygonal container. More specifically, the embodiments described herein provide an octagonal container having reinforced corner walls, side walls, and end walls for storing and/or transporting a product therein. Further, the embodiments described herein provide a polygonal container having a top wall. More specifically, the top wall may be formed from top panels emanating from the side walls of the container or the end walls of the container. The top wall may be a full top wall covering substantially the entire cavity of the container or may be a partial top wall, such as top shoulders, that allows access to the cavity of the container when the top wall is formed. Moreover, the embodiments described herein include an outer reinforcing panel to provide further support to the containers. Embodiments not including the outer reinforcing panel may be preferable when printing is to be applied to the exterior of the container. Additionally, the blanks and containers described herein may include a support wall for additional support of the container when, for example, the containers are stacked. The support wall may also act as a partition or divider for the cavity of the container.

The machine described herein facilitates forming containers from the above-described blanks. More specifically, the machine more quickly and easily forms the containers, as compared to a person manually forming the containers from the blanks. As such, the machine facilitates producing many containers in a shorter time period, as compared to manual construction of the containers. Further, the above-described machine facilitates automating the method for forming a container from a blank such that cost and time for producing a container is reduced as compared to manually forming the containers.

Exemplary embodiments of a machine for forming a container from a blank are described above in detail. The machine is not limited to the specific embodiments described herein, but rather, components of the machine may be utilized independently and separately from other components described herein. For example, the machine may also be used in combination with other types of blanks, and is not limited to practice with only the blanks for forming a polygonal container, as described herein. Rather, the exemplary embodiment can be implemented and utilized in connection with many other container forming applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a polygonal container from a blank of sheet material using a machine, the blank including a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines, the reinforcing panel assembly extending from a first side edge of a first side panel of the two side panels, the machine including a hopper station, a corner post forming station, and a plunger station, said method comprising:

rotating the reinforcing panel assembly upwardly about a first fold line of the plurality of fold lines toward the first side panel as the blank is transported from the hopper station to the corner post forming station, an exterior surface of the blank facing downward within the hopper station;

forming a corner wall and a reinforcing end tab by folding the plurality of reinforcing panels about the plurality of fold lines as the blank is transported through the corner post forming station to the plunger station, the reinforcing end tab comprising two panels of the plurality of reinforcing panels with their respective interior surfaces in face-to-face contact;

rotating the side panels and the end panels to be substantially perpendicular to the bottom panel by directing the blank through the plunger station; and coupling the reinforcing end tab to one of the end panels to form the container;

wherein the reinforcing panel assembly includes an outer reinforcing panel extending from the first side edge of the first side panel, an inner reinforcing panel extending from a side edge of the outer reinforcing panel, and an inner side panel extending from a side edge of the inner reinforcing panel, said forming a corner wall and a reinforcing end tab further comprising:

maintaining an angle between the outer reinforcing panel and the first side panel using at least one lower rail of the corner post forming station;

rotating the inner reinforcing panel toward an interior surface of the outer reinforcing panel using a first upper rail of the corner post forming station; and rotating the inner side panel toward an exterior surface of the inner reinforcing panel by causing the inner side panel to contact a stop plate of the corner post forming station as the blank is transported through the corner post forming station;

wherein the outer reinforcing panel includes a corner panel extending from the first side edge of the first side panel and a first reinforcing end panel extending from a side edge of the corner panel, and the inner reinforcing panel includes a second reinforcing end panel extending from a side edge of the first reinforcing end panel and an inner reinforcing corner panel extending from a side edge of the second reinforcing end panel, the inner side panel extending from a side edge of the inner reinforcing corner panel, said forming a corner wall and a reinforcing end tab further comprising:

rotating the interior surface of the inner reinforcing panel into face-to-face contact with the interior surface of the outer reinforcing panel;

rotating an interior surface of the inner side panel into contact with an interior surface of the first side panel as the blank is transported past the stop plate; and rotating the first reinforcing end panel and the second reinforcing end panel toward the reinforcing corner panel by transporting the blank past a second upper rail of the corner post forming station.

2. A method in accordance with claim 1 further comprising applying an adhesive to the interior surface of the first side panel by transporting the blank past a first adhesive applicator of the corner post forming station before rotating the interior surface of the inner side panel into contact with the interior surface of the first side panel.

3. A method in accordance with claim 1 wherein:

maintaining an angle between the outer reinforcing panel and the first side panel further comprises maintaining an angle of about 135° between the outer reinforcing panel and the first side panel; and rotating the first reinforcing end panel and the second reinforcing end panel toward the reinforcing corner panel further comprises rotating the first reinforcing end panel and the second reinforcing end panel toward the reinforcing corner panel to define an angle of about 135° between the second reinforcing end panel and the reinforcing corner panel.

4. A method in accordance with claim 1 wherein rotating the side panels and the end panels to be substantially perpendicular to the bottom panel further comprises:

forcing the blank downward through a plunger opening by applying a force to the bottom panel using a plunger located at the plunger station;

applying a first force to an exterior surface of the two end panels using end panel plow assemblies located at the plunger station; and applying a second force to an exterior surface of the two side panels using side panel plows located at the plunger station.

5. A method in accordance with claim 4 wherein applying a first force to an exterior surface of the two end panels using end panel plow assemblies further comprises:

rotating a frame of each end panel plow assembly toward the plunger opening as the plunger forces the blank downward; and pressing an interior surface of a first end panel of the two end panels into contact with an exterior surface of the reinforcing end tab using at least one of a glue roller and a glue plate of a first end panel plow assembly.

6. A method in accordance with claim 4 wherein the blank includes at least one outer reinforcing corner panel extending from a first side edge of a first end panel of the two end panels and the reinforcing panel assembly includes a corner panel extending from the first side edge of the first side panel, said method further comprising:

applying adhesive to at least one of an interior surface of the at least one outer reinforcing corner panel and an exterior surface of the corner panel;

rotating the at least one outer reinforcing corner panel toward the exterior surface of the corner panel by applying a third force to the at least one outer reinforcing corner panel using a corner pusher located at the plunger station; and pressing the at least one outer reinforcing panel into contact with the corner panel with the corner pusher to secure the at least one outer reinforcing panel to the corner panel using the adhesive.

7. A method in accordance with claim 1 wherein rotating the reinforcing panel assembly further comprises:

grasping an exterior surface of the bottom panel with a feed mechanism of the hopper station;

pulling the blank from a hopper of the hopper station in a downward direction using the feed mechanism;

applying a restraining force to the reinforcing panel assembly at the hopper to rotate the reinforcing panel assembly toward an interior surface of the first side panel;

supporting the reinforcing panel assembly at a predetermined angle to the first side panel using a plow within the hopper station; and transporting the blank into the corner post forming station using the feed mechanism in a substantially horizontal direction.

8. A method in accordance with claim 1, wherein the blank includes four reinforcing panel assemblies, each reinforcing panel assembly extending from a side edge of a respective side panel, said method further comprising:

rotating each reinforcing panel assembly upwardly about a respective fold line toward a respective side panel as the blank is transported from the hopper station to the corner post forming station;

forming a corner wall and a reinforcing end tab from each of the four reinforcing panel assemblies by folding the plurality of reinforcing panels of each reinforcing panel about the plurality of fold lines as the blank is transported through the corner post forming station to the plunger station;

coupling each of four reinforcing end tabs to one of the end panels to form the container.

9. A method of forming a polygonal container from a blank of sheet material using a machine, the blank including a bottom panel having opposing side edges and opposing end edges, two opposing side panels each extending from one of the side edges of the bottom panel, two opposing end panels each extending from one of the end edges of the bottom panel, and a reinforcing panel assembly including a plurality of reinforcing panels separated by a plurality of fold lines, the reinforcing panel assembly extending from a first side edge of a first side panel of the two side panels, the machine including a hopper station, a corner post forming station, and a plunger station, said method comprising:

rotating the reinforcing panel assembly upwardly about a first fold line of the plurality of fold lines toward the first side panel as the blank is transported from the hopper station to the corner post forming station, an exterior surface of the blank facing downward within the hopper station;

forming a corner wall and a reinforcing end tab by folding the plurality of reinforcing panels about the plurality of fold lines as the blank is transported through the corner post forming station to the plunger station;

rotating the side panels and the end panels to be substantially perpendicular to the bottom panel by directing the blank through the plunger station; and coupling the reinforcing end tab to one of the end panels to form the container;

wherein the reinforcing panel assembly includes an outer reinforcing panel extending from the first side edge of the first side panel, an inner reinforcing panel extending from a side edge of the outer reinforcing panel, and an inner side panel extending from a side edge of the inner reinforcing panel, said forming a corner wall and a reinforcing end tab further comprising:

maintaining an angle between the outer reinforcing panel and the first side panel using at least one lower rail of the corner post forming station;

rotating the inner reinforcing panel toward an interior surface of the outer reinforcing panel using a first upper rail of the corner post forming station; and rotating the inner side panel toward an exterior surface of the inner reinforcing panel by causing the inner side panel to contact a stop plate of the corner post forming station as the blank is transported through the corner post forming station; and wherein the outer reinforcing panel includes a corner panel extending from the first side edge of the first side panel and a first reinforcing end panel extending from a side edge of the corner panel, and the inner reinforcing panel includes a second reinforcing end panel extending from a side edge of the first reinforcing end panel and an inner reinforcing corner panel extending from a side edge of the second reinforcing end panel, the inner side panel extending from a side edge of the inner reinforcing corner panel, said forming a corner wall and a reinforcing end tab further comprising:

rotating the interior surface of the inner reinforcing panel into face-to-face contact with the interior surface of the outer reinforcing panel;

rotating an interior surface of the inner side panel into contact with an interior surface of the first side panel as the blank is transported past the stop plate; and rotating the first reinforcing end panel and the second reinforcing end panel toward the reinforcing corner panel by transporting the blank past a second upper rail of the corner post forming station.

10. A method in accordance with claim 9 further comprising applying an adhesive to the interior surface of the first side panel by transporting the blank past a first adhesive applicator of the corner post forming station before rotating the interior surface of the inner side panel into contact with the interior surface of the first side panel.

11. A method in accordance with claim 9 wherein maintaining an angle between the outer reinforcing panel and the first side panel further comprises maintaining an angle of about 135° between the outer reinforcing panel and the first side panel; and rotating the first reinforcing end panel and the second reinforcing end panel toward the reinforcing corner panel further comprises rotating the first reinforcing end panel and the second reinforcing end panel toward the reinforcing corner panel to define an angle of about 135° between the second reinforcing end panel and the reinforcing corner panel.

12. A method in accordance with claim 9 wherein rotating the side panels and the end panels to be substantially perpendicular to the bottom panel further comprises:

forcing the blank downward through a plunger opening by applying a force to the bottom panel using a plunger located at the plunger station;

applying a first force to an exterior surface of the two end panels using end panel plow assemblies located at the plunger station; and applying a second force to an exterior surface of the two side panels using side panel plows located at the plunger station.

13. A method in accordance with claim 12 wherein applying a first force to an exterior surface of the two end panels using end panel plow assemblies further comprises:

rotating a frame of each end panel plow assembly toward the plunger opening as the plunger forces the blank downward; and pressing an interior surface of a first end panel of the two end panels into contact with an exterior surface of the reinforcing end tab using at least one of a glue roller and a glue plate of a first end panel plow assembly.

14. A method in accordance with claim 12 wherein the blank includes at least one outer reinforcing corner panel extending from a first side edge of a first end panel of the two end panels and the reinforcing panel assembly includes a corner panel extending from the first side edge of the first side panel, said method further comprising:

applying adhesive to at least one of an interior surface of the at least one outer reinforcing corner panel and an exterior surface of the corner panel;

rotating the at least one outer reinforcing corner panel toward the exterior surface of the corner panel by applying a third force to the at least one outer reinforcing corner panel using a corner pusher located at the plunger station; and pressing the at least one outer reinforcing panel into contact with the corner panel with the corner pusher to secure the at least one outer reinforcing panel to the corner panel using the adhesive.

15. A method in accordance with claim 9 wherein rotating the reinforcing panel assembly further comprises:

grasping an exterior surface of the bottom panel with a feed mechanism of the hopper station;

pulling the blank from a hopper of the hopper station in a downward direction using the feed mechanism;

applying a restraining force to the reinforcing panel assembly at the hopper to rotate the reinforcing panel assembly toward an interior surface of the first side panel;

supporting the reinforcing panel assembly at a predetermined angle to the first side panel using a plow within the hopper station; and transporting the blank into the corner post forming station using the feed mechanism in a substantially horizontal direction.

16. A method in accordance with claim 9, wherein the blank includes four reinforcing panel assemblies, each reinforcing panel assembly extending from a side edge of a respective side panel, said method further comprising:

rotating each reinforcing panel assembly upwardly about a respective fold line toward a respective side panel as the blank is transported from the hopper station to the corner post forming station;

forming a corner wall and a reinforcing end tab from each of the four reinforcing panel assemblies by folding the plurality of reinforcing panels of each reinforcing panel about the plurality of fold lines as the blank is transported through the corner post forming station to the plunger station; and coupling each of four reinforcing end tabs to one of the end panels to form the container.

* * * * *